US010655343B2

(12) United States Patent
Metzger

(10) Patent No.: US 10,655,343 B2
(45) Date of Patent: May 19, 2020

(54) FIELD-ASSEMBLED FLOORING SYSTEMS WITH ISOLATION BOARDS

(71) Applicant: James R. Metzger, Santa Ana, CA (US)

(72) Inventor: James R. Metzger, Santa Ana, CA (US)

( * ) Notice: Subject to any disclaimer, the term of this patent is extended or adjusted under 35 U.S.C. 154(b) by 0 days.

(21) Appl. No.: 16/531,106

(22) Filed: Aug. 4, 2019

(65) Prior Publication Data

US 2019/0352917 A1 Nov. 21, 2019

Related U.S. Application Data

(63) Continuation-in-part of application No. 16/269,556, filed on Feb. 6, 2019.

(60) Provisional application No. 62/627,154, filed on Feb. 6, 2018.

(51) Int. Cl.
*E04F 15/20* (2006.01)
*E04B 1/94* (2006.01)
*E04B 1/86* (2006.01)

(52) U.S. Cl.
CPC ..... *E04F 15/203* (2013.01); *E04B 1/86* (2013.01); *E04B 1/942* (2013.01)

(58) Field of Classification Search
CPC ..... E04F 15/203; E04F 15/182; E04B 1/86; E04B 1/82; E04B 1/942
See application file for complete search history.

(56) References Cited

U.S. PATENT DOCUMENTS

| | | | | |
|---|---|---|---|---|
| 7,096,630 | B1 * | 8/2006 | Keene | E04F 15/18 52/302.1 |
| 7,908,810 | B2 * | 3/2011 | Payne, Jr. | E04B 5/10 52/145 |
| 8,590,268 | B2 * | 11/2013 | Giles | E04F 15/12 52/35 |
| 2007/0000198 | A1 * | 1/2007 | Payne, Jr. | E04B 5/10 52/414 |
| 2010/0126110 | A1 * | 5/2010 | Giles | E04F 15/12 52/745.05 |
| 2019/0242140 | A1 * | 8/2019 | Metzger | E04B 1/82 |

* cited by examiner

*Primary Examiner* — Rodney Mintz
(74) *Attorney, Agent, or Firm* — Chang & Hale LLP

(57) ABSTRACT

Described herein are methods for installing field-assembled flooring systems that include isolation boards on a wall frame, a subfloor, or on both the wall frame and the subfloor. The underlayment can be a hybrid design that includes a combination of isolation panels and cementitious product. The flooring systems are configured to reduce or eliminate the curing time requirement after pouring the cementitious product (e.g., gypsum concrete). The field-assembled flooring systems can reduce or eliminate the chances of the onset of mold due to high moisture levels by removing the cementitious product from the prone areas and replacing it with structural boards. The isolation boards (e.g., cellulose fiberboards) can be installed in non-critical areas such as underneath cabinets, around the perimeter of the floor, under bathtubs, in non-walk-in closets, anywhere drywall reaches the floor, or the like. The isolation boards can be installed on walls rather than or in addition to the isolation boards installed on the subfloor.

20 Claims, 41 Drawing Sheets

FIELD-ASSEMBLED FLOORING SYSTEMS WITH ISOLATION BOARDS

CROSS-REFERENCE TO RELATED APPLICATIONS

This application is a continuation-in-part of U.S. patent application Ser. No. 16/269,556 filed Feb. 6, 2019 and entitled "FIELD ASSEMBLED FLOORING SYSTEMS," which claims priority to U.S. Prov. App. No. 62/627,154 filed Feb. 6, 2018 and entitled "FIELD-ASSEMBLED FIRE RATED FLOORING SYSTEMS," each of which is expressly incorporated by reference herein in its entirety for all purposes.

BACKGROUND

Field

The present disclosure generally relates to flooring systems and, in particular, to field-assembled floor underlayments.

Description of Related Art

Flooring systems come in a wide variety of different configurations depending upon the type of building in which they are employed and their intended use. Flooring systems generally include a finish flooring and a subfloor and can include an intermediate layer called an underlayment. Finish flooring is generally the uppermost layer of the flooring system. Known finish flooring materials include wood flooring and resilient flooring. Resilient flooring comprises linoleum, asphalt tiles, vinyl or rubber tiles and the like. The subfloor is typically the structure of the building which supports the remainder of the floor system. Some subfloor materials include wood, such as plywood, or reinforced concrete. Flooring systems, especially those including reinforced-concrete subfloors, may additionally include a vapor barrier and/or acoustic- or fire-rated materials in the underlayment.

SUMMARY

According to a number of implementations, the present disclosure relates to a method for installing a hybrid underlayment having a combination of structural boards and a cementitious product. The method includes applying adhesive to adhere an isolation board to a subfloor in a targeted area, the targeted area lying within a first portion of the subfloor. The method also includes installing the isolation board to the subfloor with the adhesive in the targeted area so that there is a gap between adjacent isolation boards and walls. The method also includes applying adhesive to adhere a bottom side of a structural board to a top side of the installed isolation board. The method also includes installing the structural board on top of the installed isolation board. The method also includes pouring cementitious product in a second portion of the subfloor so that the poured cementitious product is level with a top side of the structural board. A combination of the isolation board and structural board provide a pour stop for the cementitious product.

In some embodiments, the method further includes fastening the isolation board in place with nails. In some embodiments, the method further includes fastening the structural board in place with nails.

In some embodiments, the first portion and the second portion cover the entire subfloor. In some embodiments, the isolation board comprises a fire-rated cellulose fiberboard. In some embodiments, the structural board comprises a fire-rated cellulose fiberboard In some embodiments, a thickness of a combination of the installed isolation board and the installed structural board is greater than or equal to 1 inch and less than or equal to 2 inches. In some embodiments, the cementitious product comprises gypsum concrete. In some embodiments, a width of the isolation board is less than or equal to 96 inches. In some embodiments, a width of the isolation board is less than or equal to 6 inches and greater than or equal to 4 inches.

According to a number of implementations, the present disclosure relates to a flooring system having a hybrid underlayment. The flooring system includes an isolation board adhered to a first portion of a subfloor. The flooring system also includes a structural board adhered to the isolation board, the structural board having a thickness so that a combined thickness of the isolation board and the structural board is a targeted thickness. The flooring system also includes a cementitious product poured on a second portion of the subfloor, the cementitious product poured to have a thickness that is equal to the targeted thickness. A combination of the isolation board and the structural board serves as a pour stop for the cementitious product.

In some embodiments, the first portion of the subfloor does not extend beyond a footprint of a bathtub in a finished building. In some embodiments, the first portion of the subfloor is situated in a dead space of a finished building. In some embodiments, the first portion of the subfloor is restricted to a floor of a closet of a finished building. In some embodiments, the first portion of the subfloor does not extend more than 12 inches from a wall of a finished building. In some embodiments, the first portion of the subfloor does not extend beyond a footprint of a kitchen island in a finished building. In some embodiments, the combined thickness is greater than or equal to 1 inch and less than or equal to 2 inches. In some embodiments, the cementitious product comprises gypsum concrete. In some embodiments, the isolation board comprises fire-rated cellulose fiberboard. In some embodiments, the structural board comprises fire-rated cellulose fiberboard.

According to a number of implementations, the present disclosure relates to a method for installing a flooring system. The method includes securing wall isolation boards to studs of a wall frame so that a bottom edge of the wall isolation board is adjacent to a subfloor and a top edge of the wall isolation board is less than or equal to about 12 inches above the subfloor, the wall isolation boards being installed adjacent to one another to cover a portion of the wall frame. The method also includes installing a sound control membrane over a portion of the subfloor. The method also includes installing an isolation strip to a face of the wall isolation boards with a bottom edge of the isolation strip adjacent to the sound control membrane. The method also includes pouring cementitious product over the sound control membrane so that the poured cementitious product reaches a targeted height that does not exceed a top edge of the isolation strip.

In some embodiments, securing the wall isolation boards to the wall frame includes using at least two dry wall screws for each wall isolation board. In some embodiments, the method further includes applying a tape material at a transition between the sound control membrane and the isolation strip. In some embodiments, the sound control membrane extends over the entire subfloor between wall frames of a building. In some embodiments, the wall isolation boards comprise fire-rated cellulose fiberboard. In some embodiments, a thickness of the wall isolation boards is greater than or equal to about 0.5 inches and less than or equal to about 1 inch. In some embodiments, the cementitious product comprises gypsum concrete. In some embodiments, the targeted height is less than or equal to about 1.5 inches. In some embodiments, an edge of the sound control membrane is adjacent to the wall isolation boards.

According to a number of implementations, the present disclosure relates to a method for installing a flooring system. The method includes securing wall isolation boards to studs of a wall frame so that a bottom edge of the wall isolation board is adjacent to a subfloor and a top edge of the wall isolation board is less than or equal to about 12 inches above the subfloor, the wall isolation boards being installed adjacent to one another to cover a portion of the wall frame. The method also includes securing floor isolation boards to a first area of the subfloor, wherein the floor isolation boards are adjacent to the wall isolation boards. The method also includes installing a sound control membrane over a portion of a second area of the subfloor. The method also includes pouring cementitious product over the second area of the subfloor so that the poured cementitious product reaches a targeted height that does not exceed a top edge of the floor isolation boards.

In some embodiments, securing the wall isolation boards to the wall frame includes using at least two dry wall screws for each wall isolation board. In some embodiments, securing the floor isolation boards to the subfloor includes using a combination of adhesives and mechanical fasteners. In some embodiments, the method further includes applying a tape material at a transition between the sound control membrane and the floor isolation boards. In some embodiments, the sound control membrane extends over the entire second area of the subfloor. In some embodiments, the wall isolation boards comprise fire-rated cellulose fiberboard. In some embodiments, the floor isolation boards comprise fire-rated cellulose fiberboard. In some embodiments, a thickness of the wall isolation boards is greater than or equal to about 0.5 inches and less than or equal to about 1 inch. In some embodiments, a thickness of the floor isolation boards is greater than or equal to about 1 inch and less than or equal to about 2 inches. In some embodiments, the cementitious product comprises gypsum concrete. In some embodiments, the method further includes installing drywall above the wall isolation boards.

For purposes of summarizing the disclosure, certain aspects, advantages and novel features have been described herein. It is to be understood that not necessarily all such advantages may be achieved in accordance with any particular embodiment. Thus, the disclosed embodiments may be carried out in a manner that achieves or optimizes one advantage or group of advantages as taught herein without necessarily achieving other advantages as may be taught or suggested herein.

BRIEF DESCRIPTION OF THE DRAWINGS

Various embodiments are depicted in the accompanying drawings for illustrative purposes and should in no way be interpreted as limiting the scope of the inventions. In addition, various features of different disclosed embodiments can be combined to form additional embodiments, which are part of this disclosure. Throughout the drawings, reference numbers may be reused to indicate correspondence between reference elements. The drawings are not necessarily to scale so unless otherwise indicated no relative or absolute dimensions should be inferred from the following figures.

DETAILED DESCRIPTION OF SOME EMBODIMENTS

Figure 1A:
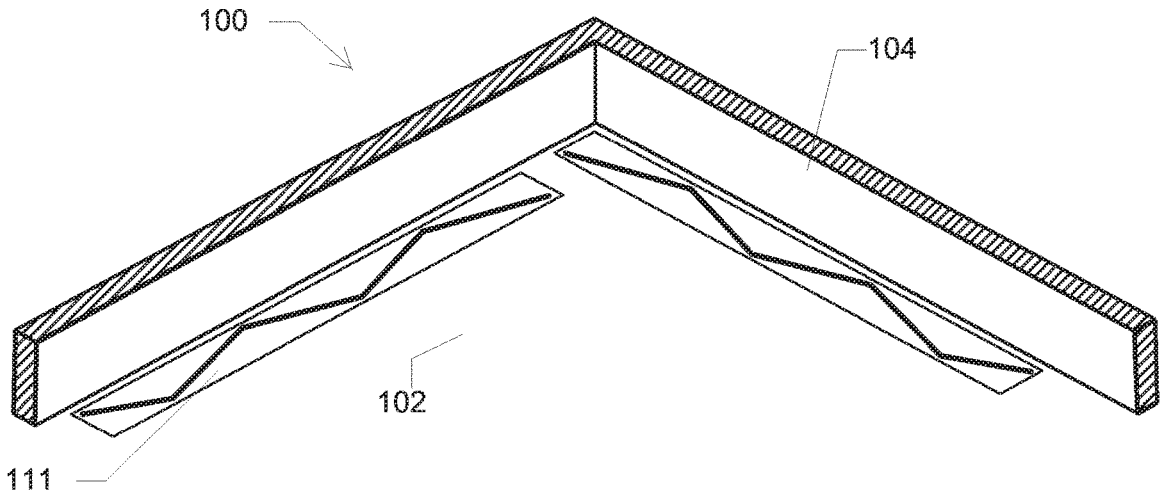
FIGS. 1A, 1B, 1C, 1D, 1E, 1F, and 1G illustrate installation of an underlayment layer of flooring using fiber boards for an inside corner binder.

The headings provided herein, if any, are for convenience only and do not necessarily affect the scope or meaning of the claimed invention.

Overview

Flooring in buildings such as dwellings typically include a subfloor, an underlayment, and a finish floor or floor covering. The topmost layer is the finish floor which is the visible and exposed part of the floor. This layer is not required to provide structural support, but often provides a type of supplementary support. The bottom-most layer is the subfloor. The subfloor is the thick flat surface on which all other layers rest. The subfloor may rest on joists, the foundation, or other structure, or in the case of a concrete slab, the slab may be considered the subfloor.

Underlayment is a layer that sits between the subfloor and the finish floor. The underlayment can facilitate the laying of floor coverings, for example, carpet, tile, wood parquet, and vinyl, and may result in a more stable finished floor. The underlayment may also have sound reduction properties. This is particularly significant where the maximum allowable level of sound transmission is controlled by local building codes, which is increasingly common. For example, underlayment can be used to reduce the transmission of sound through the floor to a room below in a multi-floor building. Underlayment may typically be a cementitious product, such as gypsum concrete, or cellulose fiberboards. Many pourable floor topping mixtures, which are suitable for incorporation in underlayment systems, are gypsum-based, in order to provide a level of fire protection by retarding the spread of flames. An example of gypsum-based floor topping mixtures is GYP-CRETE®, which is available from MAXXON® Corporation. Gypsum-based pourable floor toppings are generally installed in dwellings, which are under construction and subject to building codes that require minimum fire ratings.

Cementitious underlayment products have some sound reduction properties; however, the use of cementitious underlayment products and other similar products pose significant challenges for builders. One significant issue is that such products are applied as a wet product (e.g., poured as a thick fluid onto a subfloor) into an otherwise dry environment (e.g., a wood framed building). When such a wet product is applied to a dry environment, the moisture can adversely affect the building process. Issues such as warping of wooden elements, splashing onto unintended surfaces, etc. are common. Furthermore, introducing moisture into any environment increases the chances of mold growth in the environment, which is always an unwanted condition. Another issue is that the application of any wet product typically requires a drying, curing, or setting period following the pouring or application of the wet product. Such periods can cause delays in construction and complicate the planning and project management between various contractors and workers.

Pourable floor toppings are typically installed in two stages: first, over the portions of a dwelling subfloor where fixtures such as bath tubs are to be installed (these portions being designated as pre-pour areas); and, then, over the remainder of the subfloor, following the installation of the fixtures. Although the pre-pour areas are relatively small compared to the remainder of the subfloor, installation of the pourable floor topping to the pre-pour areas requires dispatching to the construction site all of the necessary equipment and crew that, subsequently, must be dispatched again, after installing the bathtubs and other such fixtures, to install the remainder of the floor topping to complete the underlayment system.

Underlayments that use structural boards, such as fiberboards, in place of cementitious products also present difficulties. For example, structural boards typically do not pass acoustical rating requirements for buildings in certain geographical locations. In addition, fiberboards may be more difficult to install finish flooring on top.

Accordingly, to address these and other challenges and to satisfy demands in the marketplace, described herein are methods for installing field-assembled flooring systems wherein the underlayment is a hybrid design that includes a combination of structural board and cementitious product. The hybrid design is configured to reduce or eliminate the curing time requirement after pouring the cementitious product (e.g., gypsum concrete). In some embodiments, the field-assembled flooring systems can reduce or eliminate the chances of the onset of mold due to high moisture levels by removing the cementitious product from the prone areas and replacing it with structural boards. Similarly, the disclosed installation methods may reduce construction time and cost by enabling a single pour for the cementitious product rather than two pouring stages, as is the case in some construction projects. The structural boards (e.g., fiberboards) can be installed in non-critical areas such as, for example and without limitation, underneath cabinets, around the perimeter of the floor, under bathtubs, in non-walk-in closets, anywhere drywall reaches the floor, or the like.

Moreover, described herein are methods for installing flooring systems that have isolation boards or panels secured to a wall to improve isolation. The flooring systems can include isolation panels on the walls and can be installed with or without isolation boards being used as part of the underlayment. For example, isolation panels can be installed on a wall using fasteners and a cementitious product can be poured to form the underlayment wherein the cementitious product contacts the isolation panels installed on the wall. As another example, wall isolation panels can be installed on a wall using fasteners and floor isolation panels can be installed on portions of the subfloor and a cementitious product can be poured to form the underlayment in combination with the floor isolation boards. In these embodiments, a sound control membrane can also be installed on the subfloor or as part of the underlayment. Tape may also be used in conjunction with the isolation boards and the sound control membrane during installation.

The disclosed methods include the use of structural panels, adhesive, and fasteners (e.g., ring shank coil nails). In some embodiments, the structural panels can be a cellulose fiber structural panel. For example, the cellulose fiber structural panel can be molded out of paper or other wood products (e.g., recycled post-consumer paper). The structural panels may also be referred to as isolation boards or panels due at least in part to their functionality in isolating different elements of a building (e.g., providing sound reduction, providing fire resistance, isolating poured cementitious products from fixtures or walls, etc.).

In certain implementations, structural or isolation boards can have a thickness of about 0.75 inches with a density of about 26-28 lbs. per cubic foot. In certain implementations, the structural or isolation boards can be between about ⅝ in. and about 1.5 in. thick. These are merely example values and fiberboards with other densities and thicknesses may be used. An example of such a board is manufactured by HOMASOTE® Company called the 440 SOUNDBARRIER®. This panel can be milled to be a targeted size (e.g., 6 in.×96 in.). In some embodiments, multiple boards can be installed on top of each other to achieve a targeted thickness (e.g., about 1.25 in., about 1.5 in., etc.).

The boards can be installed using any suitable combination of adhesives and/or fasteners. A typical suitable adhesive can have a base that is a synthetic rubber with polymer resins. Typically, such adhesives can have a full cure time of about 2 to 5 days. The adhesive can be applied in a designated or targeted pattern to adhere a first layer to the subfloor and to adhere a second layer to the first layer. Additional layers may also be installed in a similar fashion.

A typical suitable fastener includes ring shank coil nails. The ring shank coil nails can be installed using an offset pattern on a first layer of structural or isolation panels prior to placement of the adhesive to secure the second panel layer. Installation of these nails can be used to secure the first layer in place on the subfloor. Similarly, after the second layer has been secured to the first layer using the adhesive, additional nails can be used in a reverse offset pattern to secure the second layer in place while the adhesives dry and cure. The nails can be placed to create even distribution of the fasteners. For example, the fasteners can be about 8 in. on center. By applying two or more layers of the milled structural panels or boards with a ⅛" gap between panel edges and walls, the sound and fire rating of the hybrid system is improved relative to a unitary system of just structural panels or just cementitious products.

The structural panels or boards can be strategically placed during construction to achieve targeted performance characteristics for fire rating and sound rating. For example, to satisfy fire rating requirements, the structural boards can be adhered and fastened in the following non-critical areas: underneath bathtubs, closets, dead spaces, near walls, prone areas, under cabinets, under kitchen islands, and the like. One or more additional layers of the structural panels can be secured to the first layer to achieve a targeted thickness to provide a pour stop for the cementitious product. Moreover, isolation boards can be installed on walls in addition to or instead of installing isolation boards to the floor, to provide the described advantages.

Example Hybrid Underlayment Installations

FIGS. 1A, 1B, 1C, 1D, 1E, 1F, 1G, 1H, and 1I illustrate installation of an underlayment layer 100 of flooring using fiber boards 110, 112 for an inside corner binder. The flooring can be for single or multi-family housing, high and low-rise apartments and condominiums, motels, schools, professional buildings, assisted living facilities, or the like. The underlayment 100 extends between subfloor 102 and finish flooring 120. Underlayment 100 provides several functions including moisture blockage, cushioning, sound attenuation, fire rating, insulation, structure, and the like.

The subfloor 102 can be a cement slab or a wood subfloor. The finish flooring 120 can be any suitable flooring such as tile, wood, laminate, carpet, or the like. The subfloor 102 can extend between walls 104 that are either external walls or internal walls for a building.

FIG. 1A illustrates the subfloor 102 and walls 104 with an adhesive 111 deposited or applied in a pattern in a first portion of the subfloor 102. The adhesive 111 is configured to adhere an isolation board 110 to the subfloor within the first portion of the subfloor 102. The adhesive 111 can be, for example and without limitation, a polyurethane-based, moisture-curing subfloor bonding adhesive. The adhesive material is configured to be compatible with both the material of subfloor 102 and the isolation board 110.

Figure 1B:
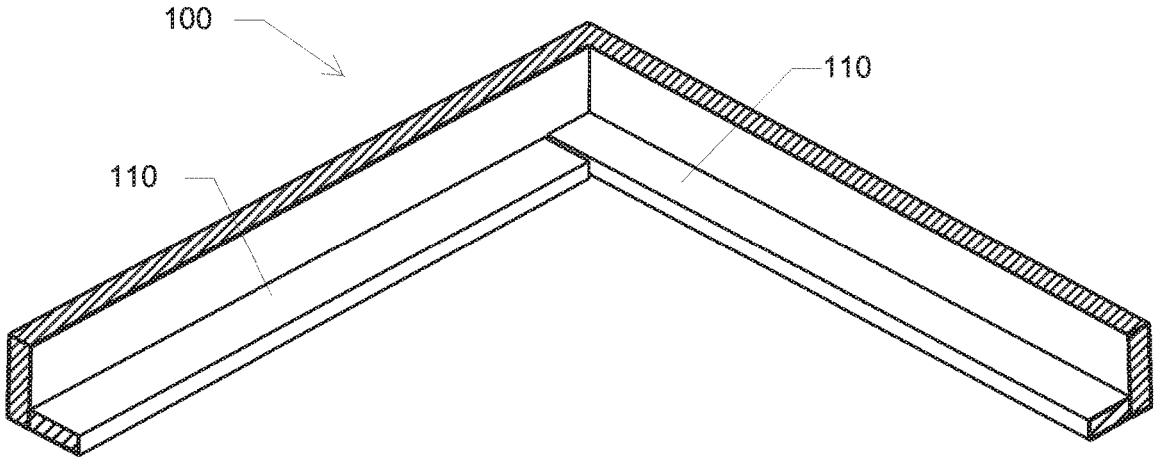

FIG. 1B illustrates installation of the isolation board 110 on the applied adhesive 111. The isolation board 110 is installed so that it lies within the first portion of the subfloor 102. The first portion of the subfloor is a non-critical area here it is advantageous to use structural boards instead of cementitious products. Non-critical areas include, for example and without limitation, underneath bathtubs, closets, dead spaces, near walls, prone areas, under cabinets, under kitchen islands, and the like. In some embodiments, the first portion covers an area that extends less than or equal to 96 inches from the wall 104, less than or equal to 48 inches from the wall 104, less than or equal 24 inches from the wall 104, less than or equal to 12 inches from the wall 104, less than or equal to 8 inches from the wall 104, or less than or equal to 6 inches from the wall 104. The isolation board 110 can be installed so that there is a gap 106 between adjacent isolation boards and the wall 104. The gap 106 can be about ⅛ inches to about 3/16 inches. The gap 106 can be configured to allow the isolation boards 110 to expand and contract.

The isolation board 110 can be a fiberboard, such as a cellulose fiberboard. The isolation board 110 can have a thickness of about ½ inch or between about ¼ inch and 1 inch. The isolation board 110 can be a fire-rated and/or sound-rated structural board tested and approved for construction purposes. Thus, the isolation board 110 can be different from the structural board 112 installed on top of the isolation board 110 because although the structural board 112 may possess similar fire-rating and sound-rating characteristics as the isolation board 110, the structural board 112 does not need to be tested and approved for construction purposes. For example, the isolation board 110 can be required to pass construction standards whereas the structural board 112 can be used without passing the same construction standards. However, it is to be understood that the isolation board 110 and the structural board 112 can be the same board (e.g., made from the same material with the same physical properties).

In some embodiments, the isolation board 110 comprises two or more structural boards pressed together to form a composite board. In some embodiments, the isolation board 110 is a structural board made from cellulose fiber. The isolation board 110 can be made using a homogeneous composition with protection against termites, rot and fungi and resistance to moisture. In some embodiments, the isolation board 110 is particleboard or fiberboard made from cellulose fibers, typically from wood, that are bonded together with a synthetic binder or resin. The isolation board 110 can be manufactured using man-made consolidated cellulosic articles, such as fiberboard, hardboard (e.g., low-density or high-density hardboard), soft board, high-density fiberboard (HDF), medium density fiberboard (MDF), chipboards, particleboard, medium-density particleboard, oriented strandboard (OSB), or the like. In some embodiments, the isolation board 110 can have a density between about 26 and about 28 lb./ft$^3$. In some embodiments, the isolation board 110 can comprise engineered wood products prepared from wood fiber extracted from chips and pulped wood waste. In certain embodiments, the isolation board 110 can have a density greater than about 50 lb/ft$^3$, including values of greater than 60 lb/ft$^3$, 70 lb/ft$^3$, 80 lb/ft$^3$, 90 lb/ft$^3$, or greater than 100 lb/ft$^3$. In certain implementations, to improve water resilience, processing oils can be added during the board formation under high temperature and pressure. In various embodiments, the isolation board 110 can be prepared from wood wastage fibers glued together with resin or glued under heat and pressure. In certain aspects, the isolation board 110 has a density of between about 30 lb/ft$^3$ and about 50 lb/ft$^3$, including values of 35 lb/ft$^3$, 40 lb/ft$^3$, and 45 lb/ft$^3$.

Figure 1C:
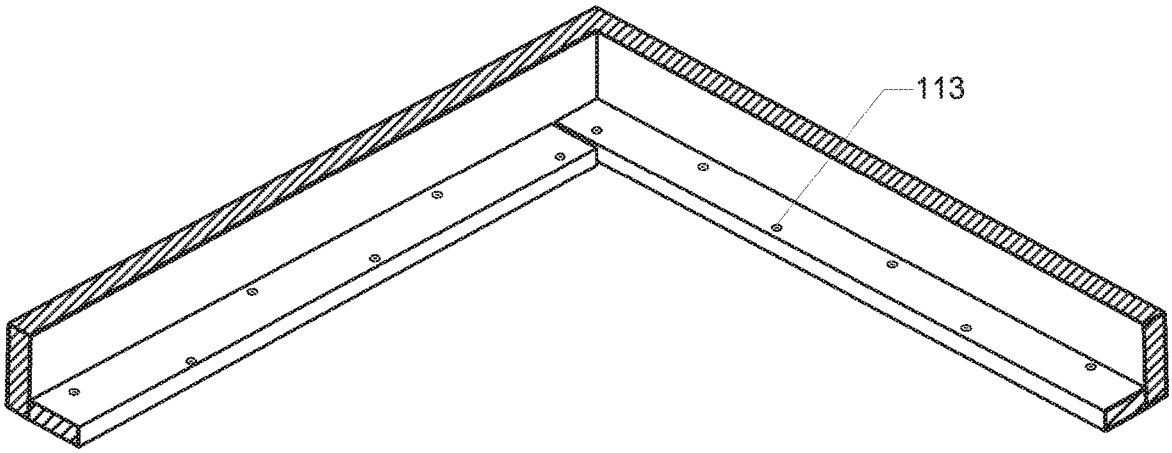

FIG. 1C illustrates one or more mechanical fasteners 113 (e.g., nails) being driven into the isolation board 110 to secure the isolation board 110 to the subfloor 102. Fastening the isolation board 110 to the subfloor 102 can be used to secure the isolation board 110 in place while the adhesive 111 cures or dries. In some embodiments, the nails 113 can be wire ring shank coil nails. The nails 113 can be, in some embodiments, 1.25"×0.080 15 deg. wire ring shank coil nails. The nails 113 can be installed or driven into the isolation board 110 using a ⅛-inch countersink. The nails 113 can be annular threaded nails or screws. The nails 113 can be installed at regular intervals in an offset pattern. In some embodiments, the nails can be spaced about 8 inches to about 10 inches apart and can be positioned at least about ½ inch away from an edge of the isolation board 110.

In some embodiments, the plurality of mechanical fasteners, e.g., either nails or screws, may be used to secure the isolation board 110. In some embodiments, the isolation board 110 may be secured to the subfloor 102 via any suitable adhesive, either independently of, or in conjunction with one or more mechanical fasteners.

Figure 1D:
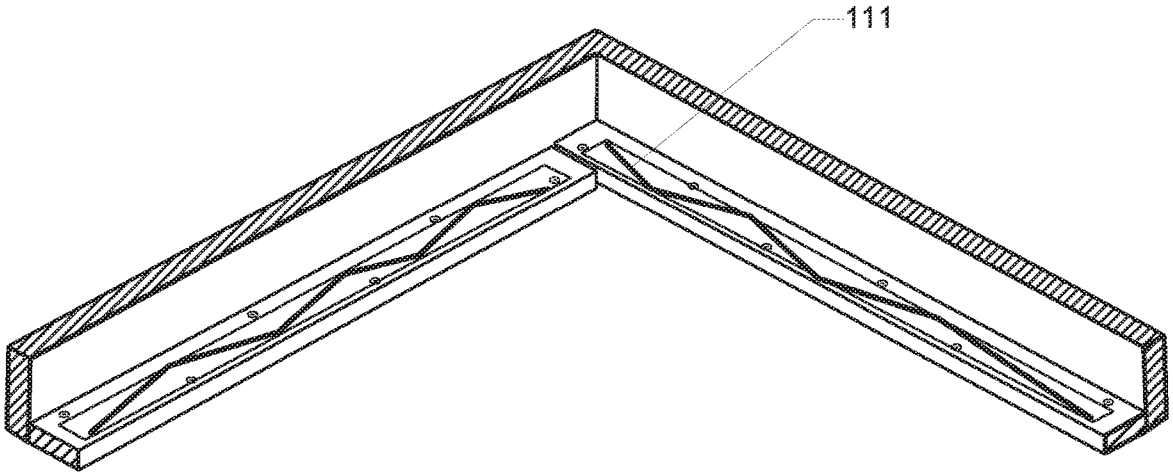
Figure 1E:
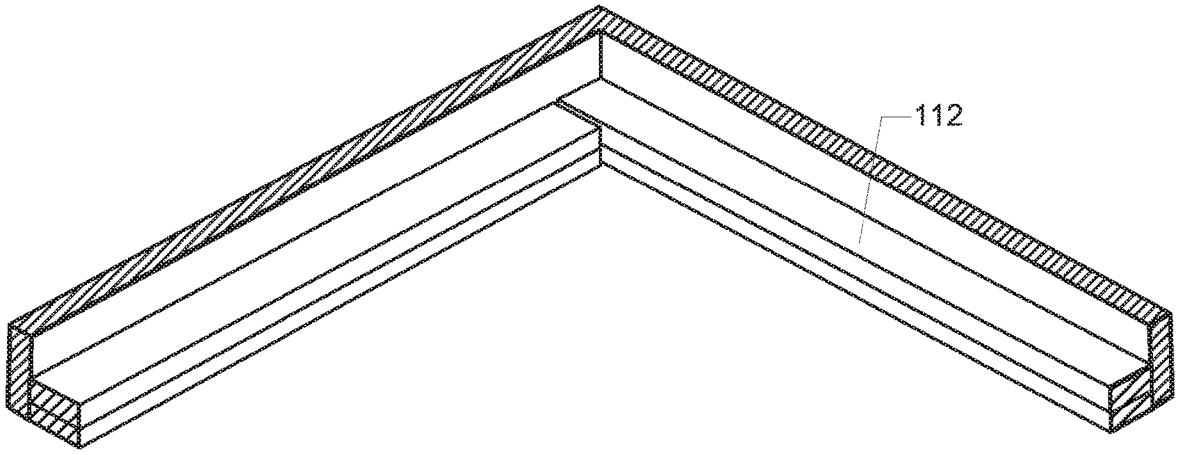

FIG. 1D illustrates application of another layer of the adhesive 111. FIG. 1E illustrates installation of the structural board 112 on top of the isolation board 110. The structural board 112 can be the same material as the isolation board 110. The structural board 112 can have the same or different thickness as the isolation board 110. The structural board 112 and the isolation board combine to form a barrier or pour stop for the cementitious product 115. In some embodiments, the structural board 112 is a class A, 1-hour, fire-rated, water-resistant type board. The structural board 112 can be a pressed structural type board made from either cellulose fiber, wood, sheathing, or fiberglass matted material. The structural board 112 can be cut or milled from a board or panel, being cut into strips ranging from about 1 inch to about 48 inches in width with a thickness from about ½ inch to about 1.5 inches. In some embodiments, the structural board has a width that is greater than or equal to about 4 inches and less than or equal to about 6 inches, greater than or equal to about 3 inches and less than or equal to about 12 inches, greater than or equal to about 2 inches and less than or equal to about 24 inches, or greater than or equal to about 1 inches and less than or equal to about 48 inches.

The structural board 112 and the isolation board 110 can be selected, milled, and stacked so that corresponding edges of each board align with one another. This can be done to maintain the gap 106 between adjacent boards and the wall 104. However, in some embodiments as described herein, the isolation board 110 and the structural board 112 can be offset from one another.

Figure 1F:
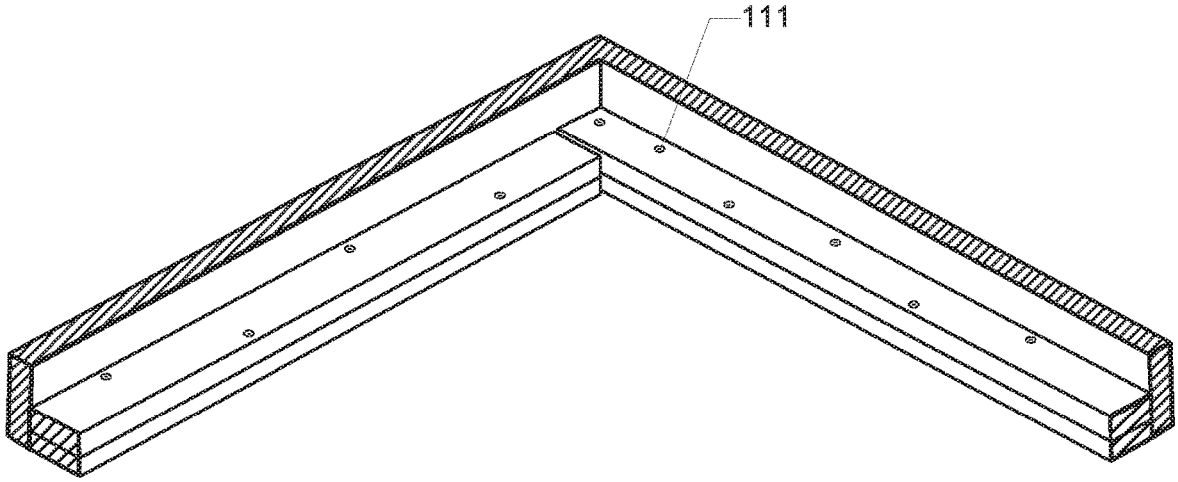

FIG. 1F illustrates one or more nails 113 being driven into the structural board 112 to secure the structural board 112 to the isolation board 110. Fastening the structural board 112 to the isolation board 110 can be used to secure the structural board 112 in place while the adhesive 111 cures or dries.

Figure 1G:
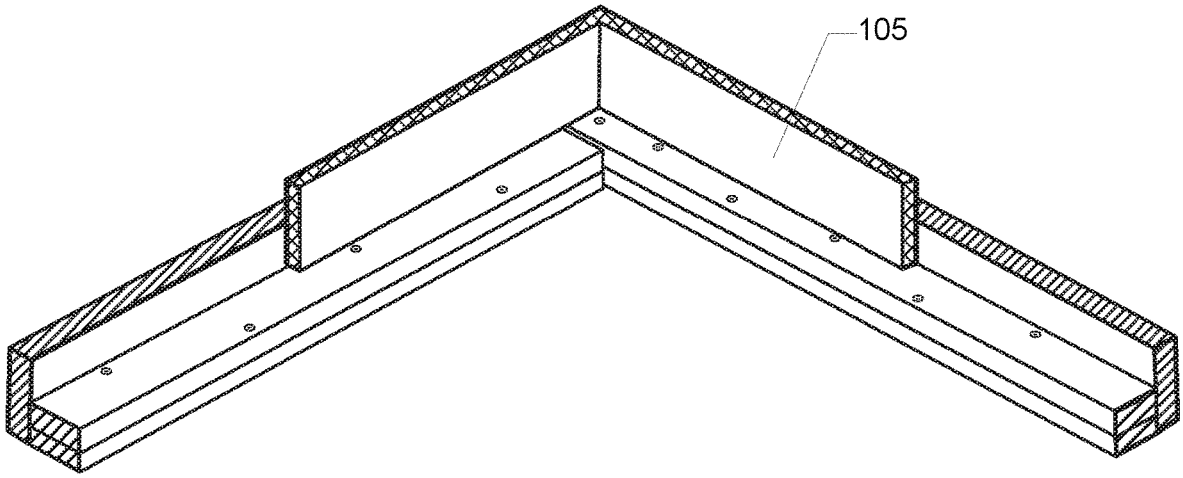

FIG. 1G illustrates installation of drywall over the top layer of the underlayment 100. The drywall 105 can be configured to be installed on top of the structural board 112. In some embodiments, the drywall 105 can be installed in a gap between the wall 104 and the combination of the isolation board 110 and the structural board 112 so that the drywall 105 and the combined boards are butted up to one another.

Figure 1H:
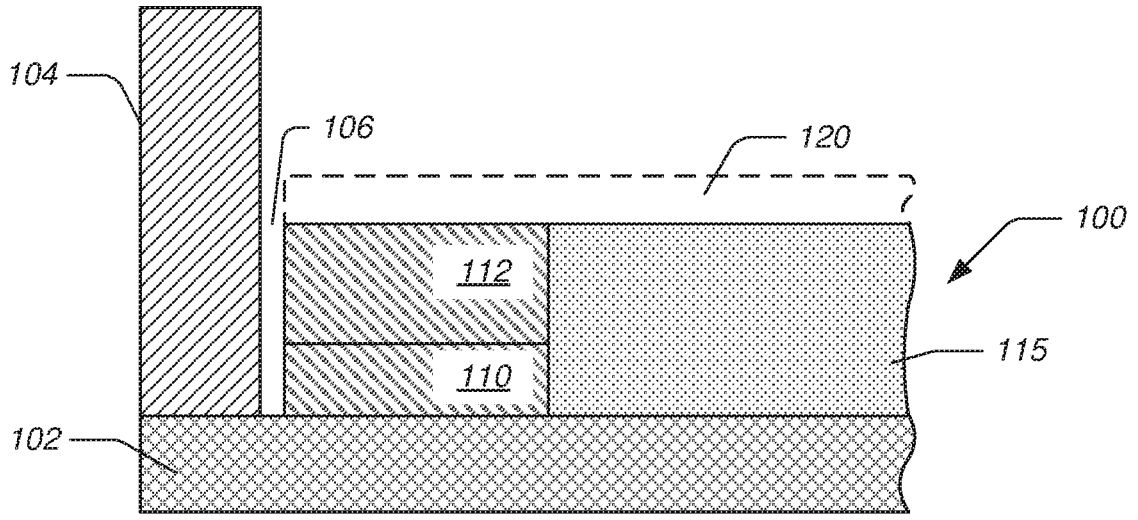
FIGS. 1H and 1I illustrate cross-sections of the flooring of FIGS. 1A-1G after installation of a cementitious product.

FIG. 1H illustrates a cementitious product 115 installed onto the flooring system of FIGS. 1A-1F. After the installation procedure described and illustrated in FIGS. 1A-1F (and before or after installation of the drywall 105 in FIG. 1G), the cementitious product 115 can be poured to form a poured underlayment that abuts an edge of the combination of the isolation board 110 and the structural board 112 and, preferably, adheres thereto. The term "pour" is used broadly herein to encompass any suitable method for applying the cementitious product 115 so that the cementitious product 115 is directed to flow, or spread, over the subfloor 102. In some embodiments, the area over which the cementitious product 115 is to be poured can be primed prior to pouring. The primer can be applied for example, via spraying or rolling, according to known methods.

The cementitious product 115 can be a self-leveling gypsum cement or other cementitious lightweight concrete. The term light-weight concrete is used herein as a generic description for a concrete topping that is less dense than standard concrete. An example of the cementitious product 115 includes a material commonly referred to as gypsum concrete or gyp-crete. Gyp-crete is a building material that can be used as a floor underlayment in wood-frame and concrete construction for fire ratings, sound reduction, radiant heating, and floor leveling. Gyp-crete comprises atmospheric calcined gypsum, sand, water, and small amounts of various additives. Additives may include polyvinyl alcohol, an extender such as sodium citrate or fly ash, a surfactant such as colloid defoamer 1513 DD made by Colloids, Inc., and a fluidizer based on sodium or potassium derivatives of naphthalene sulfonate formaldehyde condensate.

The combination of the structural board 112 and the isolation board 110 form a barrier to the cementitious product as it is poured. The cementitious product 115 can be poured until it is level with a top side of the structural board 112 to form a level underlayment 100. Thus, the isolation board 110 (in combination with the structural board 112) can cover a first portion of the subfloor 102 while the cementitious product 115 can cover a second portion of the subfloor 102. In total, the first portion and the second portion can make up the entire area of the subfloor 102, or the total area of the subfloor 102 that is to receive the underlayment 100. The first portion can be divided into various locations, wherein individual first portion locations have a size approximately equal to a footprint of a fixture, for example, a bathtub, a closet, a kitchen island, cabinets, or the like. The first portion may be designated as a pre-pour area over isolation board 110 and structural board 112 is laid prior to installing the fixture. The second portion is located adjacent to the first portion, making up the remainder of the subfloor 102. The second portion is left substantially exposed for the installation of the poured cementitious product 115.

Figure 1I:
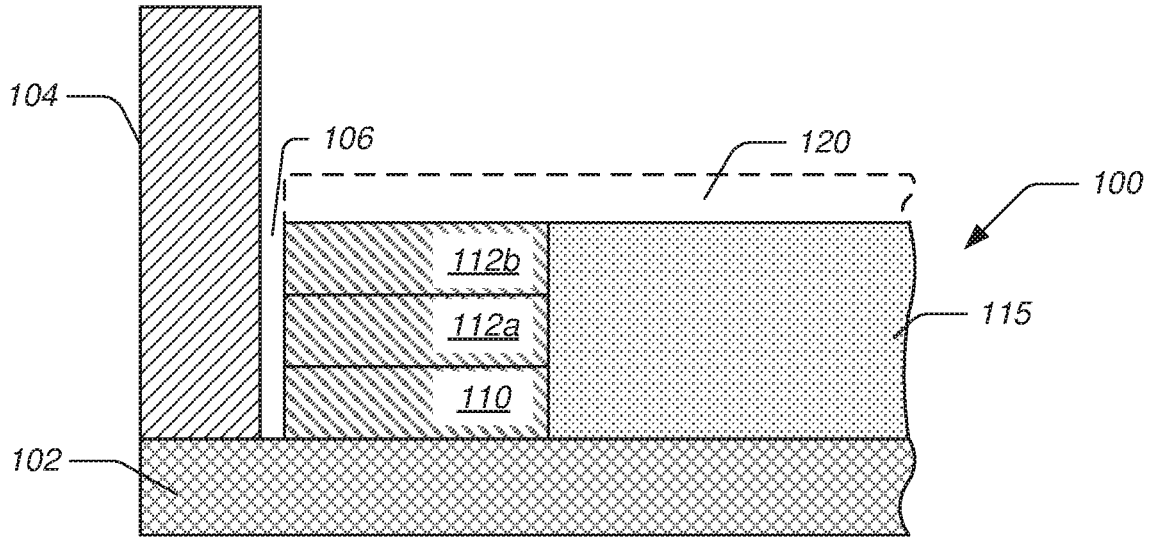

FIG. 1I illustrates the underlayment 100 wherein two structural boards 112*a*, 112*b* are used to achieve a targeted thickness. Thus, one or more structural boards 112 can be used to achieve the targeted thickness. Additionally, after the underlayment 100 has been installed, finish flooring 120 can be installed to finish installation of the flooring system.

FIGS. 2A, 2B, 2C, 2D, 2E, and 2F illustrate another example installation of an underlayment layer 200 of flooring using fiberboards for a perimeter board binder. The installation follows the same installation steps described herein with reference to FIGS. 1A-1F except that the structural board 112 is installed offset from the insulation board 110 so that the gap 206*a* between adjacent isolation boards 110 does not align with the gap 206*b* between adjacent structural boards 112.

Figure 2A:
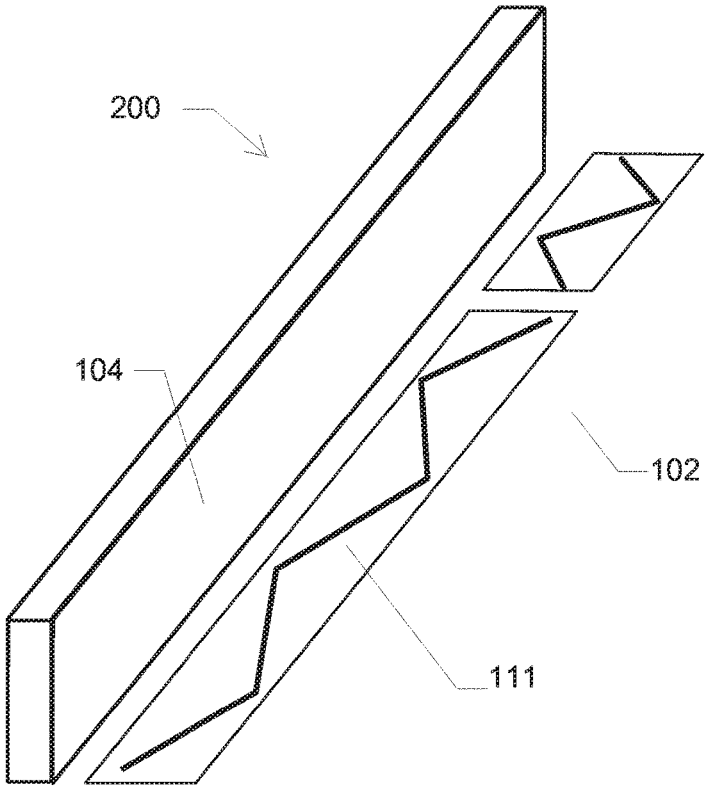
FIGS. 2A, 2B, 2C, 2D, 2E, and 2F illustrate another example installation of an underlayment layer of flooring using fiber boards for a perimeter board binder.
Figure 2B:
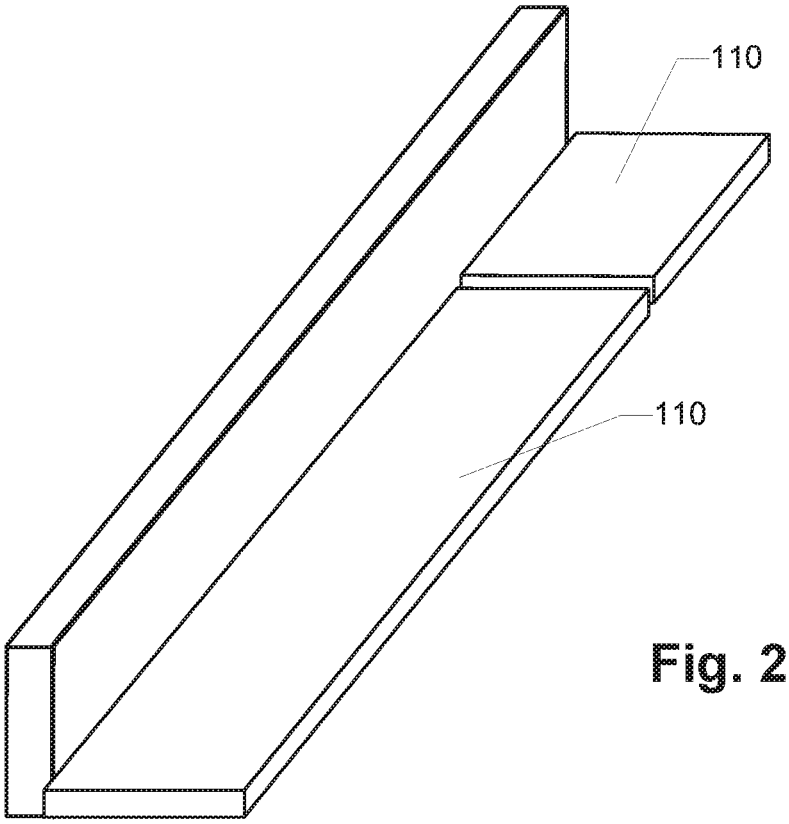
Figure 2C:
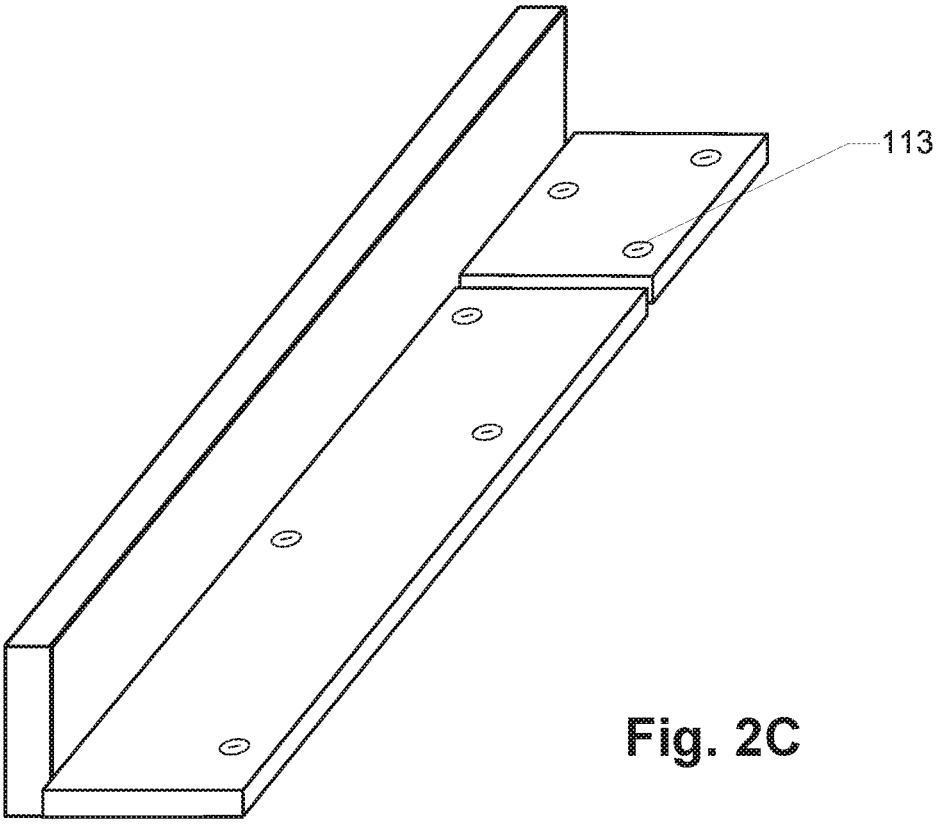
Figure 2D:
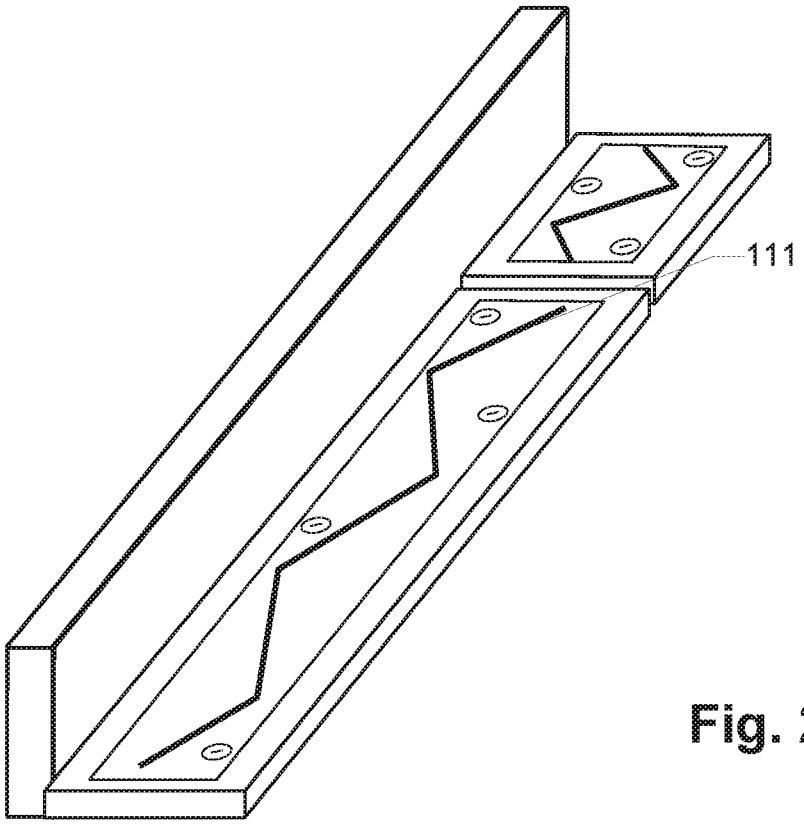
Figure 2E:
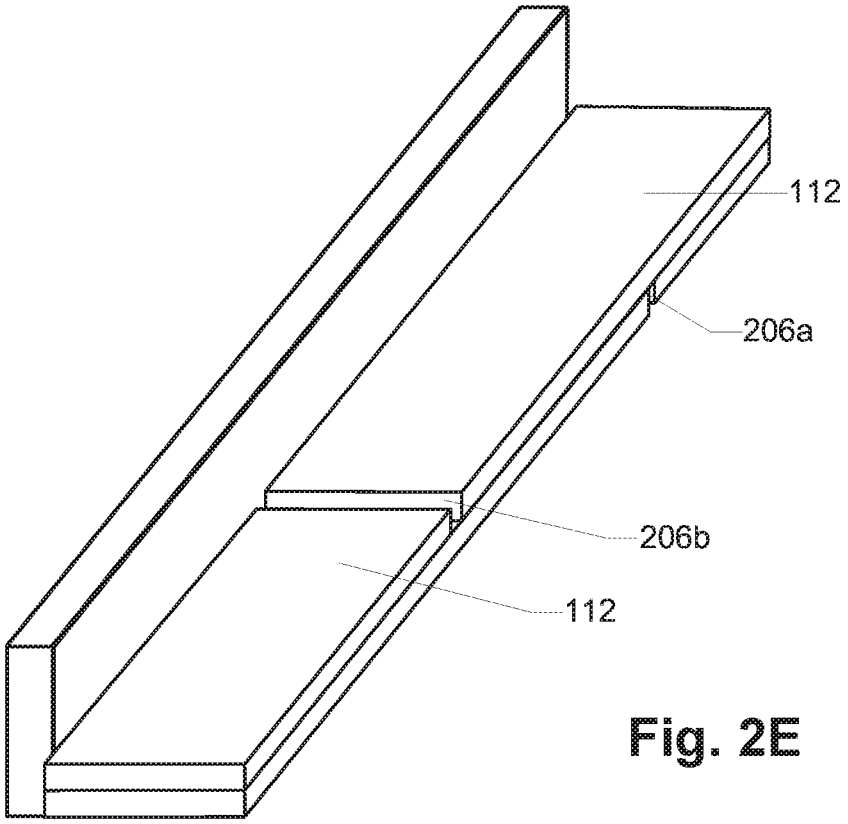
Figure 2F:
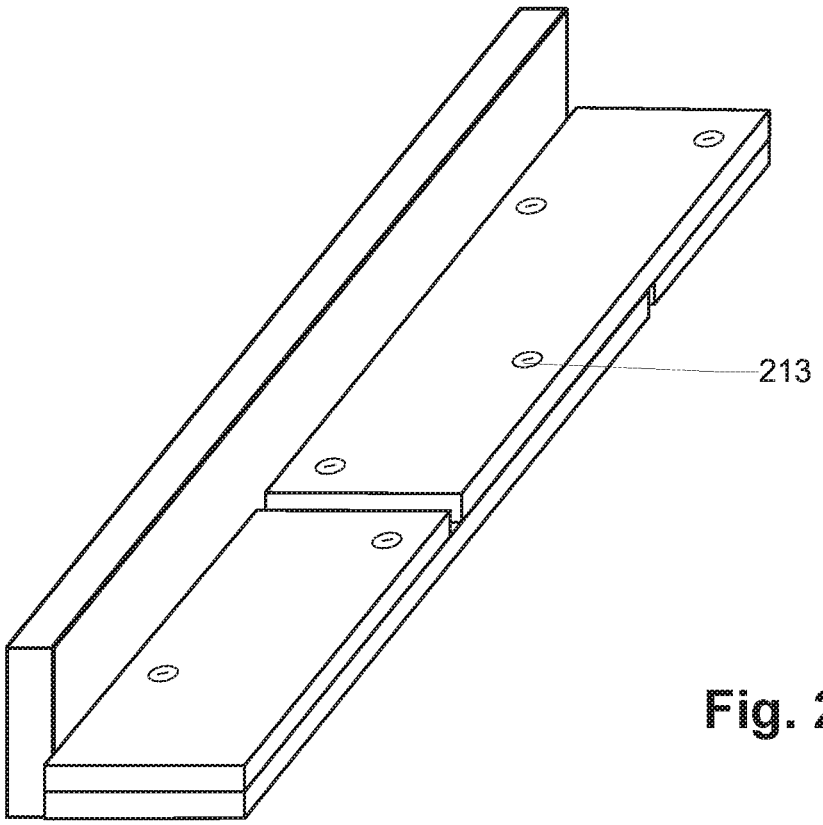

FIG. 2A illustrates application of the adhesive 111 to the subfloor 102. FIG. 2B illustrates installation of the isolation boards 110 on the subfloor 102. FIG. 2C illustrates using mechanical fasteners 113 to secure the isolation board 110 to the subfloor 102 to allow the adhesive 111 to dry. FIG. 2D illustrates application of the adhesive 111 to a topside of the isolation boards 110. FIG. 2E illustrates installation of the structural boards 112 on top of the isolation boards 110 so that they are offset horizontally from one another. That is, the edges of the isolation boards 110 and the structural boards 112 closest to the wall 104 are aligned, the edges of the isolation boards 110 and the structural boards 112 furthest from the wall 104 are aligned, but the perpendicular edges to these are not aligned so that gap 206*a* and gap 206*b* are not aligned. FIG. 2F illustrates using mechanical fasteners 113 to secure the structural boards 112 to the isolation boards 110 to allow the adhesive 111 to dry.

Figure 3A:
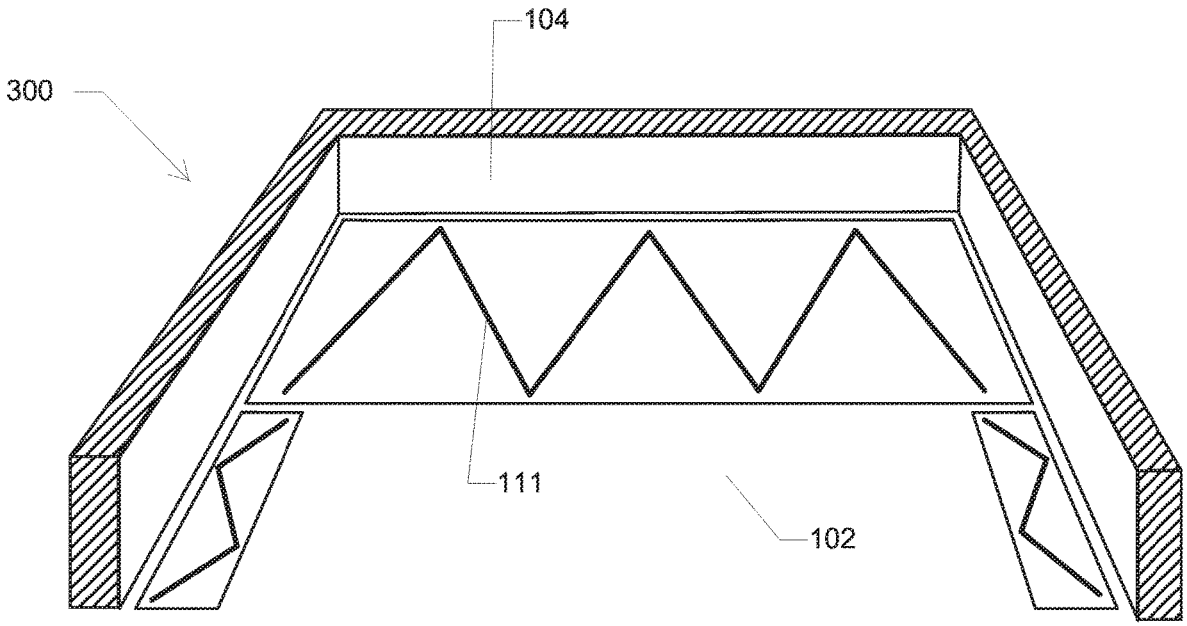
FIGS. 3A and 3B illustrate another example installation of an underlayment layer under a bathroom tub.
Figure 3B:
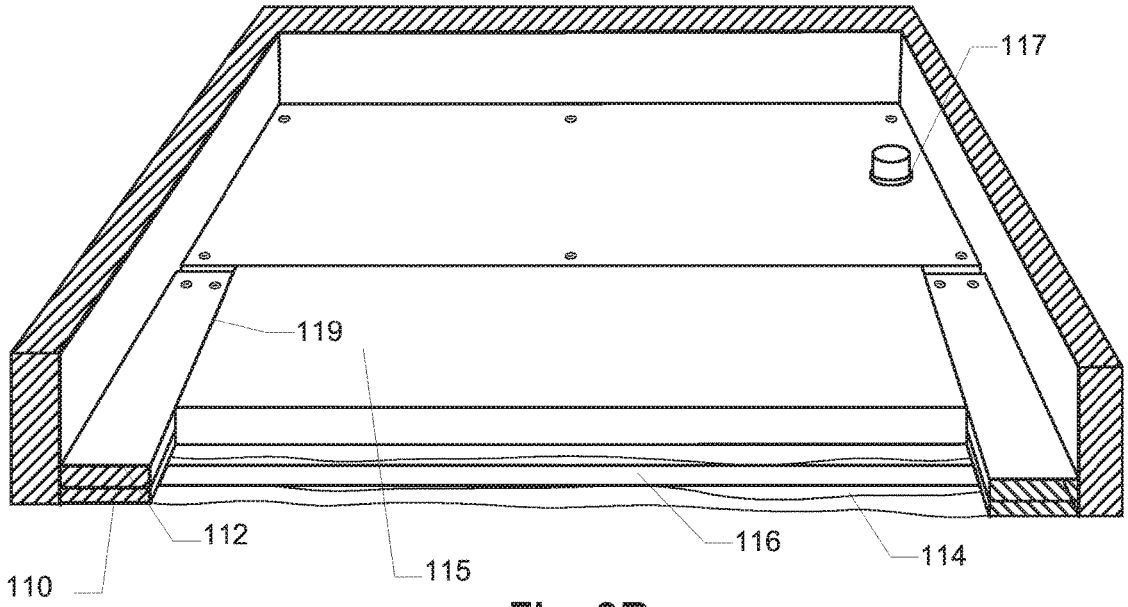

FIGS. 3A and 3B illustrate another example installation of an underlayment layer 300 under a bathroom tub. FIG. 3A illustrates the subfloor 102 and walls 104 with the adhesive 111 illustrated to adhere the first layer of isolation boards 110, similar to the installation process described herein with reference to FIG. 1A.

FIG. 3B illustrates after the underlayment installation procedure has been completed. The underlayment 300 includes isolation boards 110 installed in a first portion of the subfloor 102, structural boards 112 installed on top of, and aligned with, the isolation boards 110. Although a single layer of structural boards 112 is illustrated, two or more layers of structural boards 112 can be installed, similar to the installation described herein with reference to FIG. 1I. Each structural board 112 can have a different thickness from each other or the same thickness. Similarly, one or more structural boards 112 can have the same thickness as the isolation board 110. In this way, the of the isolation board 110 and/or a combination of the isolation board 110 and one or more structural boards 112 can be used to build a pour barrier to a targeted thickness corresponding to a targeted thickness of the cementitious product 115.

The underlayment 300 includes the poured cementitious product 115 poured and installed in the second portion of the subfloor 102. Prior to pouring the cementitious product 115, a sound control membrane 114 can be installed in the second portion of the subfloor 102. The sound control membrane 114 can be configured for sound control, sound attenuation, and/or sound abatement. The sound control membrane 114 may also function as a vapor barrier and may include a sheet of polyethylene film resting upon the reinforced-concrete subfloor 102. The sound control membrane 114 may supplied in rolls and have adhesive-backed edges for overlapping with one another to secure the abutting edges together. In some embodiments, as shown here, a separate tape material 116 may be used for this purpose. The sound control membrane 114 may be formed from fused entangled filaments of a nylon material attached to a non-woven nylon fabric, or from blends of polymeric fibers having a nylon reinforcement. The tape material 116 may be, e.g., duct tape, poly-stucco tape, cloth tape, scrim-backed tape, or pressure-sensitive tape. The tape material 116 may be coated with polyethylene.

Caulking 117 is applied to any component that penetrates through the isolation boards and/or subfloor 102. The caulking 117 can be, e.g., fire-rated caulking and can be installed or applied around piping and any gaps larger than about 3/16 inches. Caulking 117 can be applied to help with expansion and for places that require penetration.

A sealant 119 may be applied at intersection locations between structural boards 112 and/or intersections between the structural boards 112 and the cementitious product 115. The sealant 119 can be applied on top of the cementitious product 115 and the structural boards to protect the seam to make it smooth for finish flooring installed on the top thereof.

Figure 4A:
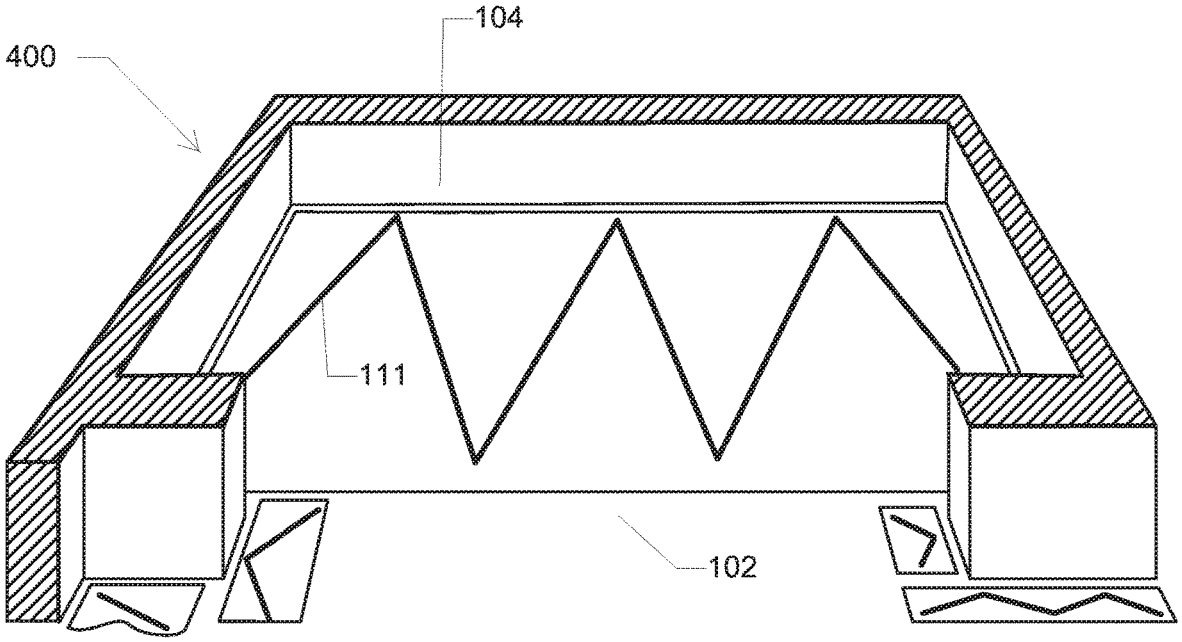
FIGS. 4A and 4B illustrate another example installation of an underlayment layer under a closet.
Figure 4B:
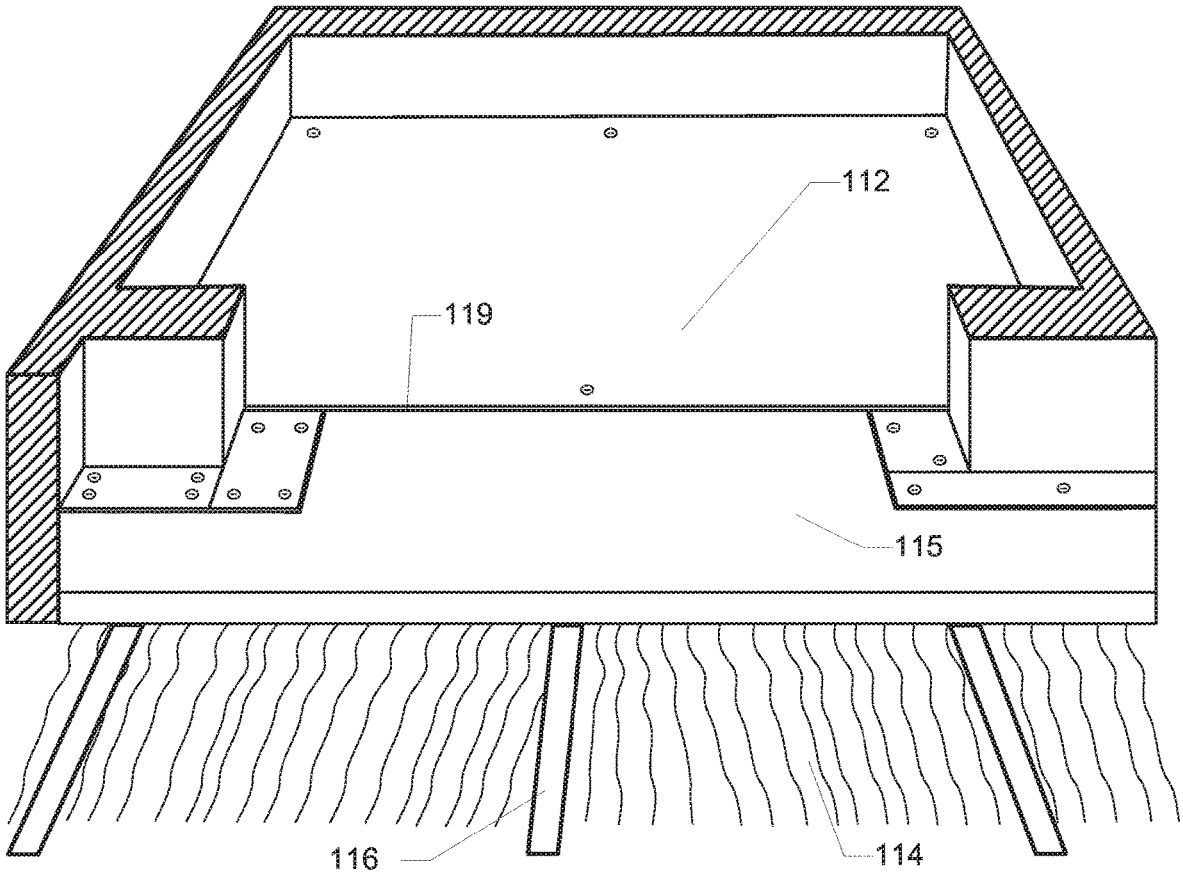

FIGS. 4A and 4B illustrate another example installation of an underlayment layer 400 under a closet. The installation follows the same installation steps described herein with reference to FIGS. 3A and 3B but for a different portion of a building (e.g., under a closet rather than under a bathtub). The corresponding callouts reference the same components so a description of these components will not be repeated again for the sake of conciseness.

Figure 5A:
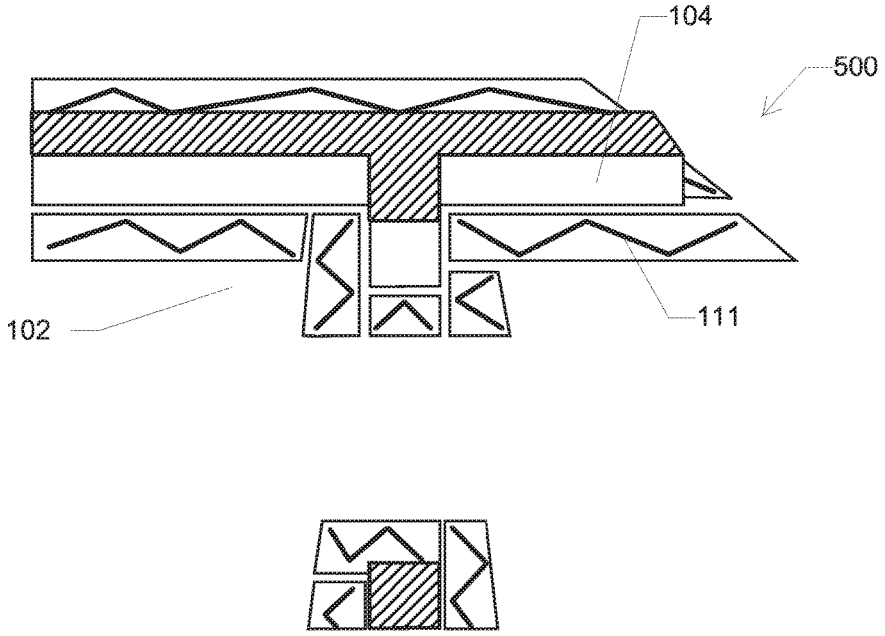
FIGS. 5A and 5B illustrate another example installation of an underlayment layer for an outside corner binder.
Figure 5B:
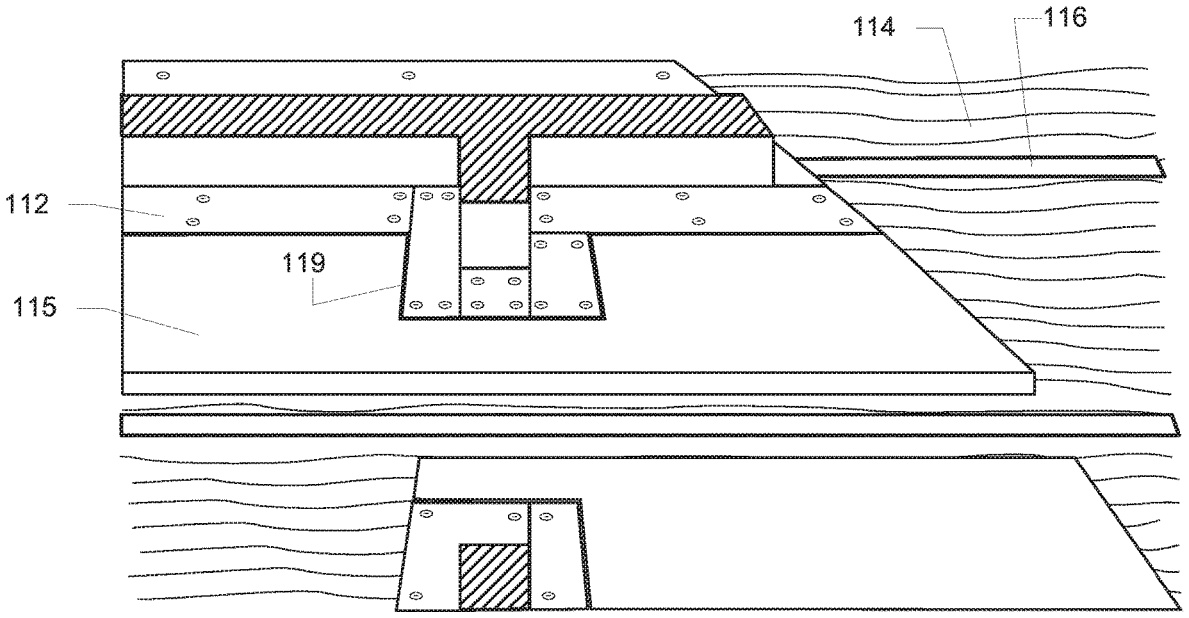

FIGS. 5A and 5B illustrate another example installation of an underlayment layer 500 for an outside corner binder. The installation follows the same installation steps described herein with reference to FIGS. 3A and 3B but for a different portion of a building (e.g., an outside corner binder rather than under a bathtub). The corresponding callouts reference the same components so a description of these components will not be repeated again for the sake of conciseness.

Figure 6A:
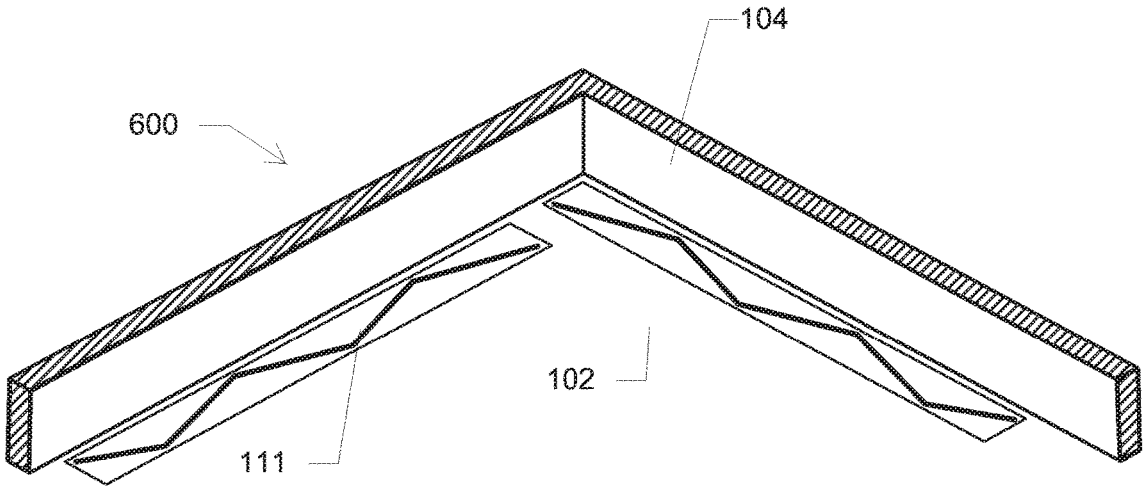
FIGS. 6A and 6B illustrate installation of an underlayment layer for an inside corner binder.
Figure 6B:
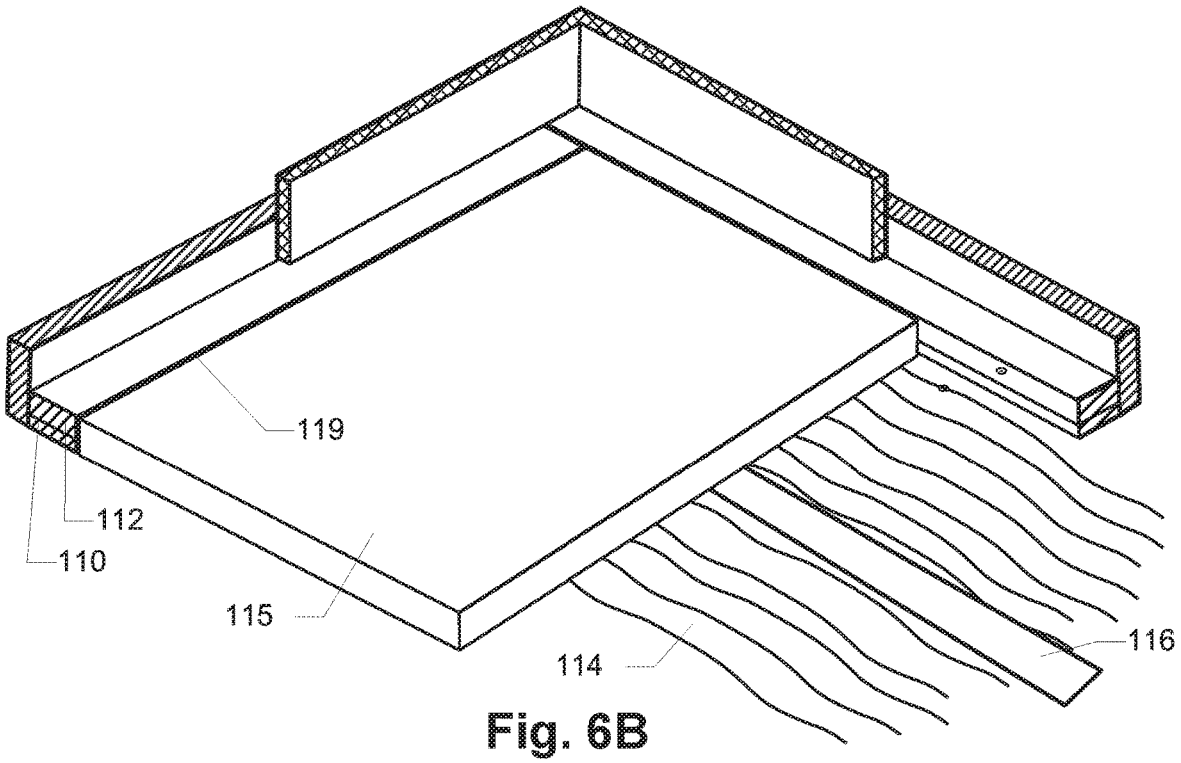

FIGS. 6A and 6B illustrate installation of an underlayment layer 600 for an inside corner binder. The installation follows the same installation steps described herein with reference to FIGS. 3A and 3B but for a different portion of a building (e.g., an inside corner binder rather than under a bathtub). The corresponding callouts reference the same components so a description of these components will not be repeated again for the sake of conciseness.

Figure 7A:
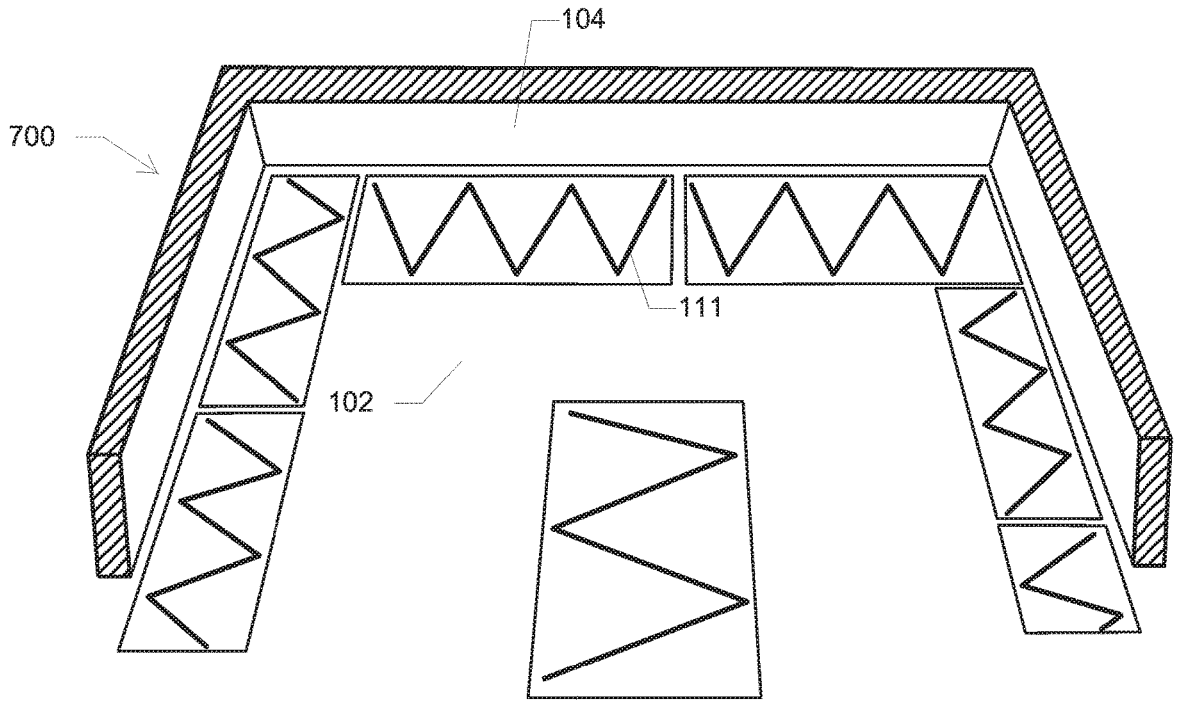
FIGS. 7A and 7B illustrate installation of an underlayment layer for an island in a kitchen.
Figure 7B:
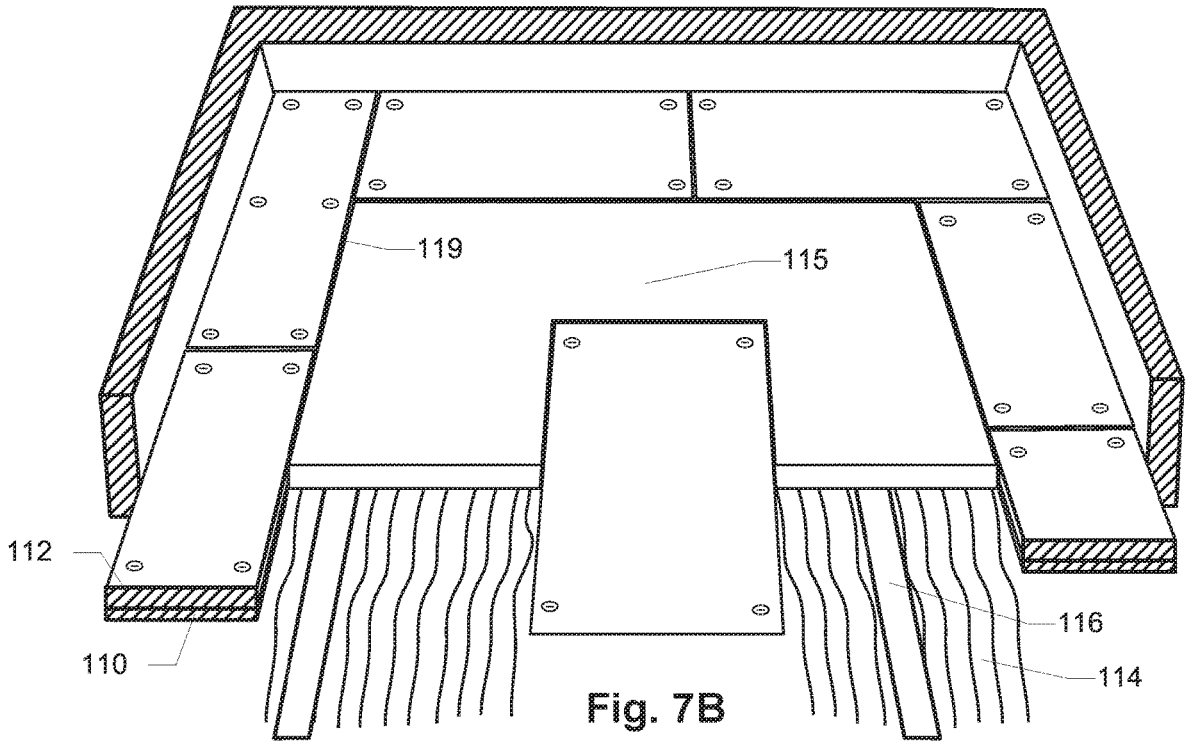

FIGS. 7A and 7B illustrate installation of an underlayment layer 700 for an island in a kitchen. The installation follows the same installation steps described herein with reference to FIGS. 3A and 3B but for a different portion of a building (e.g., under an island in the kitchen rather than under a bathtub). The corresponding callouts reference the same components so a description of these components will not be repeated again for the sake of conciseness.

Figure 8A:
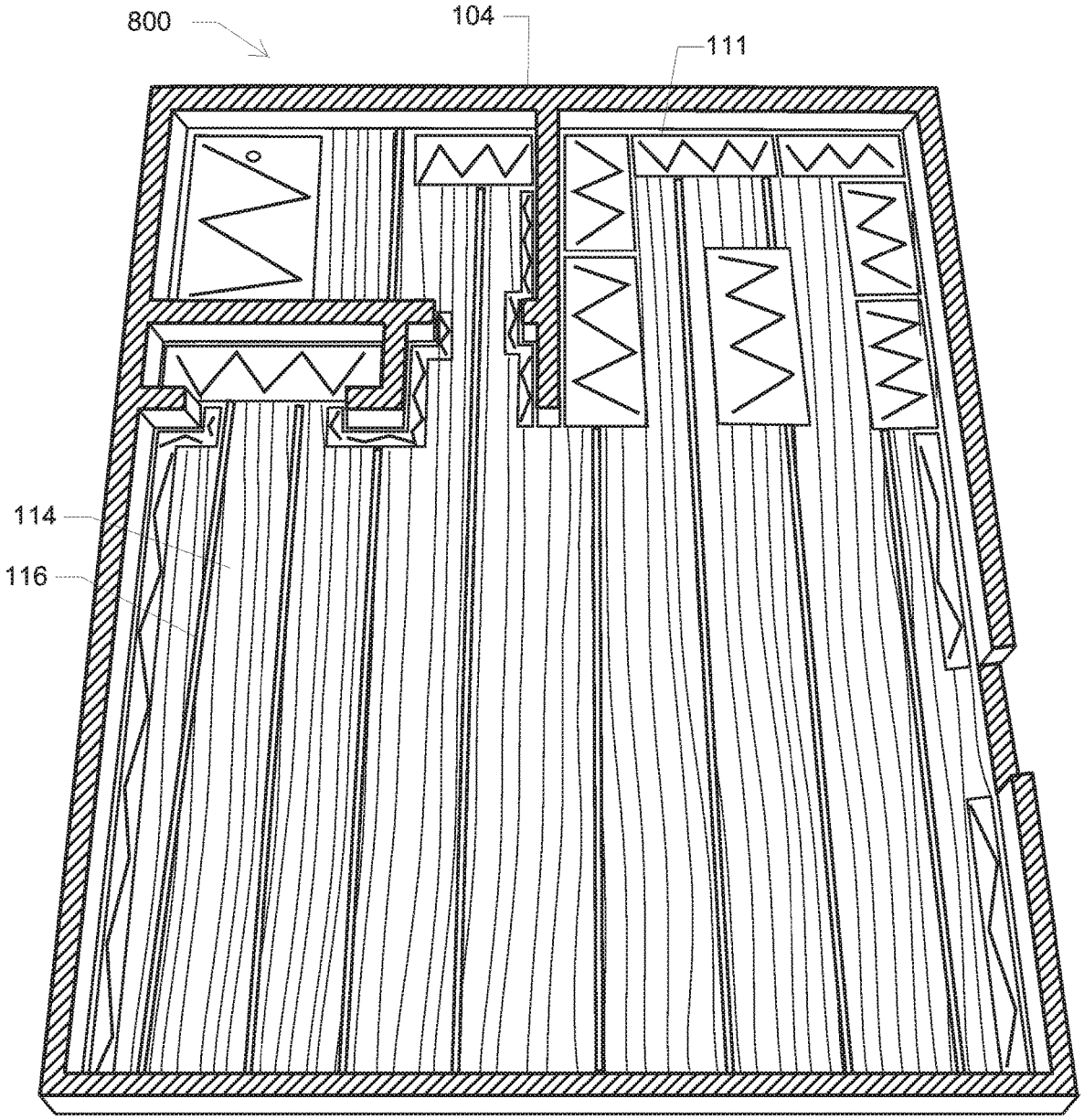
FIGS. 8A and 8B illustrate installation of an underlayment layer of flooring in a dwelling.
Figure 8B:
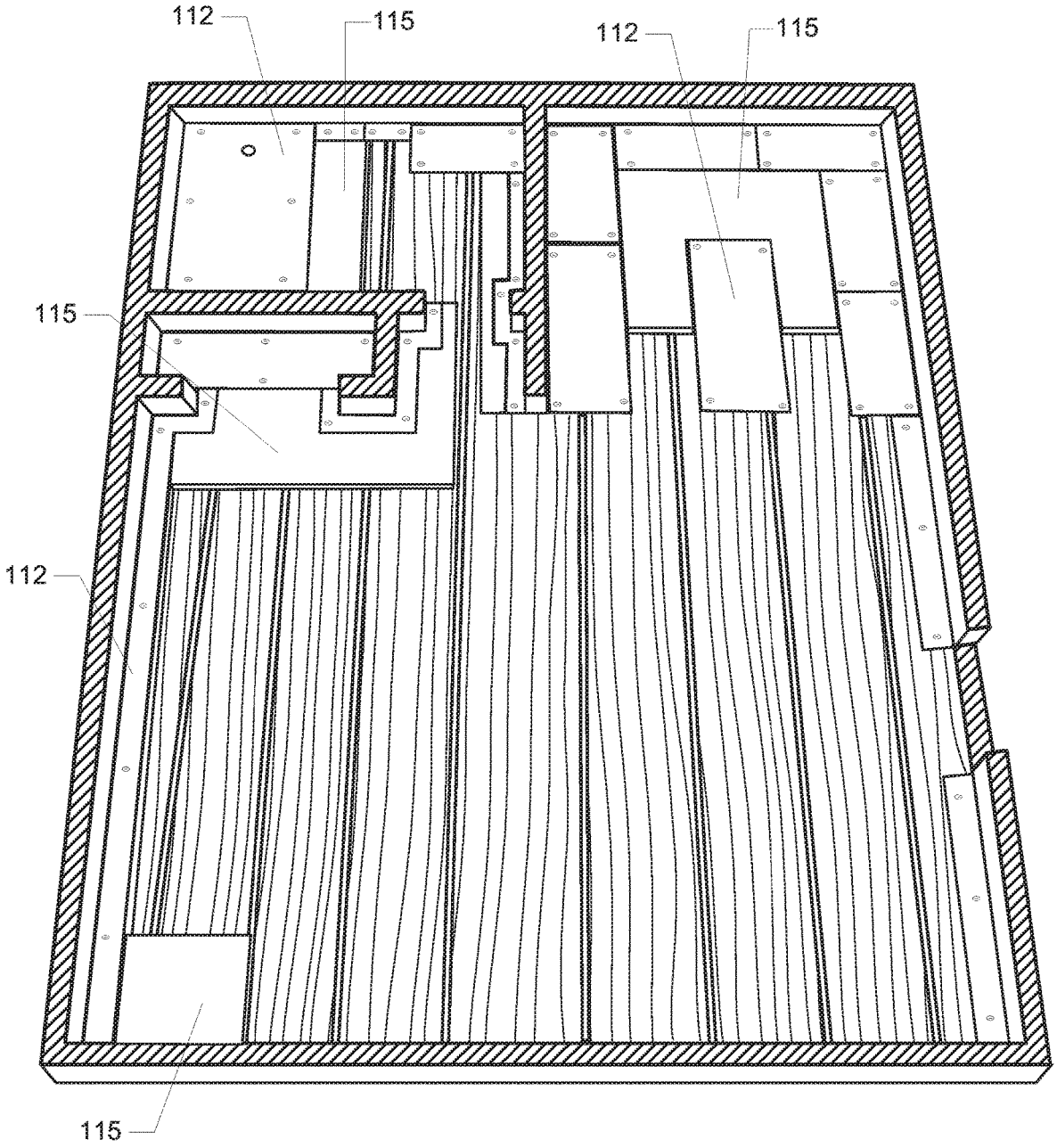

FIGS. 8A and 8B illustrate installation of an underlayment layer 800 of flooring in a dwelling. The installation follows the same installation steps described herein with reference to FIGS. 3A-7B but are for an entire dwelling, including all the locations described in FIGS. 3A-7B. The dwelling is a studio-style apartment, but the disclosed installation steps can be applied to various other building and dwelling types. The corresponding callouts reference the same components so a description of these components will not be repeated again for the sake of conciseness.

FIGS. 9A, 9B, 9C, 9D, 9E, and 9F illustrate another example installation of an underlayment layer 900 of flooring using fiberboards for an outside corner binder. The installation follows the same installation steps described herein with reference to FIGS. 2A-2F but are for a different portion of a building (e.g., an outside corner binder rather than a perimeter binder).

Figure 9A:
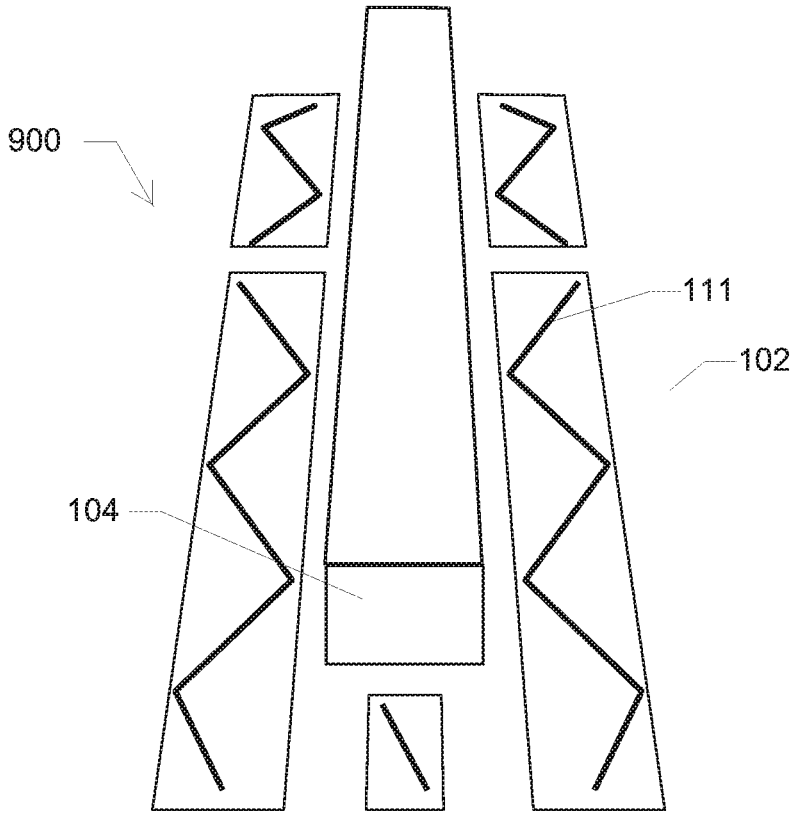
FIGS. 9A, 9B, 9C, 9D, 9E, and 9F illustrate another example installation of an underlayment layer of flooring using fiber boards for an outside corner binder.
Figure 9B:
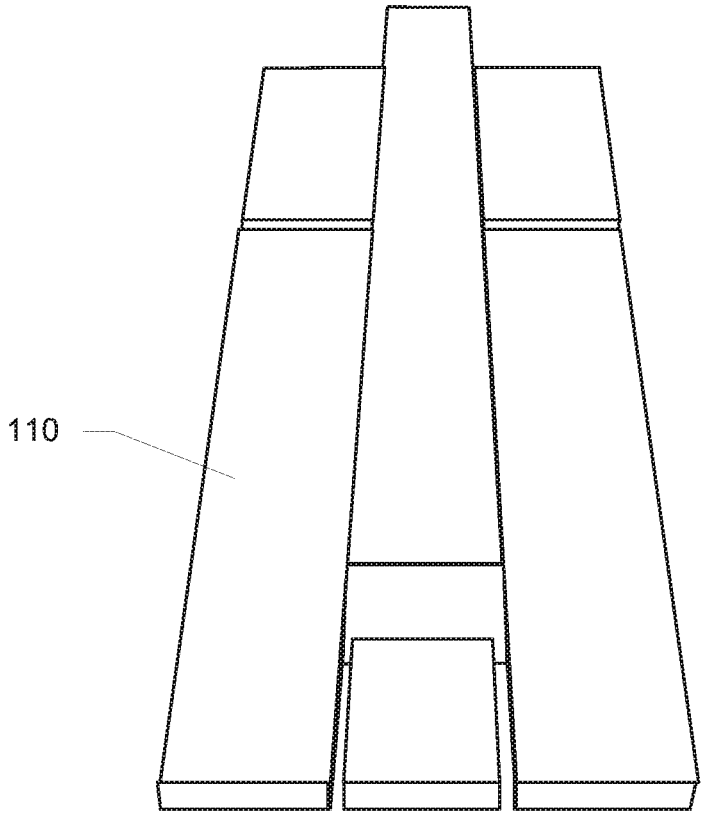
Figure 9C:
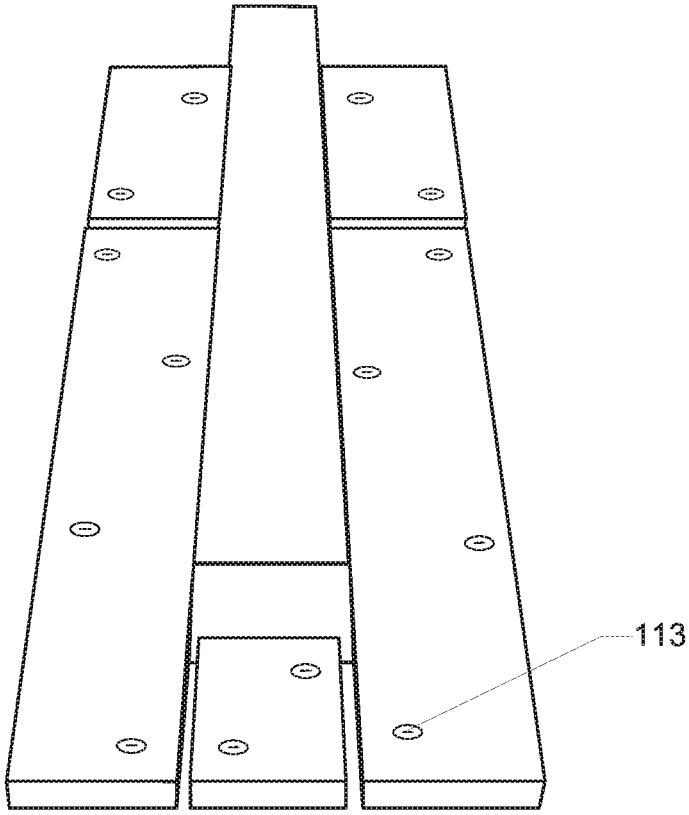
Figure 9D:
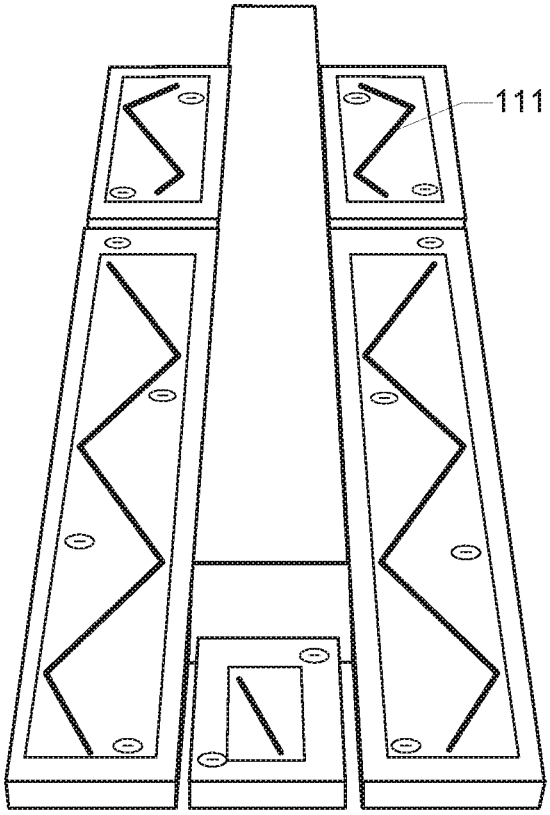
Figure 9E:
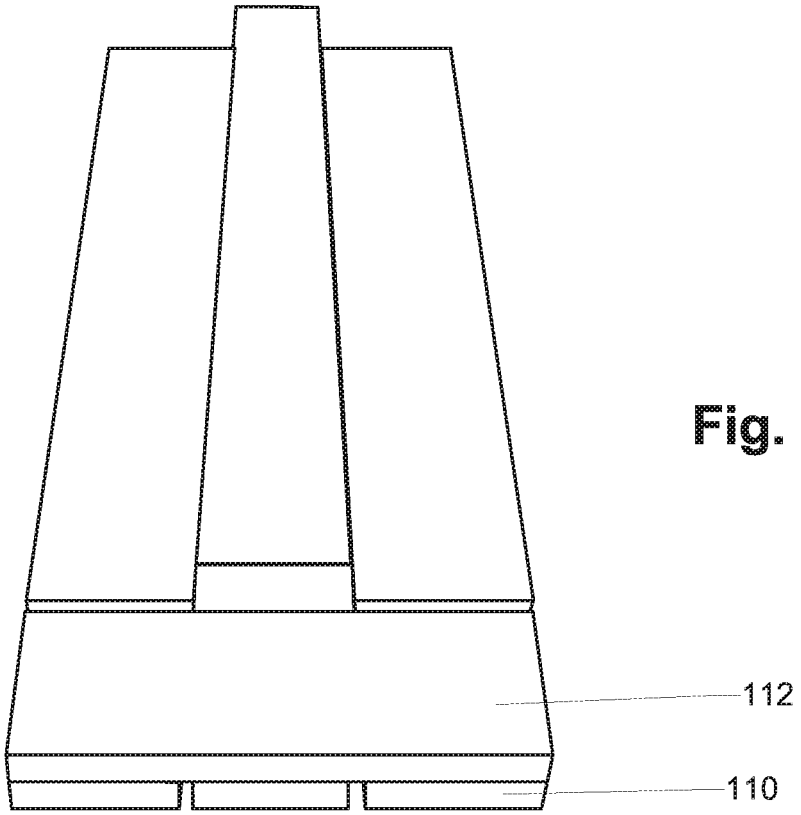
Figure 9F:
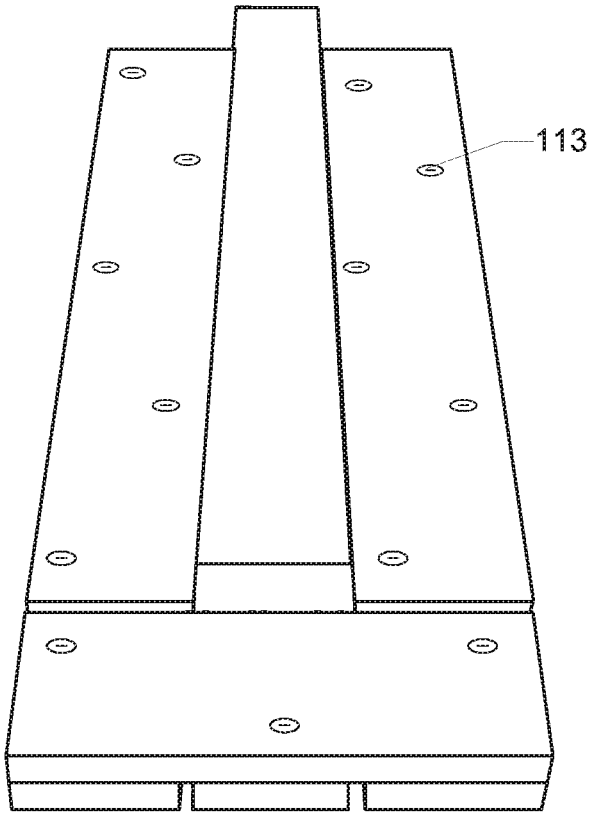

FIG. 9A illustrates application of the adhesive 111 to the subfloor 102. FIG. 9B illustrates installation of the isolation boards 110 on the subfloor 102. FIG. 9C illustrates using mechanical fasteners 113 to secure the isolation board 110 to the subfloor 102 to allow the adhesive 111 to dry. FIG. 9D illustrates application of the adhesive 111 to a topside of the isolation boards 110. FIG. 9E illustrates installation of the structural boards 112 on top of the isolation boards 110 so that they are offset horizontally from one another. FIG. 9F illustrates using mechanical fasteners 113 to secure the structural boards 112 to the isolation boards 110 to allow the adhesive 111 to dry.

FIGS. 10A, 10B, 10C, 10D, 10E, 10F, and 10G illustrate another example installation of an underlayment layer 1000 of flooring using fiberboards as a bathtub binder. The installation follows the same installation steps described herein with reference to FIGS. 2A-2F but are for a different portion of a building (e.g., underneath a bathtub in a finished building rather than a perimeter binder).

Figure 10A:
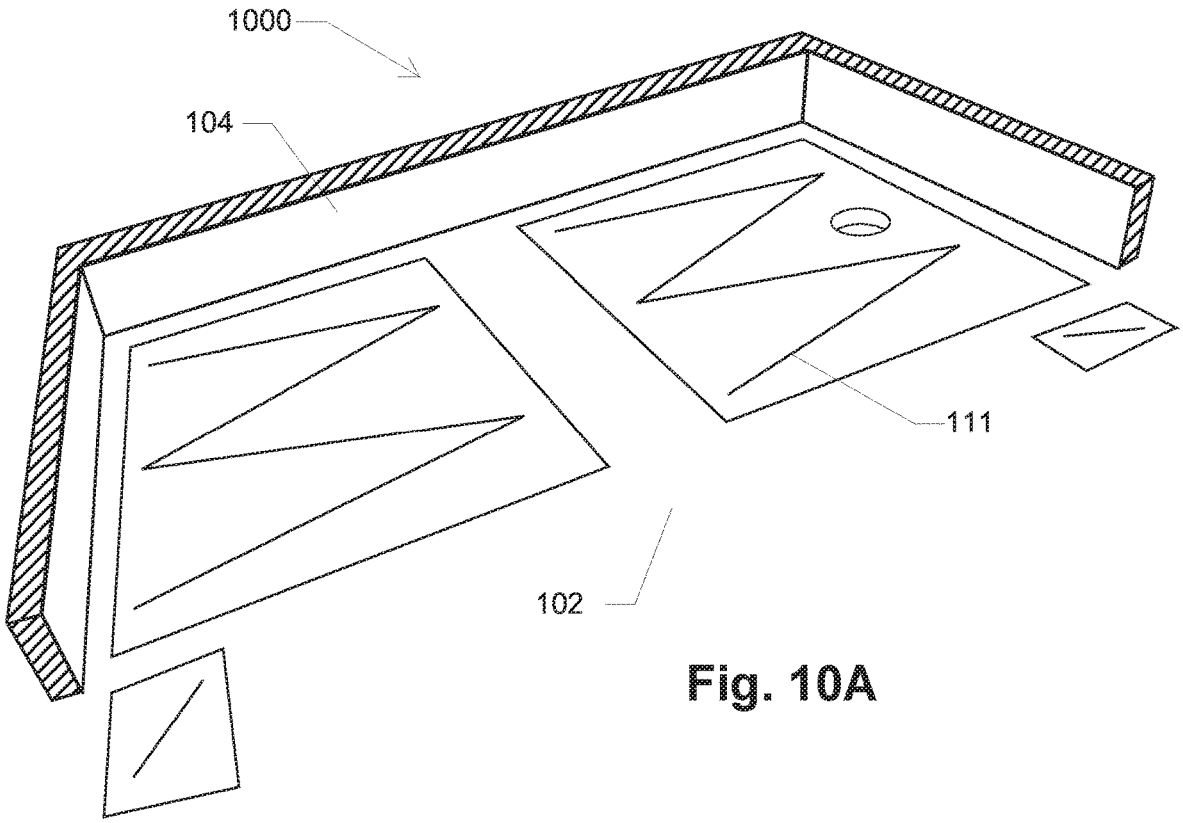
FIGS. 10A, 10B, 10C, 10D, 10E, 10F, and 10G illustrate another example installation of an underlayment layer of flooring using fiber boards as a bathtub binder.
Figure 10B:
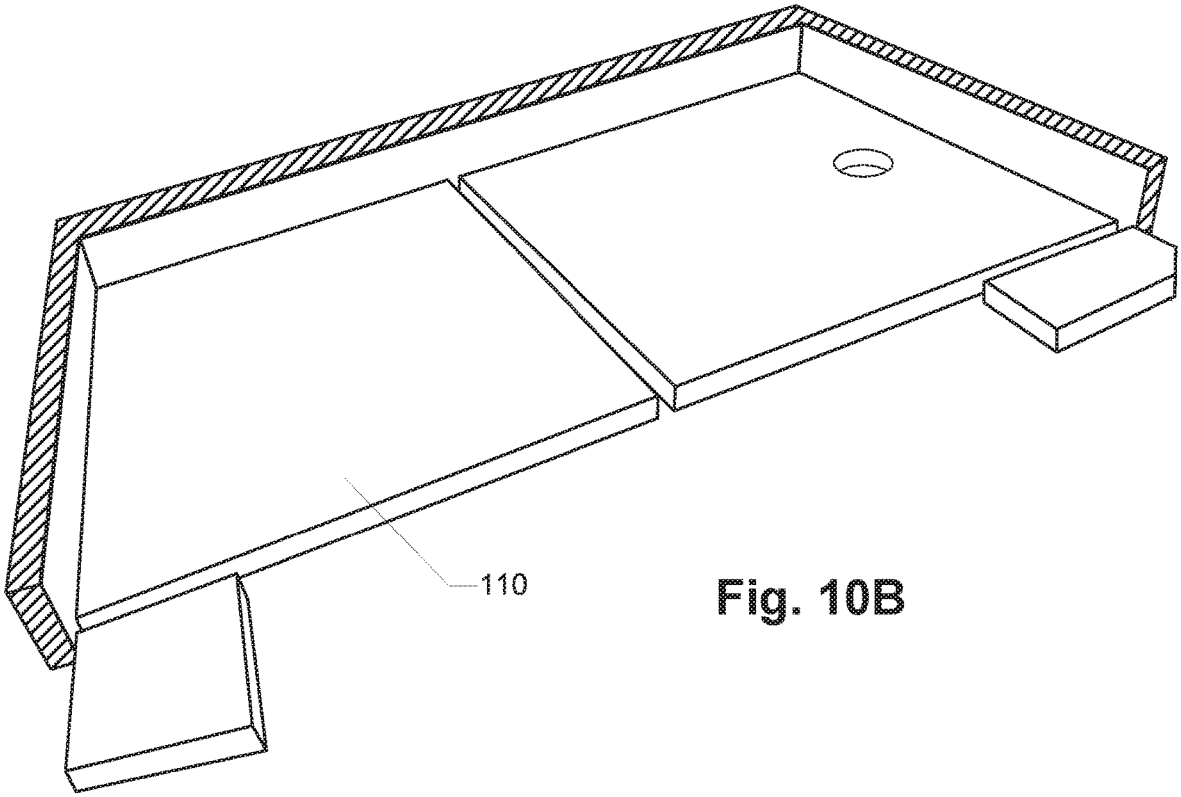
Figure 10C:
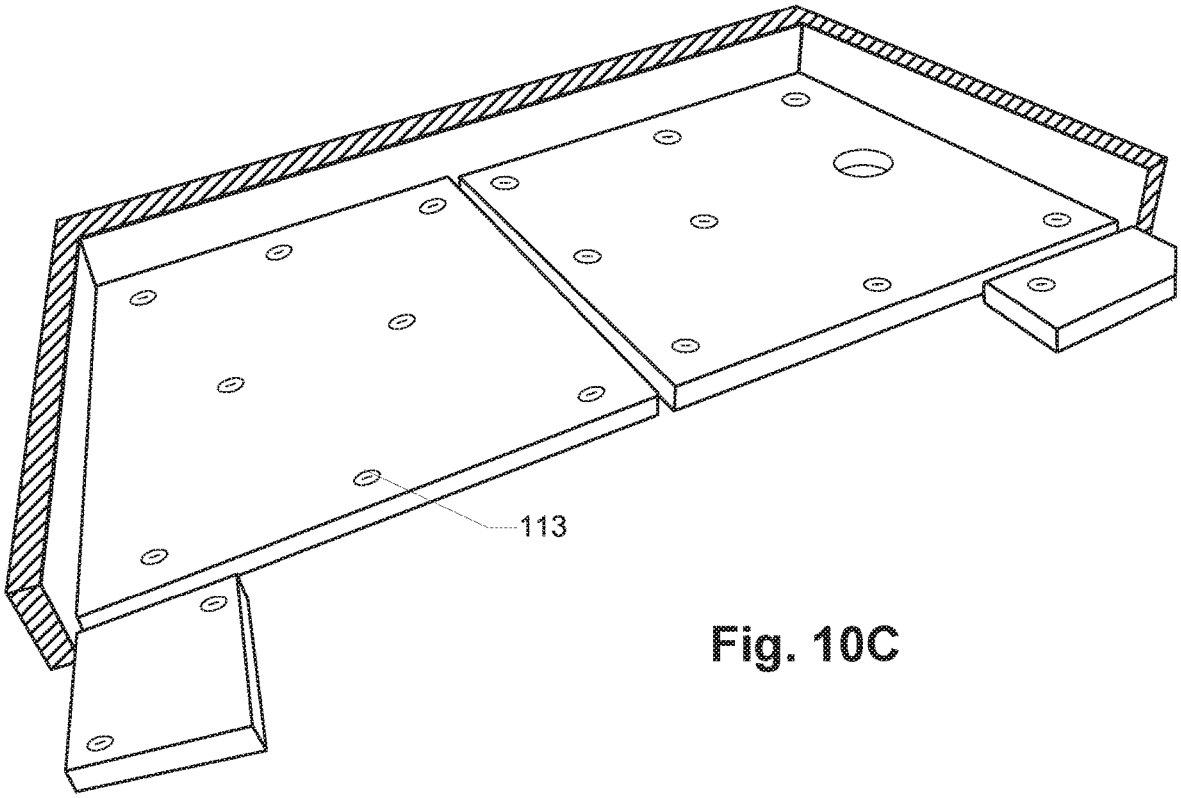
Figure 10D:
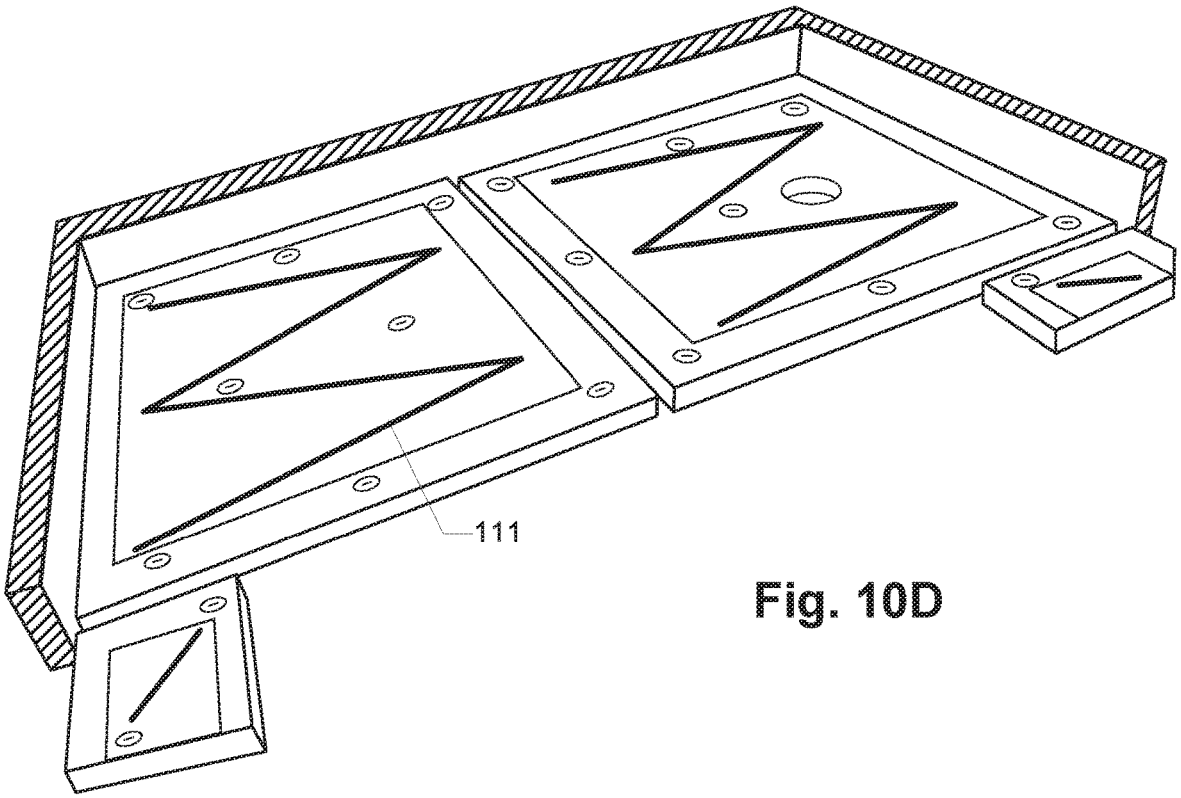
Figure 10E:
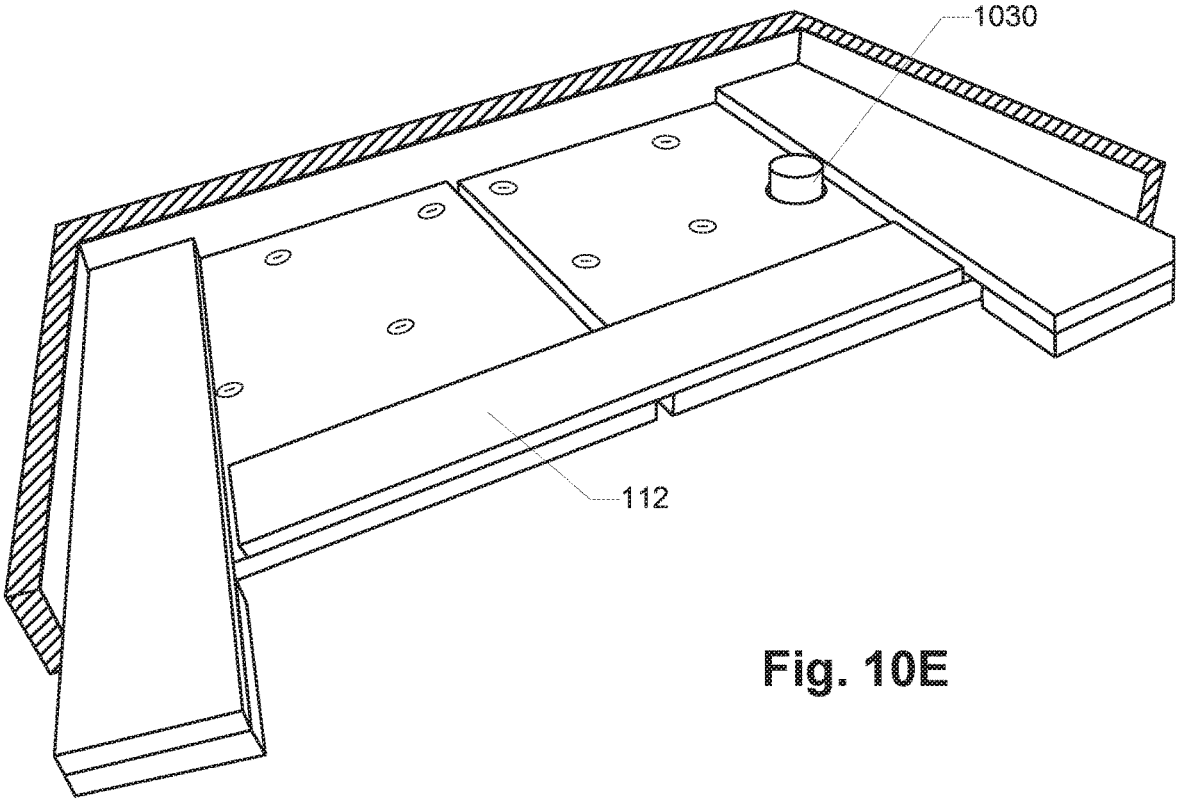
Figure 10F:
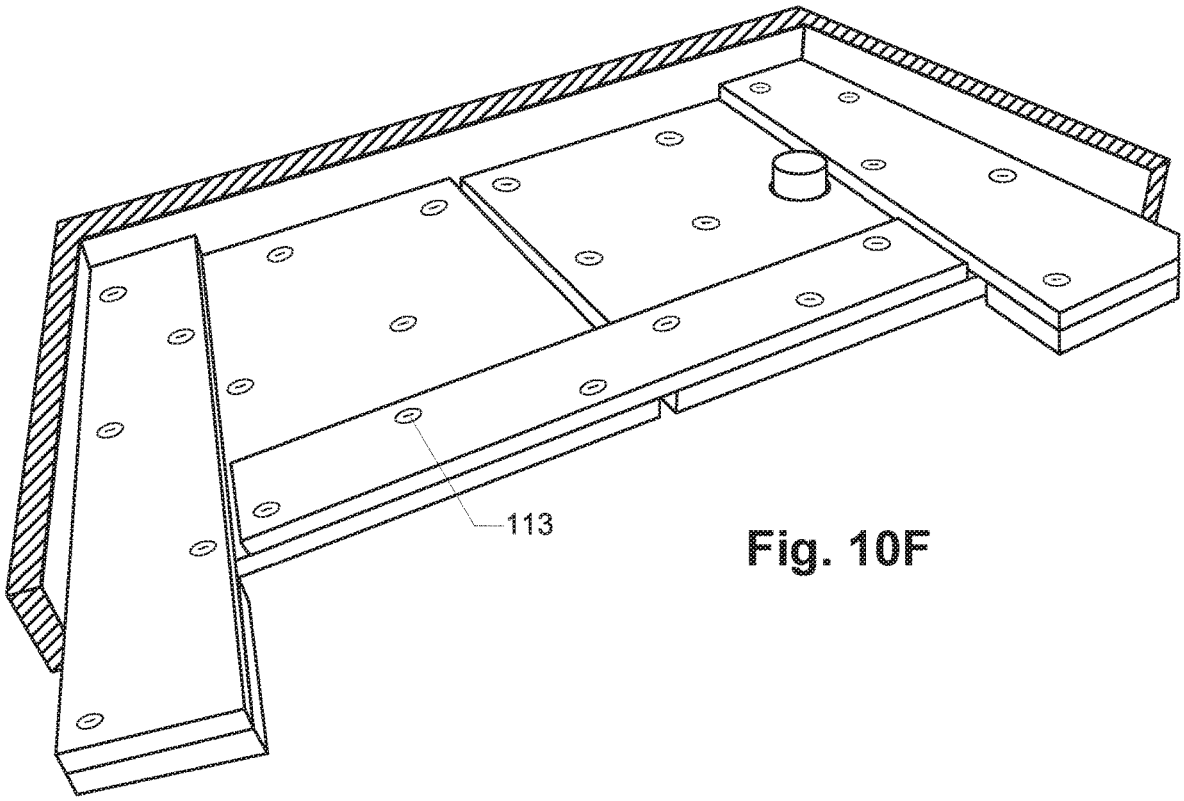

FIG. 10A illustrates application of the adhesive 111 to the subfloor 102. FIG. 10B illustrates installation of the isolation boards 110 on the subfloor 102. FIG. 10C illustrates using mechanical fasteners 113 to secure the isolation board 110 to the subfloor 102 to allow the adhesive 111 to dry. FIG. 10D illustrates application of the adhesive 111 to a topside of the isolation boards 110. FIG. 10E illustrates installation of the structural boards 112 on top of the isolation boards 110 so that they are offset horizontally from one another. FIG. 10F illustrates using mechanical fasteners 113 to secure the structural boards 112 to the isolation boards 110 to allow the adhesive 111 to dry.

Figure 10G:
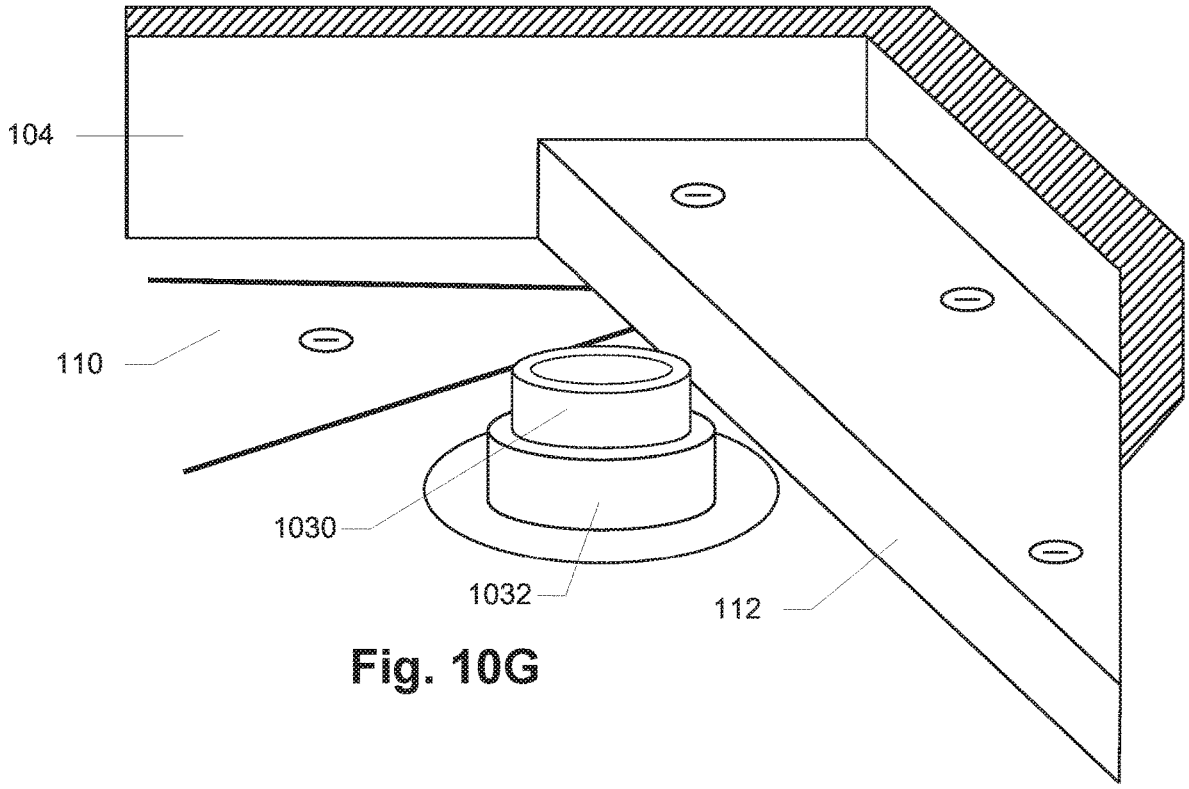

FIG. 10G illustrates a pipe penetration for the bathtub to be installed over the isolation boards 110. The pipe 1030 penetrates through the isolation boards 110 and the subfloor 102. The pipe 1030 includes foam insulation 1032 or fire-rated caulking 1032 between the pipe 1030 and the isolation boards 110, similar to the embodiment described herein with reference to FIG. 3B.

FIGS. 11A, 11B, 11C, 11D, and 11E illustrate another example installation of an underlayment layer 1100 of flooring using fiber boards as a bedroom closet binder. The installation follows the same installation steps described herein with reference to FIGS. 2A-2F with one or more installation steps removed for the sake of brevity. The installation differs from that described with reference to FIGS. 2A-2F because it is for a different portion of a building (e.g., the flooring in a non-walk-in closet rather than a perimeter binder).

Figure 11A:
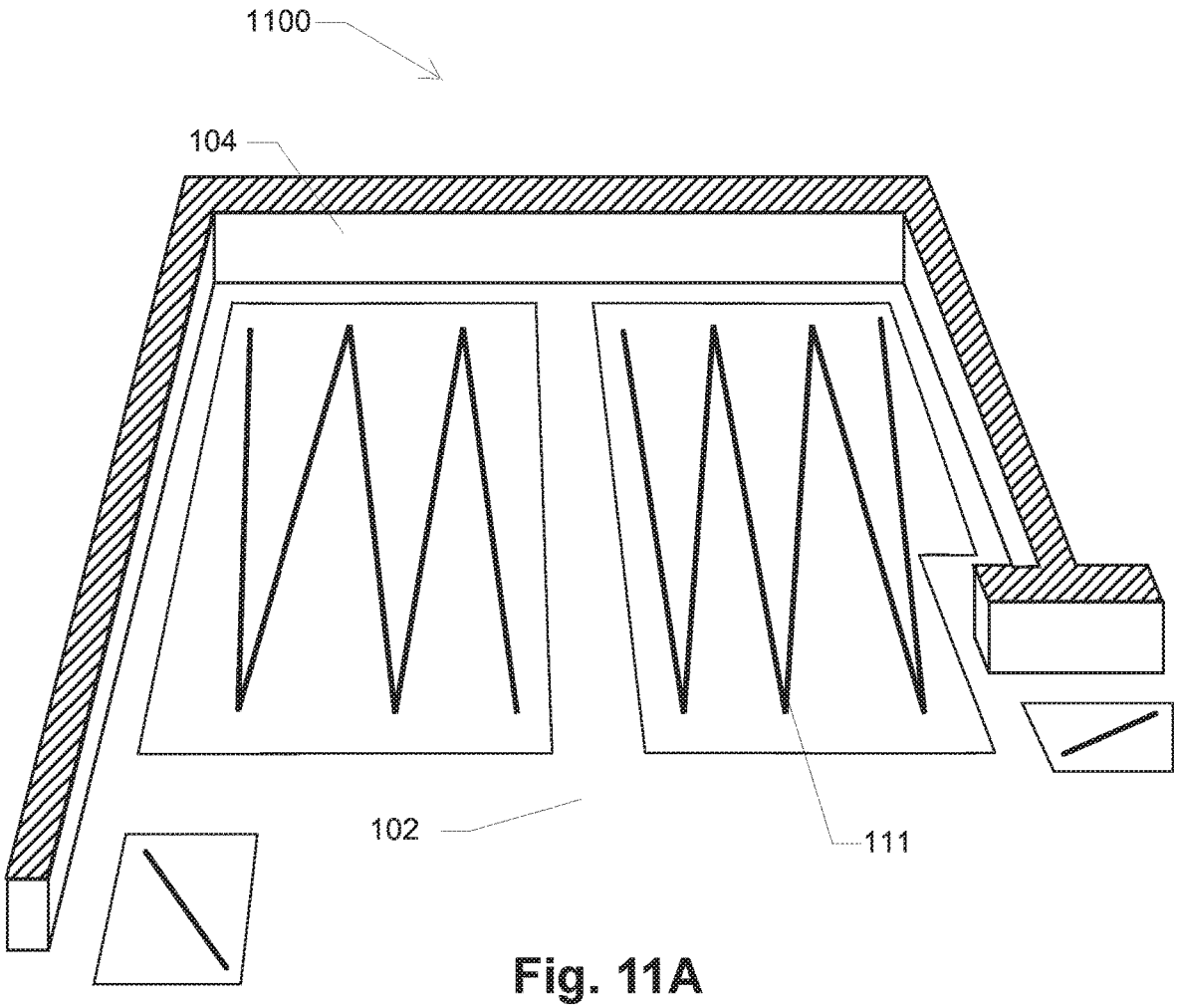
FIGS. 11A, 11B, 11C, 11D, and 11E illustrate another example installation of an underlayment layer of flooring using fiber boards as a bedroom closet binder.
Figure 11B:
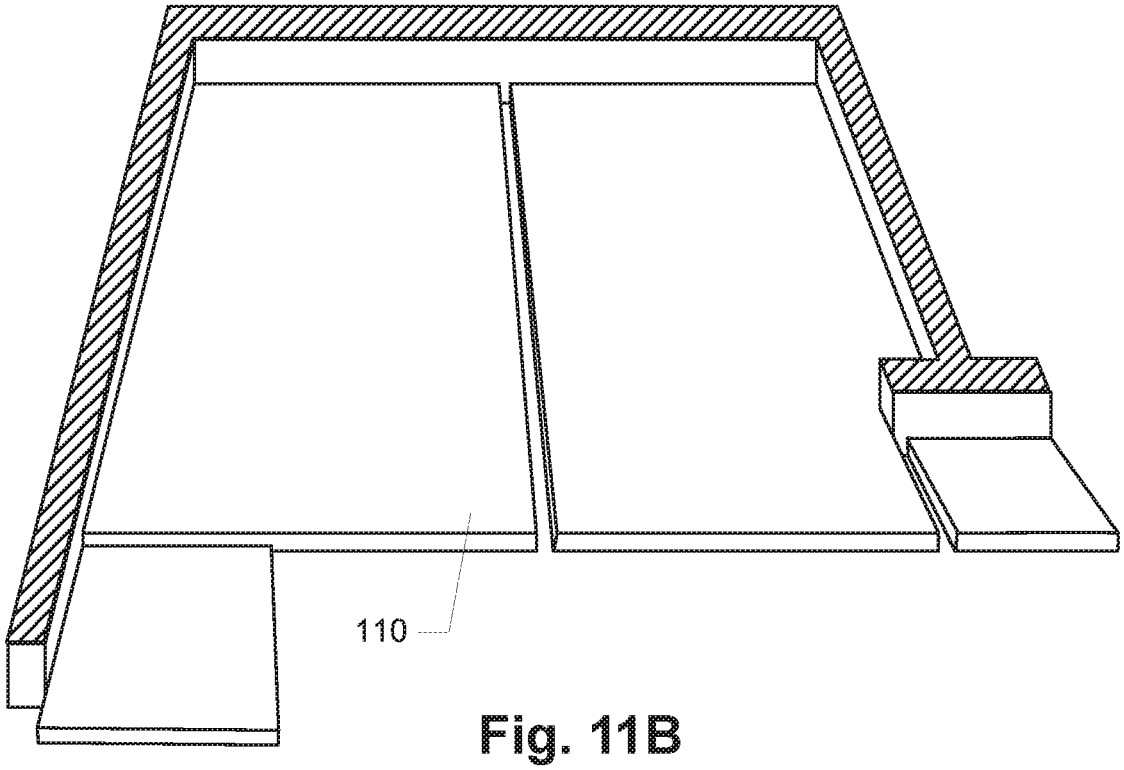
Figure 11C:
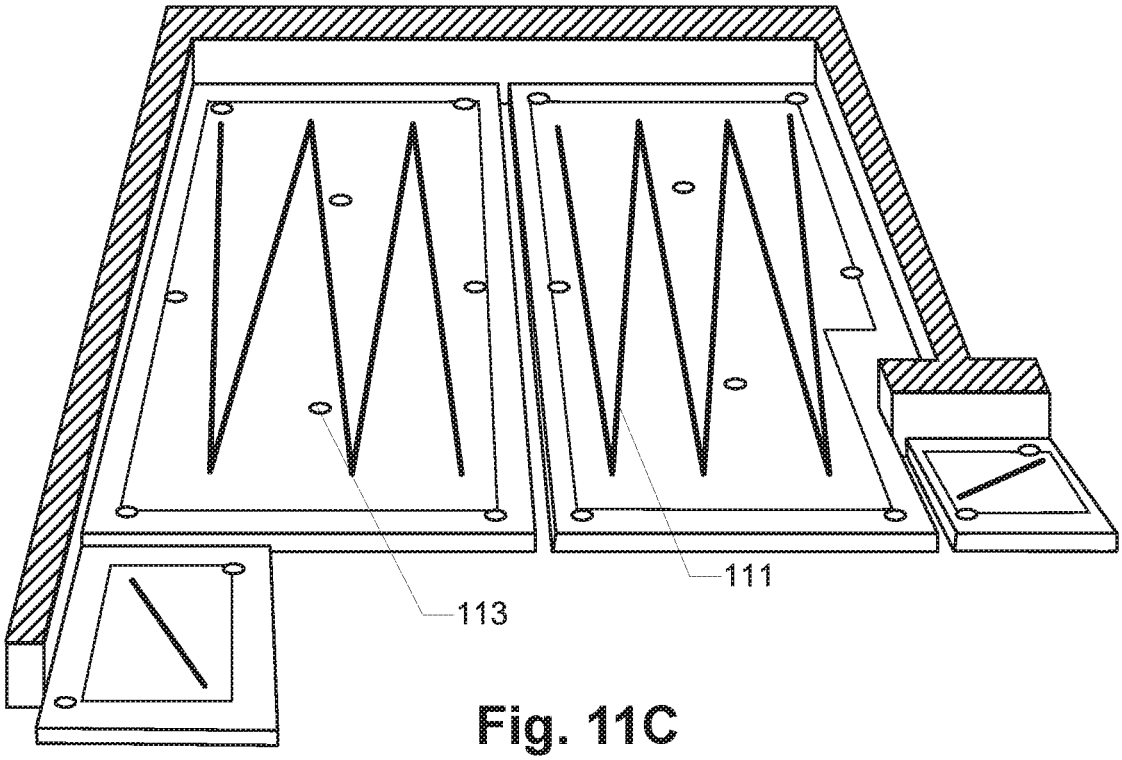
Figure 11D:
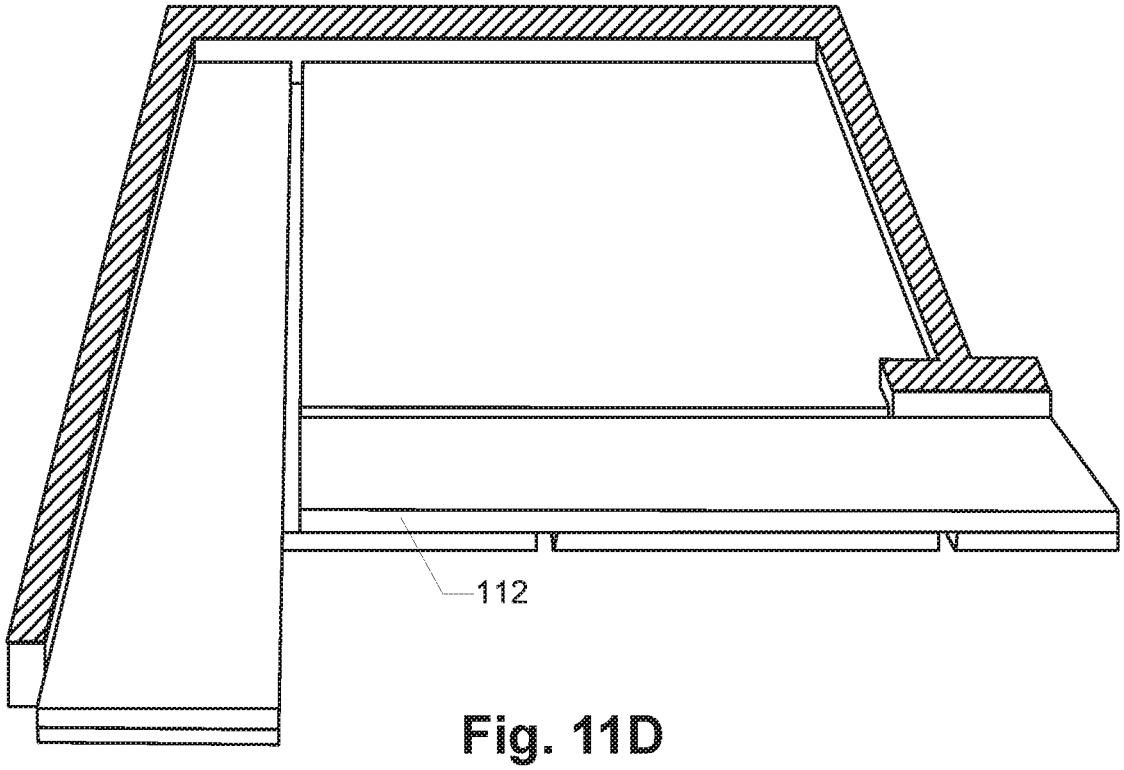
Figure 11E:
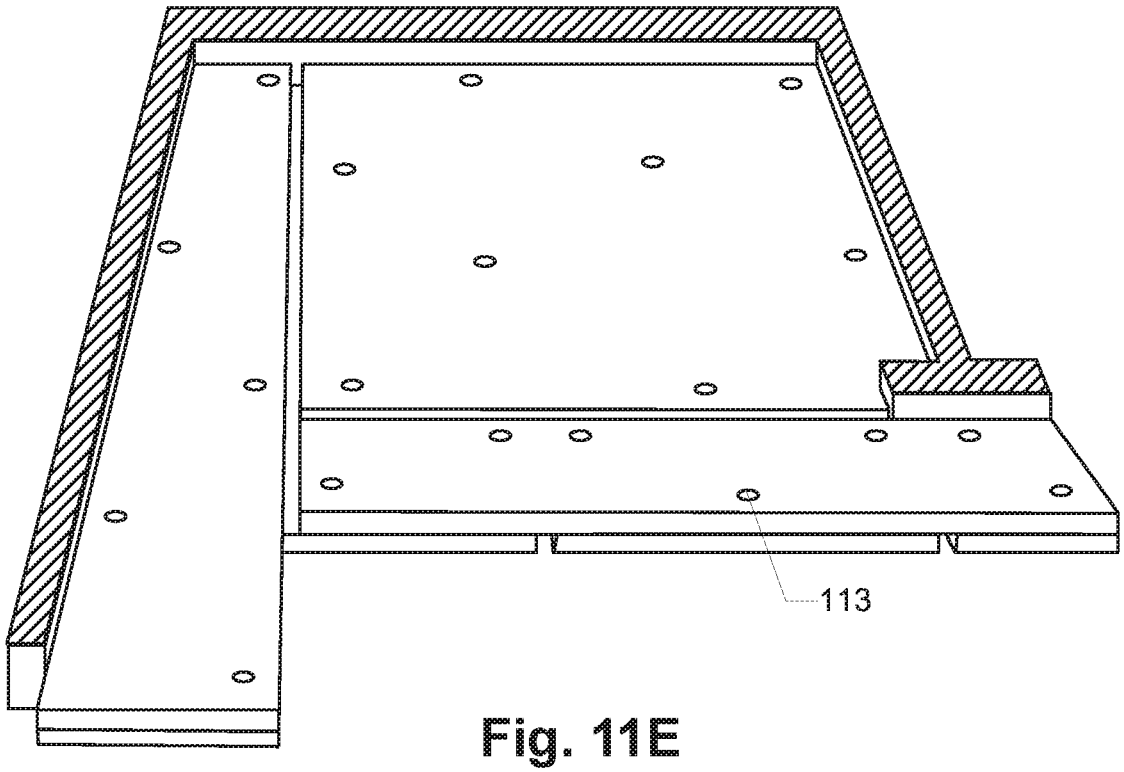

FIG. 11A illustrates application of the adhesive 111 to the subfloor 102. FIG. 11B illustrates installation of the isolation boards 110 on the subfloor 102. FIG. 11C illustrates application of the adhesive 111 to a topside of the isolation boards 110. FIG. 11D illustrates installation of the structural boards 112 on top of the isolation boards 110 so that they are offset horizontally from one another. FIG. 11E illustrates using mechanical fasteners 113 to secure the structural boards 112 to the isolation boards 110 to allow the adhesive 111 to dry.

FIGS. 12A, 12B, 12C, 12D, 12E, and 12F illustrate another example installation of an underlayment layer 1200 of flooring using fiber boards as a kitchen island binder. The installation follows the same installation steps described herein with reference to FIGS. 2A-2F but are for a different portion of a building (e.g., underneath a kitchen island or cabinets in a finished building rather than a perimeter binder).

Figure 12A:
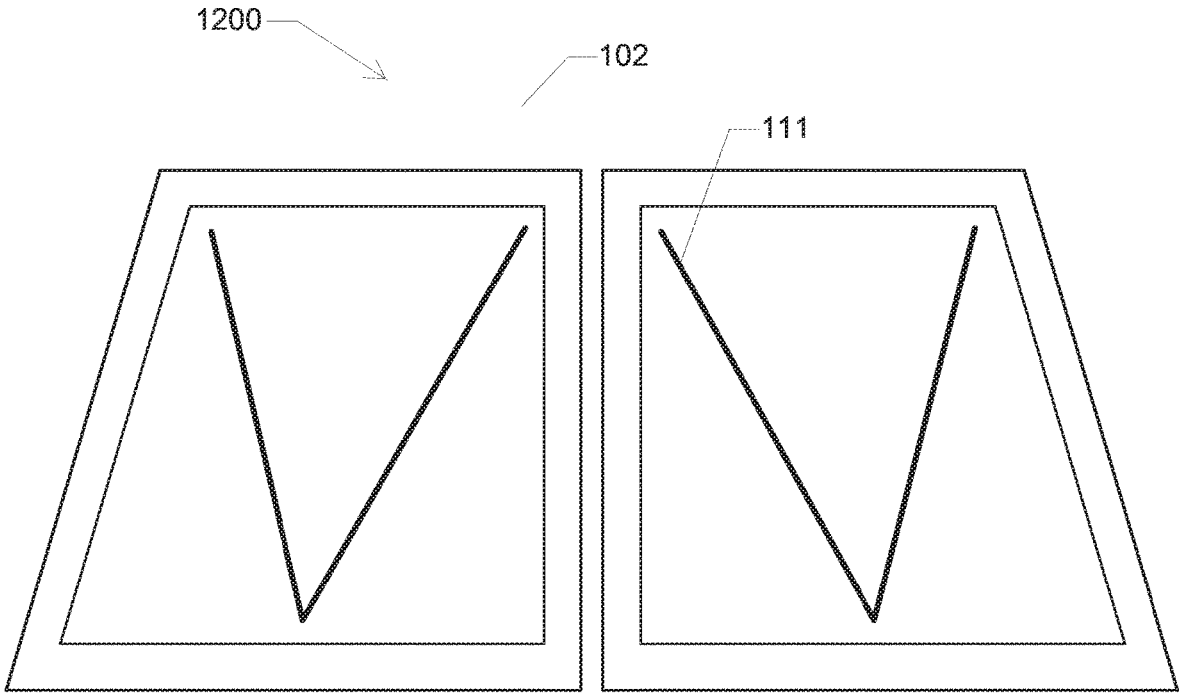
FIGS. 12A, 12B, 12C, 12D, 12E, and 12F illustrate another example installation of an underlayment layer of flooring using fiber boards as a kitchen island binder.
Figure 12B:
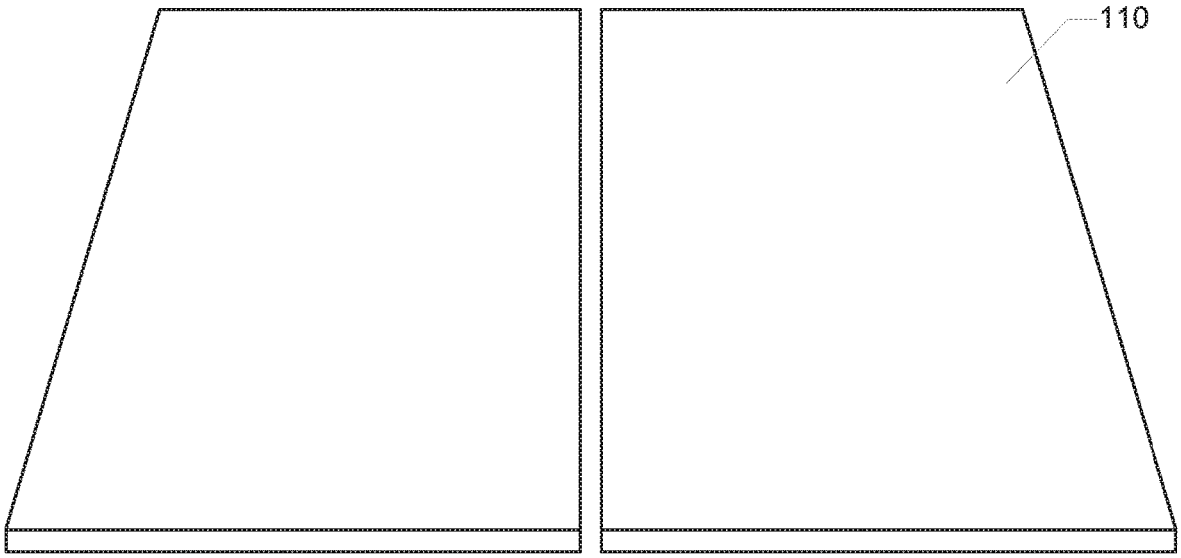
Figure 12C:
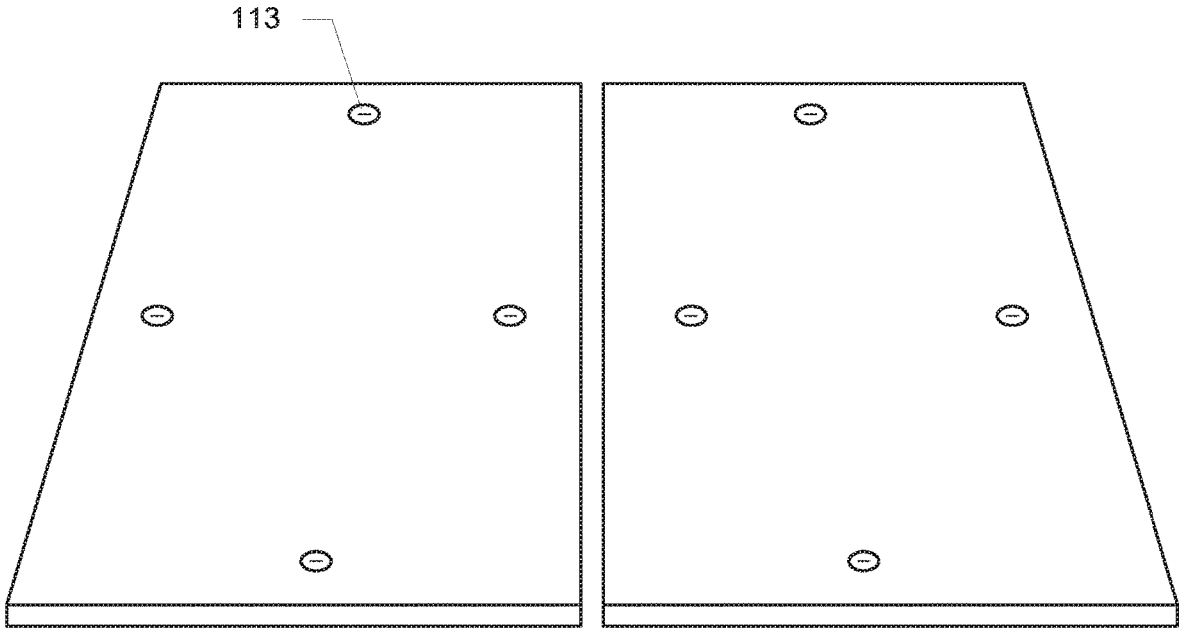
Figure 12D:
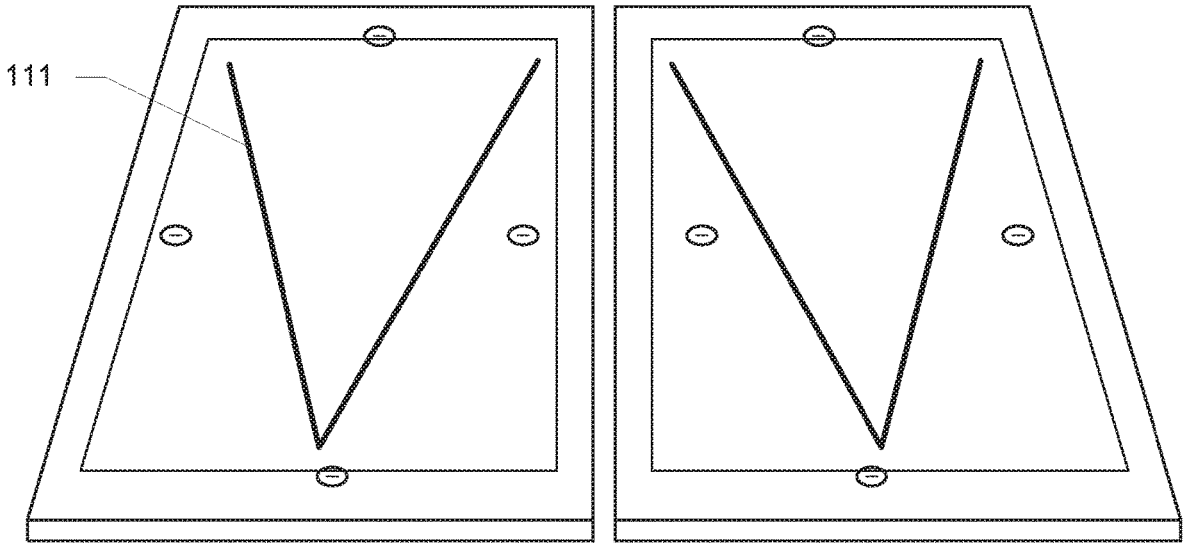
Figure 12E:
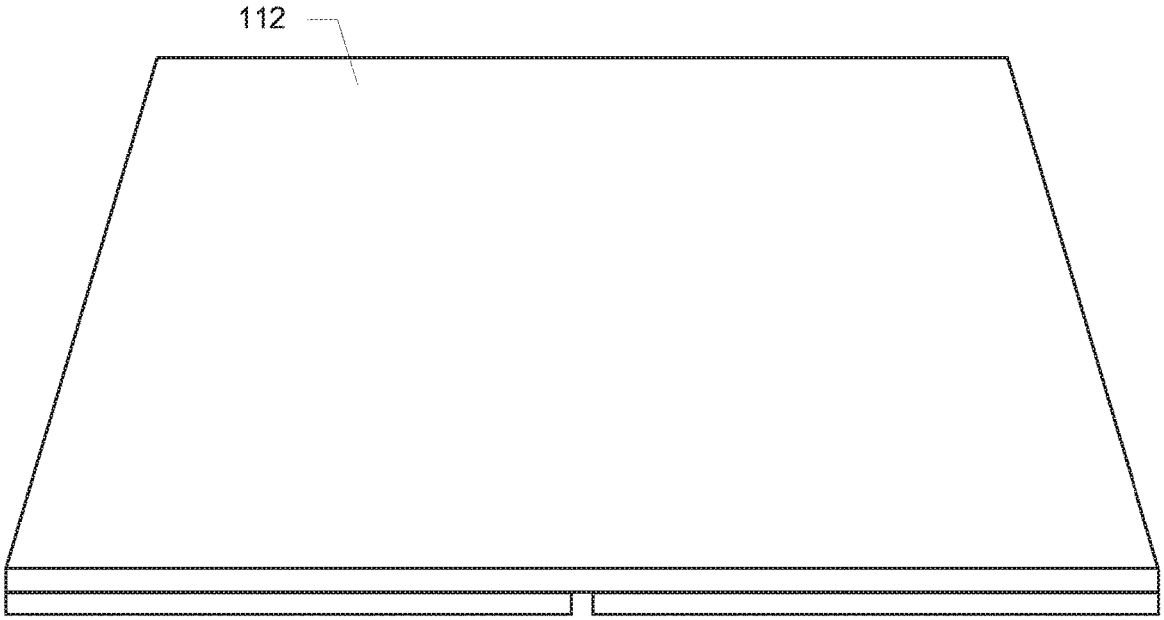
Figure 12F:
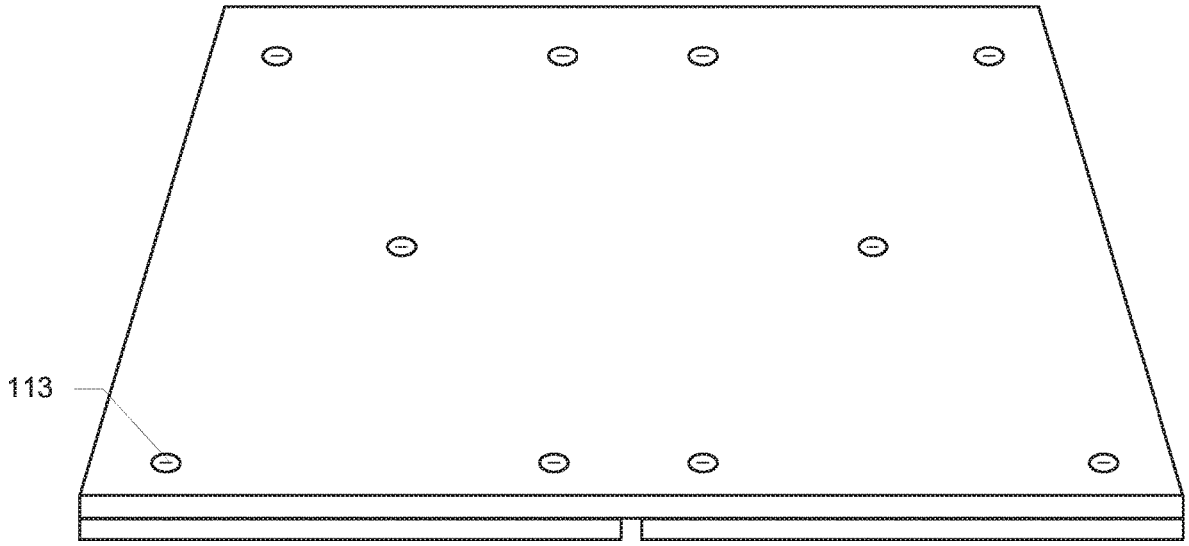

FIG. 12A illustrates application of the adhesive 111 to the subfloor 102. FIG. 12B illustrates installation of the isolation boards 110 on the subfloor 102. FIG. 12C illustrates using mechanical fasteners 113 to secure the isolation board 110 to the subfloor 102 to allow the adhesive 111 to dry. FIG. 12D illustrates application of the adhesive 111 to a topside of the isolation boards 110. FIG. 12E illustrates installation of the structural boards 112 on top of the isolation boards 110 so that they are offset horizontally from one another. FIG. 12F illustrates using mechanical fasteners 113 to secure the structural boards 112 to the isolation boards 110 to allow the adhesive 111 to dry.

FIGS. 13A, 13B, 13C, 13D, and 13E illustrate a plan view of an installation of an underlayment layer 1300 of flooring in a dwelling. The dwelling is a studio-style apartment, but the disclosed installation steps can be applied to various other building and dwelling types. The installation follows the same installation steps described herein with reference to FIGS. 2A-2F but includes all of the disclosed binders rather than just a perimeter binder.

The disclosed installation in FIGS. 13A-13E illustrates that a first portion of the subfloor 102 which is configured to receive the isolation boards 110 can be divided among different rooms and need not be a continuous area. For example, disjointed first portions can be installed for a kitchen island. In addition, it can be seen that the first portion can include the prone areas of the dwelling so that isolation boards 110 and structural boards 112 are installed around the interior perimeter of each room and for other non-critical areas such as kitchen islands, cabinets, underneath bathtubs, in closets, and the like. Thus, the subfloor 102 of a dwelling is typically divided among various rooms, and, particularly in a multi-family dwelling, can have multiple pre-pour, or first portion areas of the subfloor 102.

Figure 13A:
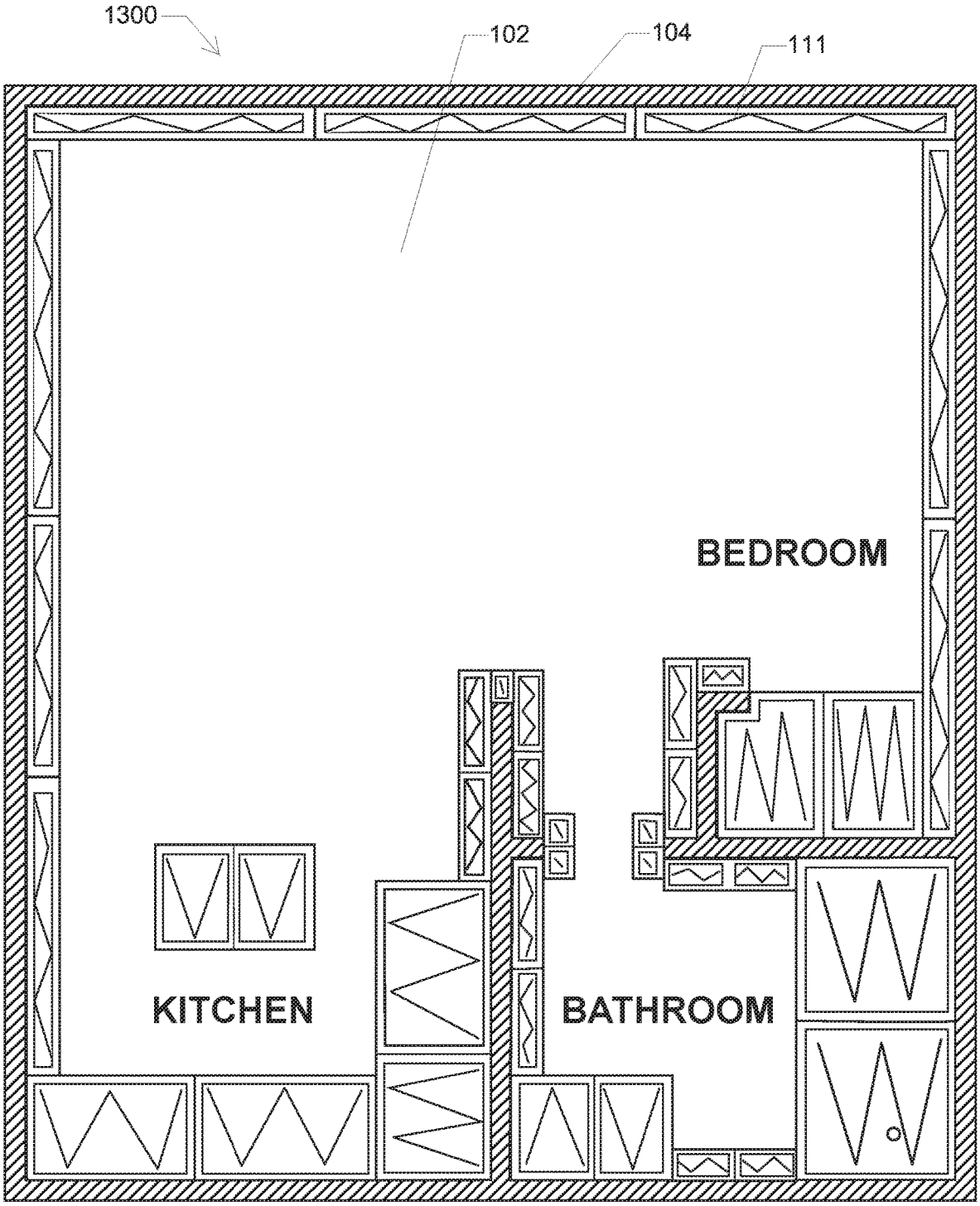
FIGS. 13A, 13B, 13C, 13D, and 13E illustrate a plan view of an installation of an underlayment layer of flooring in a dwelling.
Figure 13B:
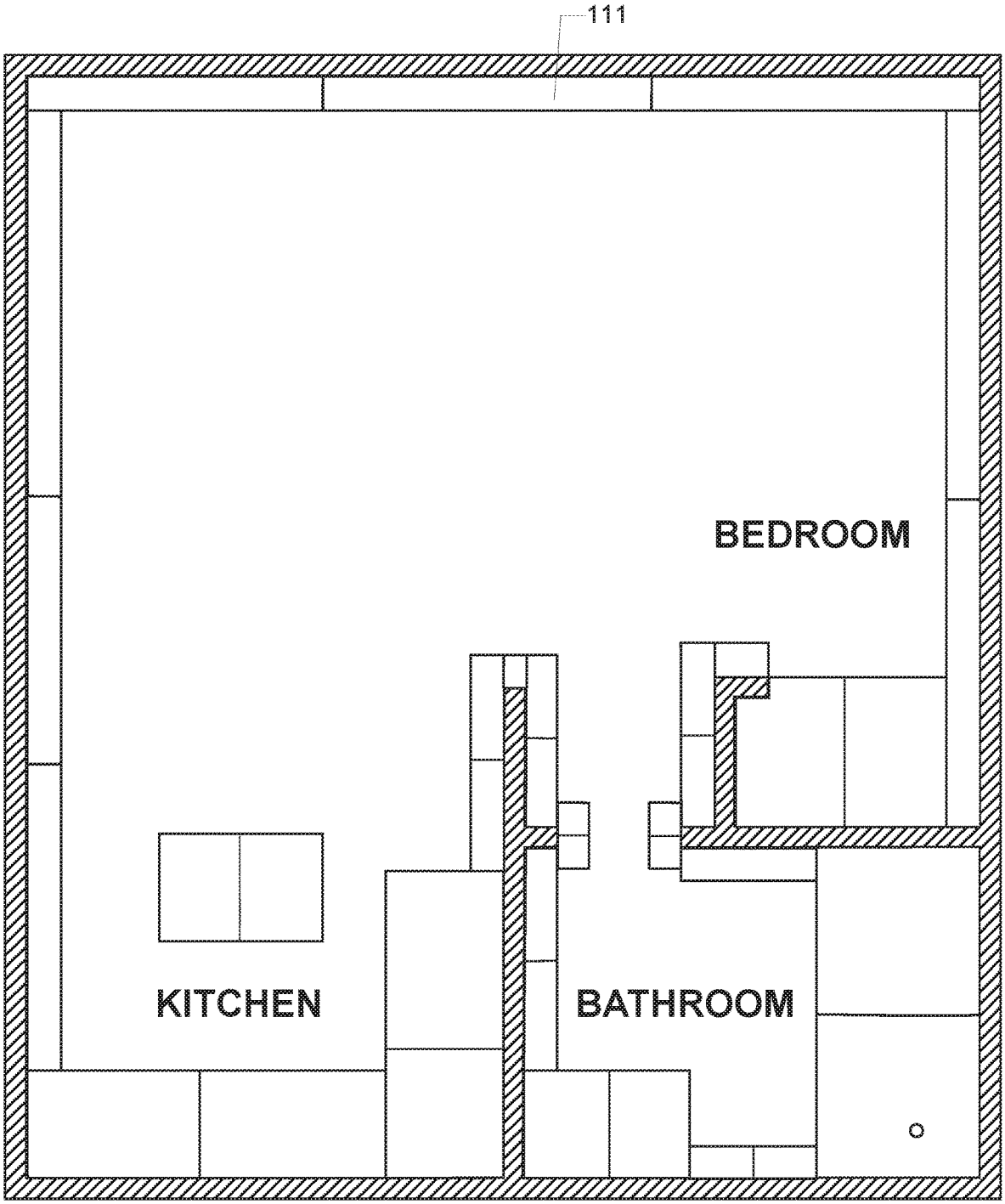
Figure 13C:
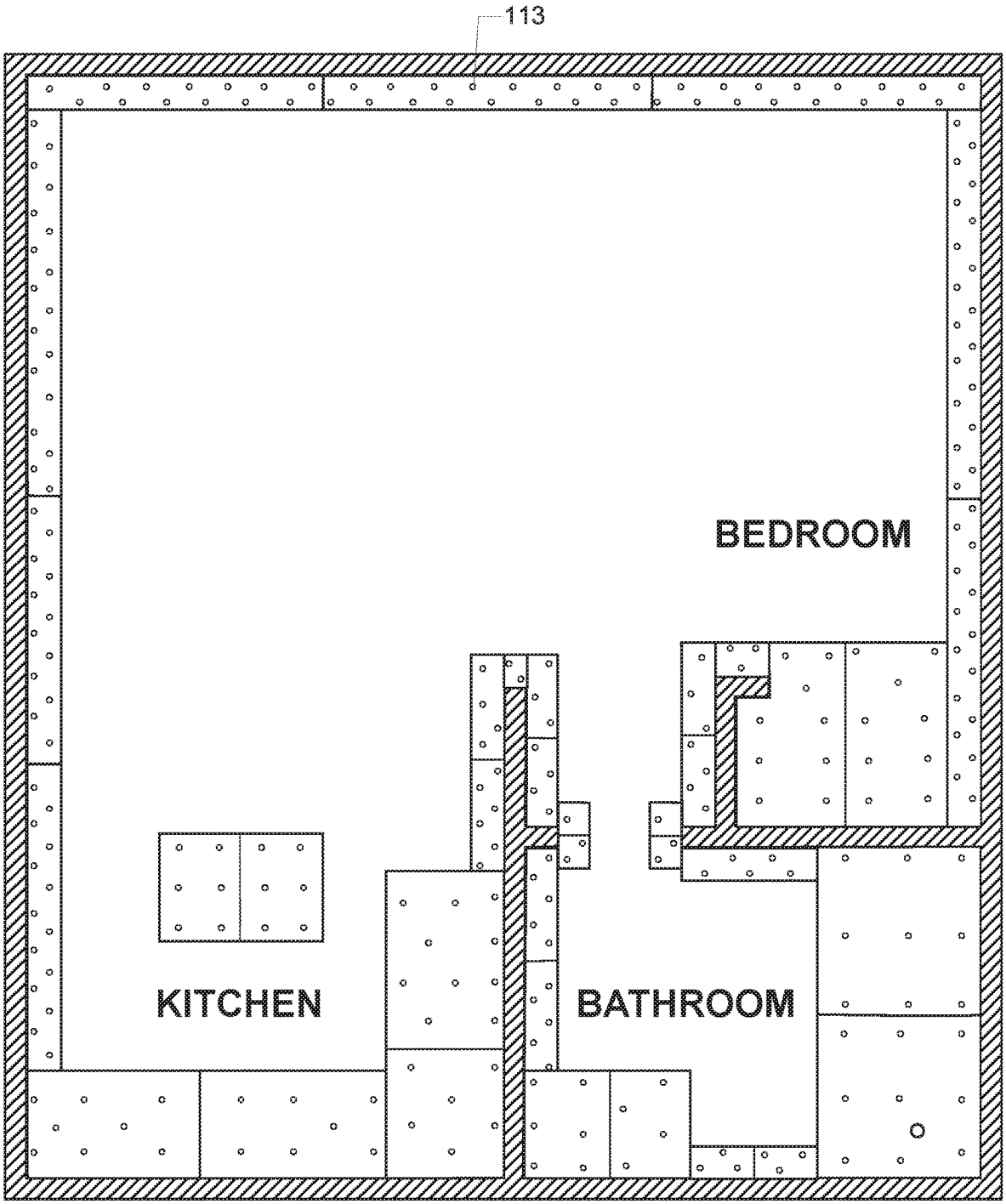
Figure 13D:
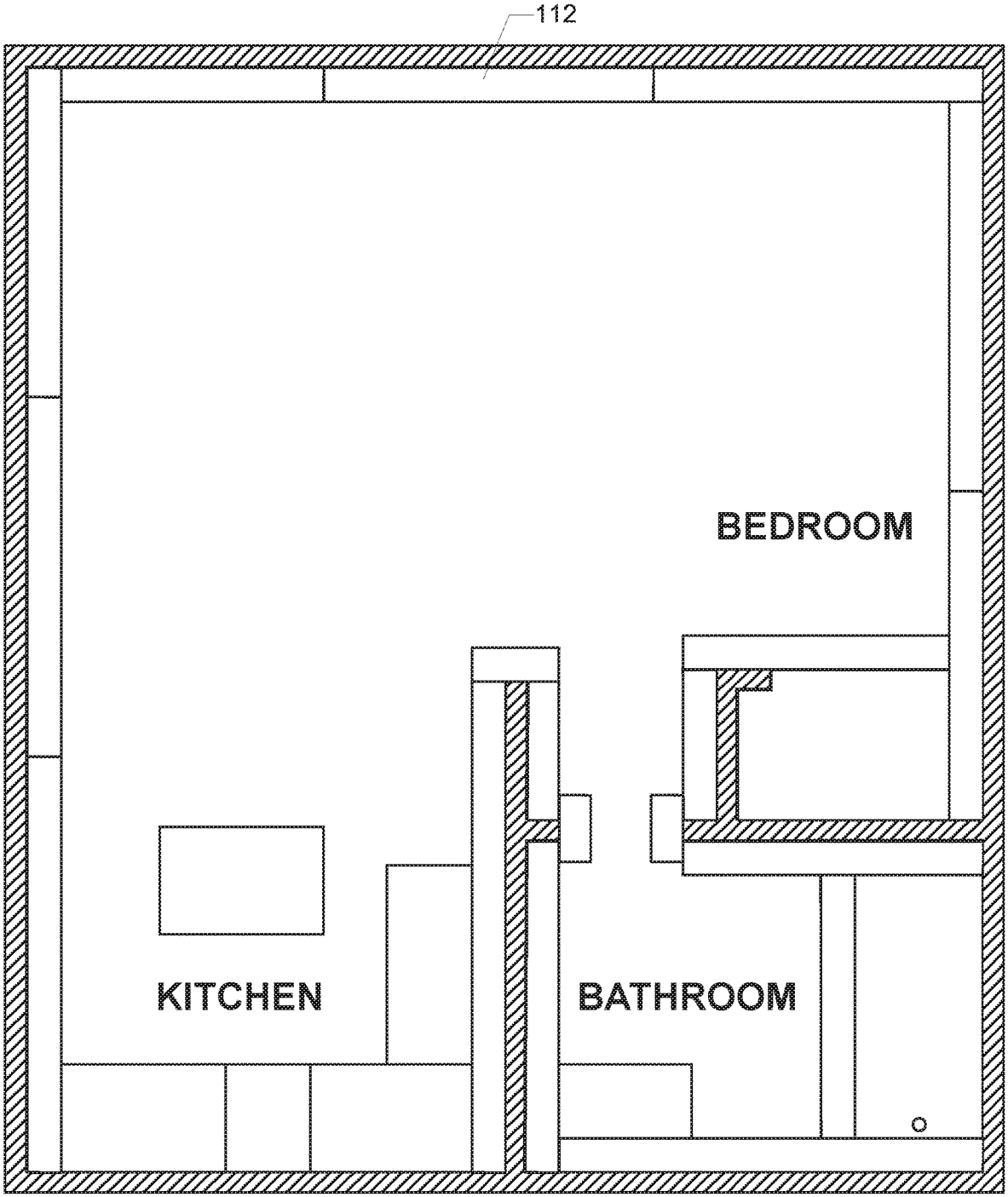
Figure 13E:
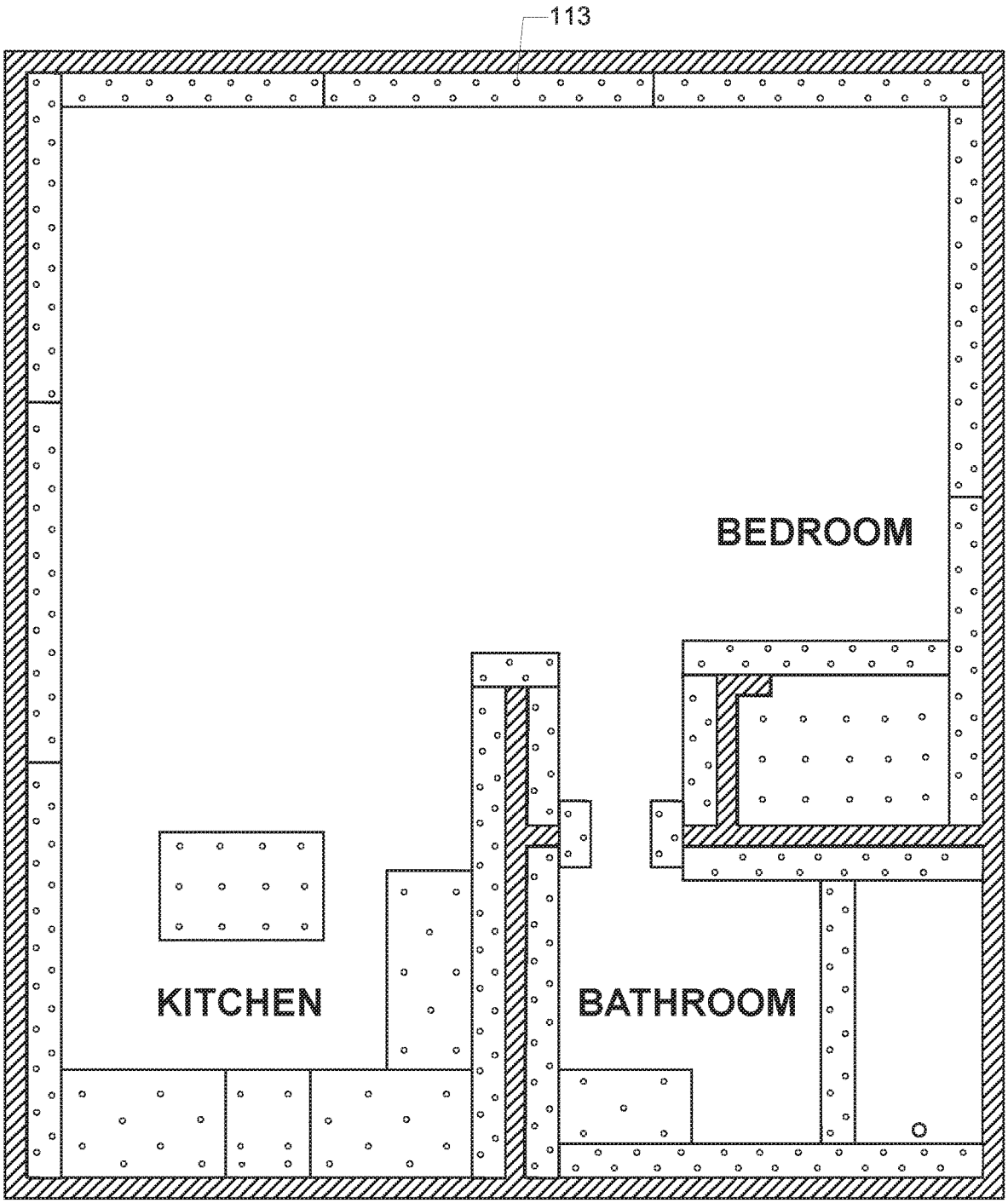

FIG. 13A illustrates application of the adhesive 111 to the subfloor 102. FIG. 13B illustrates installation of the isolation boards 110 on the subfloor 102. FIG. 13C illustrates using mechanical fasteners 113 to secure the isolation boards 110 to the subfloor 102 to allow the adhesive 111 to dry. FIG. 13D illustrates installation of the structural boards 112 on top of the isolation boards 110 so that they are offset horizontally from one another. FIG. 13E illustrates using mechanical fasteners 113 to secure the structural boards 112 to the isolation boards 110 to allow the adhesive 111 to dry.

Example Hybrid Underlayment Installation Methods

Figure 14:
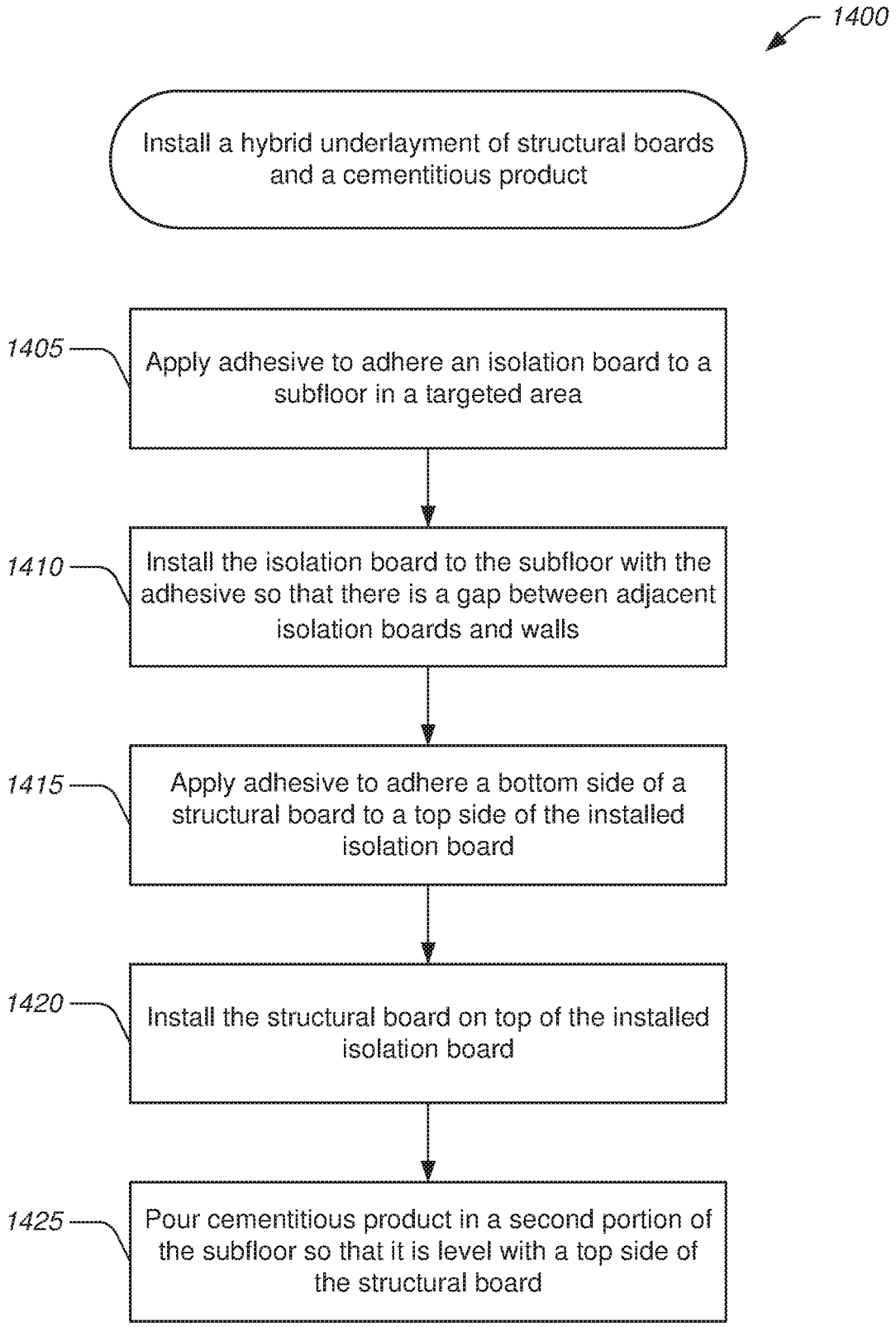
FIG. 14 illustrates a flow chart of an example method for installing a hybrid underlayment of structural boards and a cementitious product.

FIG. 14 illustrates a flow chart of an example method 1400 for installing a hybrid underlayment of fiber boards and a cementitious product. The fiber boards and cementitious product have been described elsewhere herein, so further description of these items will be omitted here for conciseness in the description.

Prior to installing the underlayment layer, a worker can ensure the installation area is swept and clean of debris throughout corners and center. The substrate (e.g., subfloor) can be inspected for delamination and excessive sagging prior to installation of the underlayment. In addition, the worker can confirm the overall thickness of the underlayment, and specifically the targeted thickness of the cementitious product. The structural barrier formed by the isolation board in combination with one or more structural boards should be configured to achieve the targeted thickness of the cementitious product. The isolation board and/or the structural boards are fire-rated and/or sound-rated. The worker may also measure wall length or targeted length and pre-cut the structural boards and/or the isolation boards to the measured length. In addition, the worker may place the isolation board on top of the subfloor, pushing firmly against wall to evaluate and to confirm panel placement.

In block 1405, a worker applies adhesive to adhere an isolation board to the subfloor in a targeted area. The targeted area is located within a first portion of the subfloor where the cementitious product will not be poured. The adhesive can be applied to the subfloor, to an underside of the isolation board, or to both. The worker can apply a pattern of adhesive to the subfloor and/or to the underside of the isolation board.

In block 1410, the worker installs the isolation board to the subfloor with the adhesive so that there is a gap between adjacent isolation boards and any walls. The worker can press the isolation board in place to secure it to the subfloor with the adhesive. This step can be repeated as necessary to obtain targeted coverage with the isolation boards to complete a first installation layer. This step can be repeated for the first layer by installing a plurality of installation boards edge-to-edge to cover the first portion of the subfloor.

In addition, a worker may secure the first layer of isolation board to the subfloor using mechanical fasteners such as nails. Nails can be installed using a linear pattern about 8 inches to about 10 inches apart and about ½ inch from the edge of the isolation board with a ⅛-inch countersink to create an even distribution of pressure and to allow the second layer to be properly placed without obstruction.

Once the first layer of isolation boards has been installed, a second layer can be installed (if necessary). Installation follows the same pattern, but nails are offset from nails in first layer. For example, in block 1415, adhesive is applied to adhere a bottom side of the structural boards to a top side of the installed installation boards. In block 1420, a worker installs the structural board on top of the installed isolation boards. Gaps between boards can be aligned vertically or they can be offset. This completes a second layer of the fiberboard installation, covering the first portion of the subfloor. This process can be repeated to build up a targeted thickness that matches the targeted thickness of the cementitious product pour. The first portion of the subfloor can include areas such as cabinets, closets, bathtubs, areas near walls and/or other dead spaces are to be set. In some embodiments, the worker can place caulking and/or isolating foam at all pipe penetrations or other penetrations.

In block 1425, the worker pours cementitious product in a second portion of the subfloor so that it is level with a top side of the uppermost structural board. This is done to create an even and level underlayment. The method 1400 may also include applying sealant to seams between the combined fiberboards and the cementitious product. This can be done to enhance the levelness of the underlayment. In some instances, a sound mat may be laid over the second portion of the subfloor prior to pouring the cementitious product. Once the flooring system has been installed using the method 1400, construction schedule may commence with installations such as drywall, cabinets, and trim as early as within 24 hours after the final pour.

Example Flooring Installations with Isolation Boards

Figure 15:
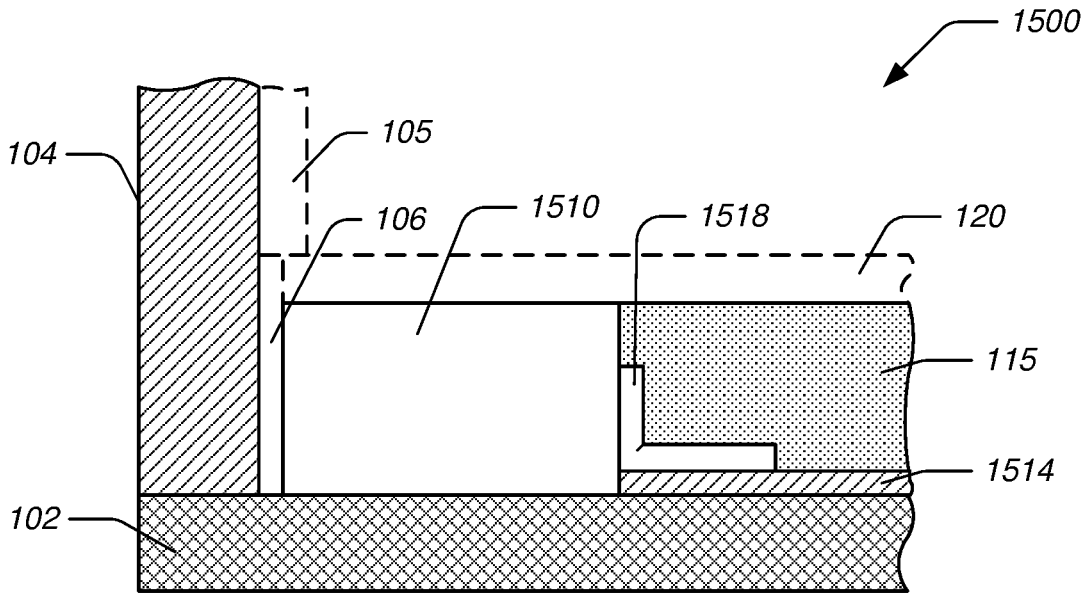
FIG. 15 illustrates a cross-section of flooring having floor isolation boards and a cementitious product.

FIG. 15 illustrates a cross-section of flooring 1500 having floor isolation boards 1510 and a cementitious product 115 forming an underlayment layer. The flooring 1500 is similar to the underlayment 100 described herein with reference to FIGS. 1A-1I, so description of common elements (as indicated by shared callout numbers) are omitted. The floor isolation boards 1510 are similar to the combination of the isolation board 110 and the structural board 112 illustrated and described herein with reference to FIG. 1H, with a difference being a single isolation board 1510 being used to achieve the desired or targeted height for the pour stop of the cementitious product 115. However, it is to be understood that the flooring 1500 can be constructed using a combination of isolation boards and structural boards, as described elsewhere herein. The isolation boards 1510 can be, for example, about 1.25 inches or about 1.5 inches thick, depending on construction details and specifications. Other thickness may be used as well. The isolation boards 1510 can be milled and manufactured to have a targeted height (or thickness). The isolation boards 1510 can be fire-rated and/or sound-rated structural boards tested and approved for construction purposes.

In some embodiments, the isolation board 1510 is a structural board made from cellulose fiber. The isolation board 1510 can be made using a homogeneous composition with protection against termites, rot and fungi and resistance to moisture. In some embodiments, the isolation board 1510 is particleboard or fiberboard made from cellulose fibers, typically from wood, that are bonded together with a synthetic binder or resin. The isolation board 1510 can be manufactured using man-made consolidated cellulosic articles, such as fiberboard, hardboard (e.g., low-density or high-density hardboard), soft board, high-density fiberboard (HDF), medium density fiberboard (MDF), chipboards, particleboard, medium-density particleboard, oriented strandboard (OSB), or the like. In some embodiments, the isolation board 1510 can have a density between about 26 and about 28 lb./ft$^3$. In some embodiments, the isolation board 1510 can comprise engineered wood products prepared from wood fiber extracted from chips and pulped wood waste. In certain embodiments, the isolation board 1510 can have a density greater than about 50 lb/ft$^3$, including values of greater than 60 lb/ft$^3$, 70 lb/ft$^3$, 80 lb/ft$^3$, 90 lb/ft$^3$, or greater than 100 lb/ft$^3$. In certain implementations, to improve water resilience, processing oils can be added during the board formation under high temperature and pressure. In various embodiments, the isolation board 1510 can be prepared from wood wastage fibers glued together with resin or glued under heat and pressure. In certain aspects, the isolation board 1510 has a density of between about 30 lb/ft$^3$ and about 50 lb/ft$^3$, including values of 35 lb/ft$^3$, 40 lb/ft$^3$, and 45 lb/ft$^3$.

The isolation boards 1510 can be secured to the subfloor 102 using any suitable combination of adhesives and/or mechanical fasteners. Examples of adhesives are provided elsewhere herein. Similarly, examples of mechanical fasteners are provided elsewhere herein. A gap 106 can be provided between the isolation boards 1510 and the wall 104, as described elsewhere herein. Drywall 105 can be installed on top of the isolation boards 1510, as described in greater detail with reference to FIG. 1G.

The flooring 1500 can also include a sound control membrane 1514, similar to the sound control membrane 114 described elsewhere herein. The sound control membrane 1514 can be placed and/or secured to the subfloor 102. Multiple pieces of a sound control membrane or mat can be attached together (e.g., at seams) to form the sound control membrane 1514. In some embodiments, a tape material can be used to attach separate pieces of the sound control membrane together. A bonding adhesive in the form of a tape material 1518 can be applied to a face of the isolation board 1510 and to a portion of the sound control membrane 1514. Installed in this manner, the cementitious product 115 can be poured to a targeted height (e.g., a height or thickness of the isolation boards 1510). Finish flooring 120 can then be installed to complete the flooring 1500. In addition, the flooring can include a sealant (as described elsewhere herein) and/or caulking (as described elsewhere herein) at intersections between isolation boards, on components that penetrate through the isolation boards 1510 and the subfloor 102, and/or at intersections between isolation boards 1510 and the cementitious product 115, etc.

Figure 16:
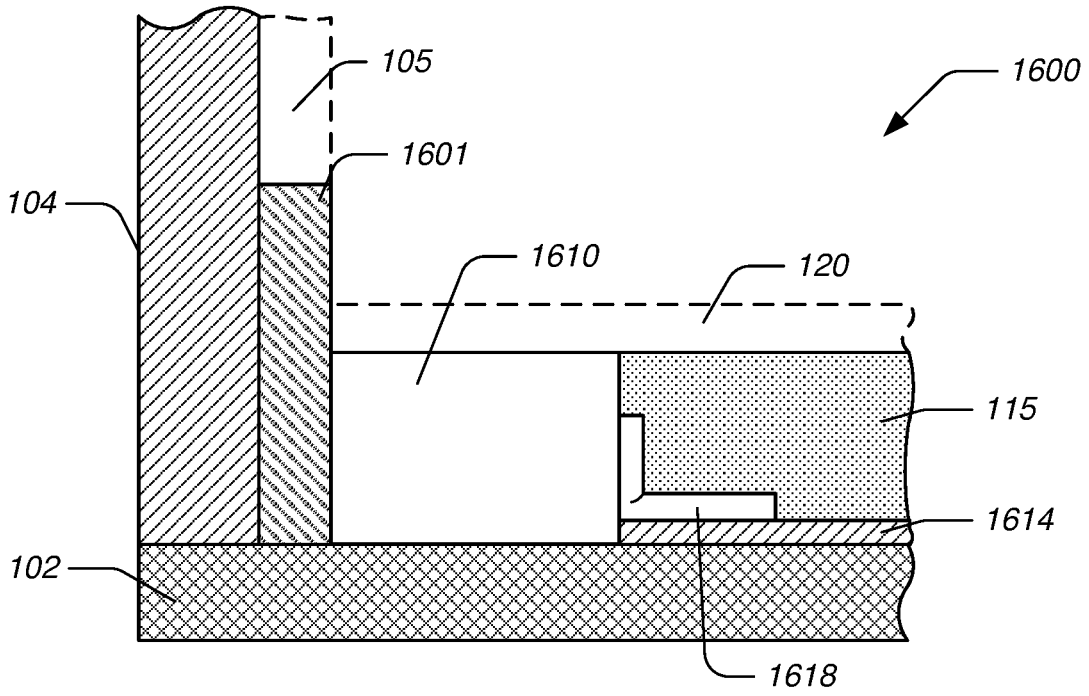
FIG. 16 illustrates a cross-section of flooring having floor isolation boards, wall isolation boards, and a cementitious product.

FIG. 16 illustrates a cross-section of flooring 1600 having floor isolation boards 1610, wall isolation boards 1601, and a cementitious product 115. The flooring 1600 is similar to the flooring 1500 with the addition of the wall isolation boards 1601. There can be a gap between the floor isolation boards 1610 and the wall isolation boards 1601 or there can be no gap (as illustrated). The floor isolation boards 1610 can be a single panel or a stack of panels, as described herein with reference to FIGS. 1H and 1I, for example. Similarly, the wall isolation boards 1601 can be stacked boards (e.g., extending inward from the wall 104) or unstacked. The wall isolation boards 1601 can be the same type of board as the floor isolation boards 1610 or may be any suitable structural or isolation panel described herein. In certain embodiments, the wall isolation boards 1601 can be fire-rated and/or sound-rated structural boards tested and approved for construction purposes, similar to the isolation boards described elsewhere herein. The wall isolation boards 1601 can have a thickness of about 0.625 inches (e.g., ⅝ in.) or between about 0.5 in. and about 1.5 in., between about 0.6 in. and about 1.25 in., or between about 0.75 in. and about 1 in. In some embodiments, the wall isolation boards 1601 can have a thickness that is less than the thickness of the floor isolation boards 1610. The wall isolation boards 1601 can have a height of about 6 in., or at least about 2 in. and/or less than or equal to about 12 in., at least about 4 in. and/or less than or equal to about 10 in., or at least about 5 in. and/or less than or equal to about 8 in. Drywall 105 can be installed over (e.g., above) the wall isolation boards 1601.

The flooring 1600 can also include a sound control membrane 1614, similar to the sound control membrane 114 described elsewhere herein. The sound control membrane 1614 can be placed and/or secured to the subfloor 102. Multiple pieces of a sound control membrane or mat can be attached together (e.g., at seams) to form the sound control membrane 1614. In some embodiments, a tape material can be used to attach separate pieces of the sound control membrane together. A bonding adhesive in the form of a tape material 1618 can be applied to a face of the isolation board 1610 and to a portion of the sound control membrane 1614. Installed in this manner, the cementitious product 115 can be poured to a targeted height (e.g., a height or thickness of the isolation boards 1610). Finish flooring 120 can then be installed to complete the flooring 1600. In addition, the flooring can include a sealant (as described elsewhere herein) and/or caulking (as described elsewhere herein) at intersections between floor isolation boards, at intersections between wall isolation boards, at intersections between floor isolation boards and wall isolation boards, on components that penetrate through the isolation boards 1610 and the subfloor 102, and/or at intersections between isolation boards 1610 and the cementitious product 115.

Figure 17:
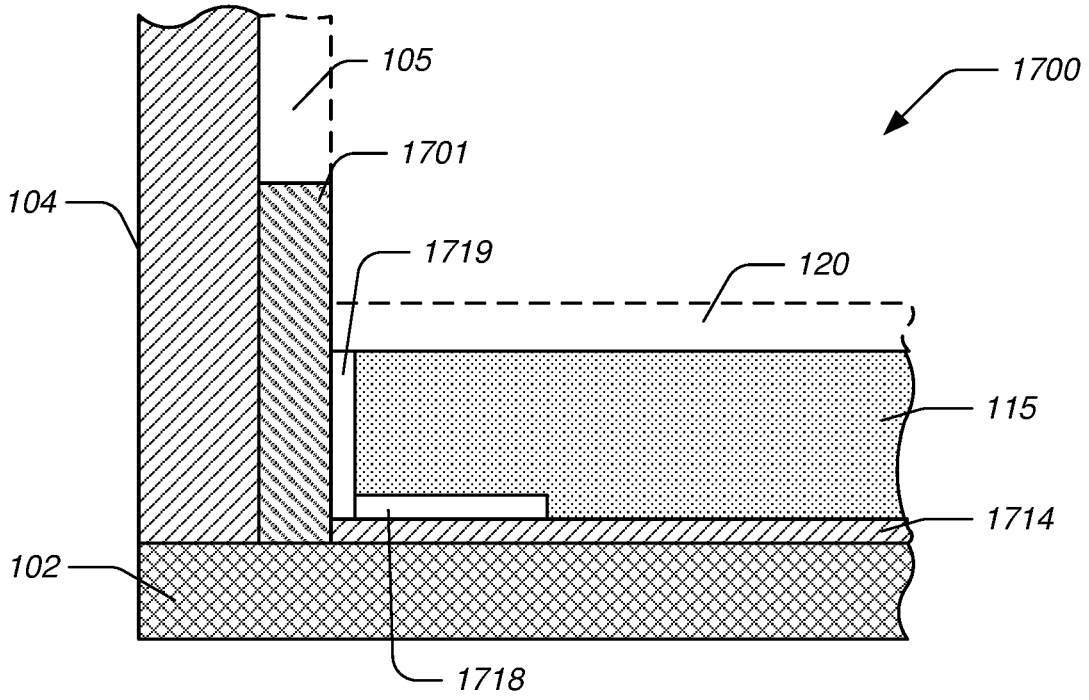
FIG. 17 illustrates a cross-section of flooring having wall isolation boards and a cementitious product.

FIG. 17 illustrates a cross-section of flooring 1700 having wall isolation boards 1701 and a cementitious product 115. The flooring 1700 is similar to the flooring 1600 without the inclusion of floor isolation boards 1610. The wall isolation boards 1701 can be installed by securing the wall isolation boards 1701 to the wall 104 using mechanical fasteners (e.g., drywall screws, nails, etc.) and/or adhesives, as described elsewhere herein. With the wall isolation boards 1701 installed, a perimeter isolation strip 1719 can be secured to the wall isolation boards 1701. The perimeter isolation strip 1719 can be a tape material that provides, enhances, or assists with the isolation properties of the wall isolation boards 1701. Drywall 105 can be installed over (e.g., above) the wall isolation boards 1701.

The flooring 1700 can also include a sound control membrane 1714, similar to the sound control membrane 114 described elsewhere herein. The sound control membrane 1714 can be placed and/or secured to the subfloor 102. Multiple pieces of a sound control membrane or mat can be attached together (e.g., at seams) to form the sound control membrane 1714. In some embodiments, a tape material can be used to attach separate pieces of the sound control membrane together. A bonding adhesive in the form of a tape material 1718 can be applied to a portion of the sound control membrane 1714. Installed in this manner, the cementitious product 115 can be poured to a targeted height. The targeted height can be higher than a height of the perimeter isolation strip 1719, the same height as the perimeter isolation strip 1719, or below the height of the perimeter isolation strip 1719. Finish flooring 120 can then be installed to complete the flooring 1700. In addition, the flooring can include a sealant (as described elsewhere herein) and/or caulking (as described elsewhere herein) at intersections between wall isolation boards 1701, on components that penetrate through the subfloor 102, and/or at intersections between wall isolation boards 1701 and the cementitious product 115.

Example Methods for Installing Flooring with Isolation Boards

Figure 18:
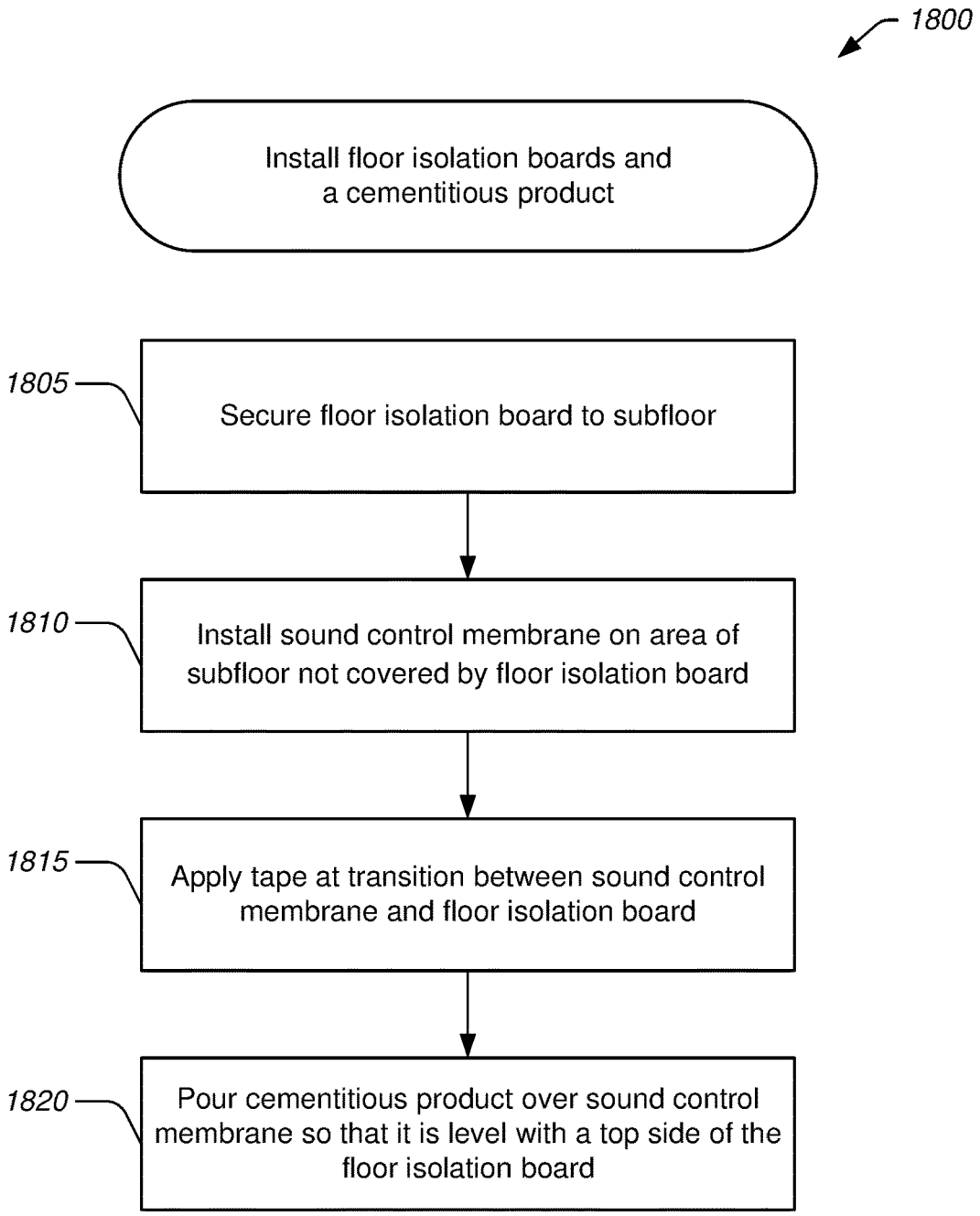
FIG. 18 illustrates a flow chart of an example method for installing floor isolation boards and a cementitious product.

FIG. 18 illustrates a flow chart of an example method 1800 for installing floor isolation boards and a cementitious product. The method 1800 can be used to install the flooring 1500 described herein with reference to FIG. 15, for example, but may also be used to install the flooring of any of FIGS. 1-13.

Prior to installing the underlayment layer and the isolation boards, a worker can ensure the installation area is swept and clean of debris throughout corners and center. The substrate (e.g., subfloor) can be inspected for delamination and excessive sagging prior to installation of the isolation boards. In addition, the worker can confirm the overall thickness of the underlayment, and specifically the targeted thickness of the cementitious product. The structural barrier formed by the isolation board should be configured to achieve the targeted thickness of the cementitious product. The isolation boards are fire-rated and/or sound-rated. The worker may also measure wall length or targeted length and pre-cut the isolation boards to the measured length. In addition, the worker may place the isolation boards on top of the subfloor, pushing firmly against wall to evaluate and to confirm panel placement.

At block 1805, a worker secures floor isolation boards to the subfloor in a targeted area. The targeted area is located within a first portion of the subfloor where the cementitious product will not be poured. The worker can secure the floor isolation boards to the subfloor so that there is a gap between adjacent isolation boards and any walls. The worker can secure the floor isolation boards to the subfloor using one or a combination of adhesives and mechanical fasteners. If multiple layers of floor isolation boards are to be used, the worker can then install a second layer of the floor isolation boards. In this way, the height of the isolation boards can be built up to a targeted or desired height. The targeted area of the subfloor can include areas such as cabinets, closets, bathtubs, areas near walls and/or other dead spaces are to be set. In some embodiments, the worker can place caulking and/or isolating foam at all pipe penetrations or other penetrations.

In some embodiments, the worker lays out the floor isolation boards running parallel to the walls of the room and pushes the boards tight against the base plate of the wall. The worker can then dry fit the isolation boards on each wall using a cabinetry square to account for a gap between each board of no more than about 0.125 in. The worker then applies a bonding adhesive in an S-shaped pattern, for example, to the subfloor and/or to the isolation boards (as described elsewhere herein). The worker can then even out the adhesive material using a trowel, for example. After application and smoothing of the adhesive, the worker can flip the isolation boards and install adhesive side down. The worker can then fasten the isolation boards to the subfloor using 0.080 ring shank coil nails in an offset pattern at about 18 in. on center and no less than about 1 in. from any exposed edge. This can be repeated for areas to cabinetry or other designated areas (e.g., under bathtubs).

At block 1810, the worker installs a sound control membrane on an area of the subfloor not covered by the floor isolation boards. The worker can unroll and lay loose the sound control membrane (e.g., in strips) across the subfloor. Where the sound control membrane is made up of multiple pieces, the worker can seam the pieces of mat together using mechanical fasteners (e.g., zip strips), adhesives, and/or tape. The worker can seam the pieces together at the ends of the sound control membrane using a bonding tape, for example. In some embodiments, after installation of the sound control membrane, the worker should not allow further penetrations to be made in the subfloor as it may degrade the quality of sound control provided by the membrane. The sound control membrane can be installed on a portion of a second area of the subfloor, wherein the subfloor is made up of the first area (covered by the floor isolation boards) and the second area (the portion of the subfloor not covered by the floor isolation boards).

At block 1815, the worker applies a tape material at a transition between the sound control membrane and the floor isolation boards. The tape material can be a bonding tape, for example. In some embodiments, the tape material can be applied so that it covers a portion of the face of the isolation board and a portion of the sound control membrane. In some embodiments, the height covered by the tape material on the face of the isolation boards is about the same as the distance covered on the sound control membrane (e.g., about 1 in. on the face of the isolation board and about 1 in. on the sound control membrane).

At block 1820, the worker pours a cementitious product over the subfloor and the sound control membrane in a second area to a targeted height, such as level with a top side of the floor isolation boards. This is done to create an even and level underlayment. The method 1800 may also include applying sealant to seams between the boards and the cementitious product. This can be done to enhance the levelness of the underlayment. Once the flooring system has been installed using the method 1800, construction schedule may commence with installations such as drywall, cabinets, and trim as early as within 24 hours after the final pour.

Figure 19:
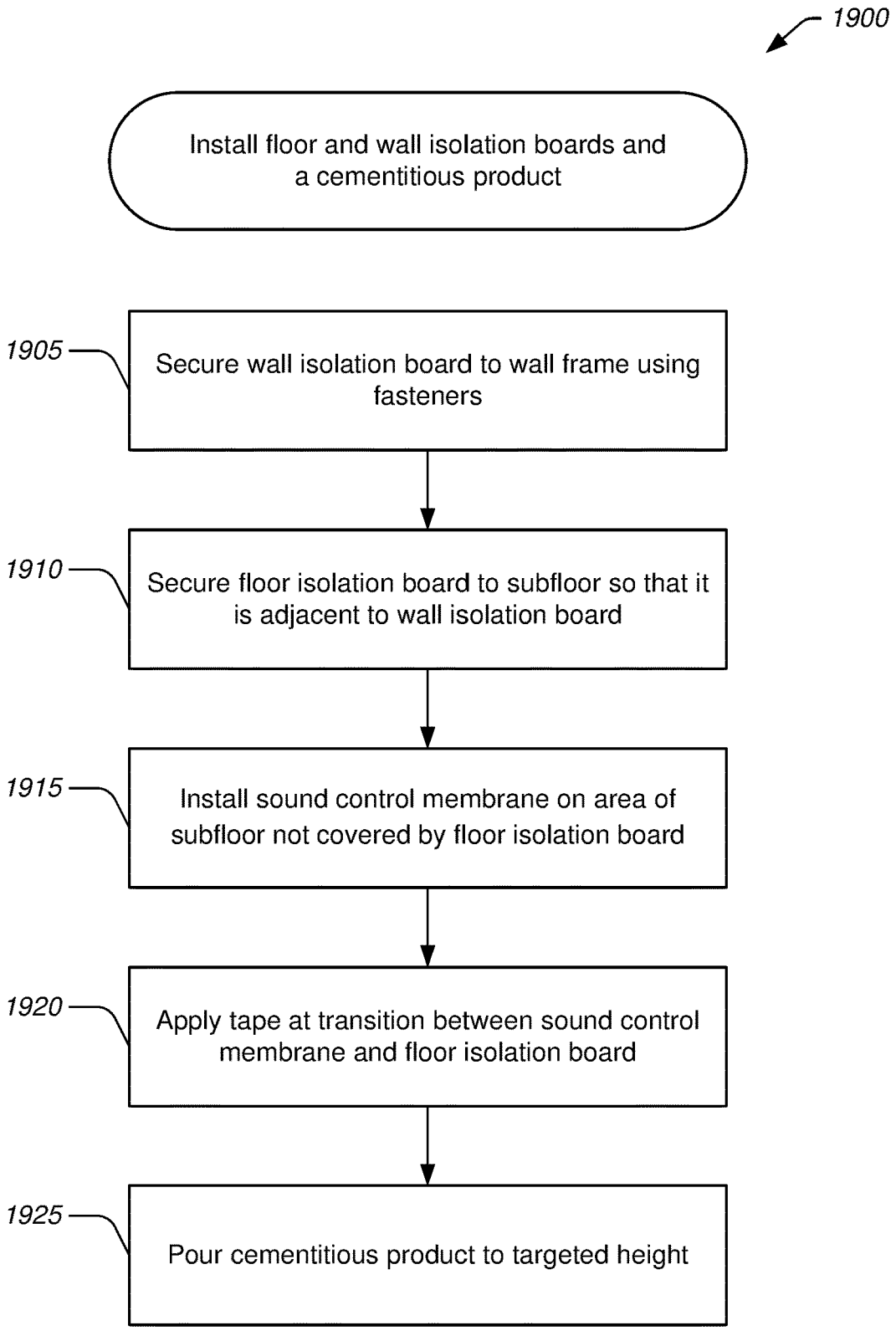
FIG. 19 illustrates a flow chart of an example method for installing floor and wall isolation boards and a cementitious product.

FIG. 19 illustrates a flow chart of an example method 1900 for installing floor and wall isolation boards and a cementitious product. The method 1900 can be used to install the flooring 1600 described herein with reference to FIG. 16, for example. For steps that are similar to the method 1800, description will refer to that corresponding step rather than repeating the description. For example, prior to installing the underlayment layer and the isolation boards, a worker can prepare the area as described herein with reference to the method 1400 and the method 1800.

At block 1905, the worker secures the wall isolation boards to the wall frame using mechanical fasteners. The wall isolation boards can be installed in a manner similar to the floor isolation boards, but against the wall frame rather than on the subfloor.

At block 1910, the worker secures floor isolation boards to the subfloor so that at least a portion of the floor isolation boards are adjacent to the wall isolation boards. Installation of the floor isolation boards is similar to the step 1805 of the method 1800.

In some embodiments, for steps 1905 and 1910, the worker lays out the floor isolation boards running parallel to the walls of the room and pushed tight against the base plate of the wall with the length side down. The worker then lays out the wall isolation boards running parallel to the walls of the room with the length side up and pushed tight against the base plate of the wall. The worker then fastens the wall isolation boards to the studs of the wall frame and sill plate along the base of the wall, for example, using 1.25 in. drywall screws and 2 screws to each stud. The worker then dry fits the floor isolation boards on each wall using a cabinetry square to account for a gap between each board of no more than about 0.125 in. The worker then applies a bonding adhesive (e.g., using a caulking gun) in an S-shaped pattern on the floor isolation boards. The worker then evens out the adhesive material (e.g., using a trowel). The worker then Flips the floor isolation board and installs the boards glue side down. The worker then fastens the floor isolation boards to the subfloor using 0.080 ring shank coil nails in an offset pattern at about 18 in. on center with no less than about 1 in. from any exposed edge. These steps can be repeated for each designated area (e.g., areas that receive cabinets, bathtubs, etc.).

At block 1915, the worker installs a sound control membrane on an area of the subfloor not covered by the floor isolation boards. Installation of the sound control membrane is similar to the step 1810 of the method 1800.

At block 1920, the worker applies a tape material at a transition between the sound control membrane and the floor isolation boards. Installation of the tape material is similar to the step 1815 of the method 1800.

At block 1925, the worker pours a cementitious product over the subfloor and the sound control membrane in a second area to a targeted height, such as level with a top side of the floor isolation boards. Pouring the cementitious product is similar to the step 1820 of the method 1800. In some embodiments, the height of the cementitious product is higher than the height of the floor isolation boards and the cementitious product contacts the wall isolation boards. The height of the cementitious product can be controlled so that it reaches the targeted height by using a height-specific screed darby, for example.

Figure 20:
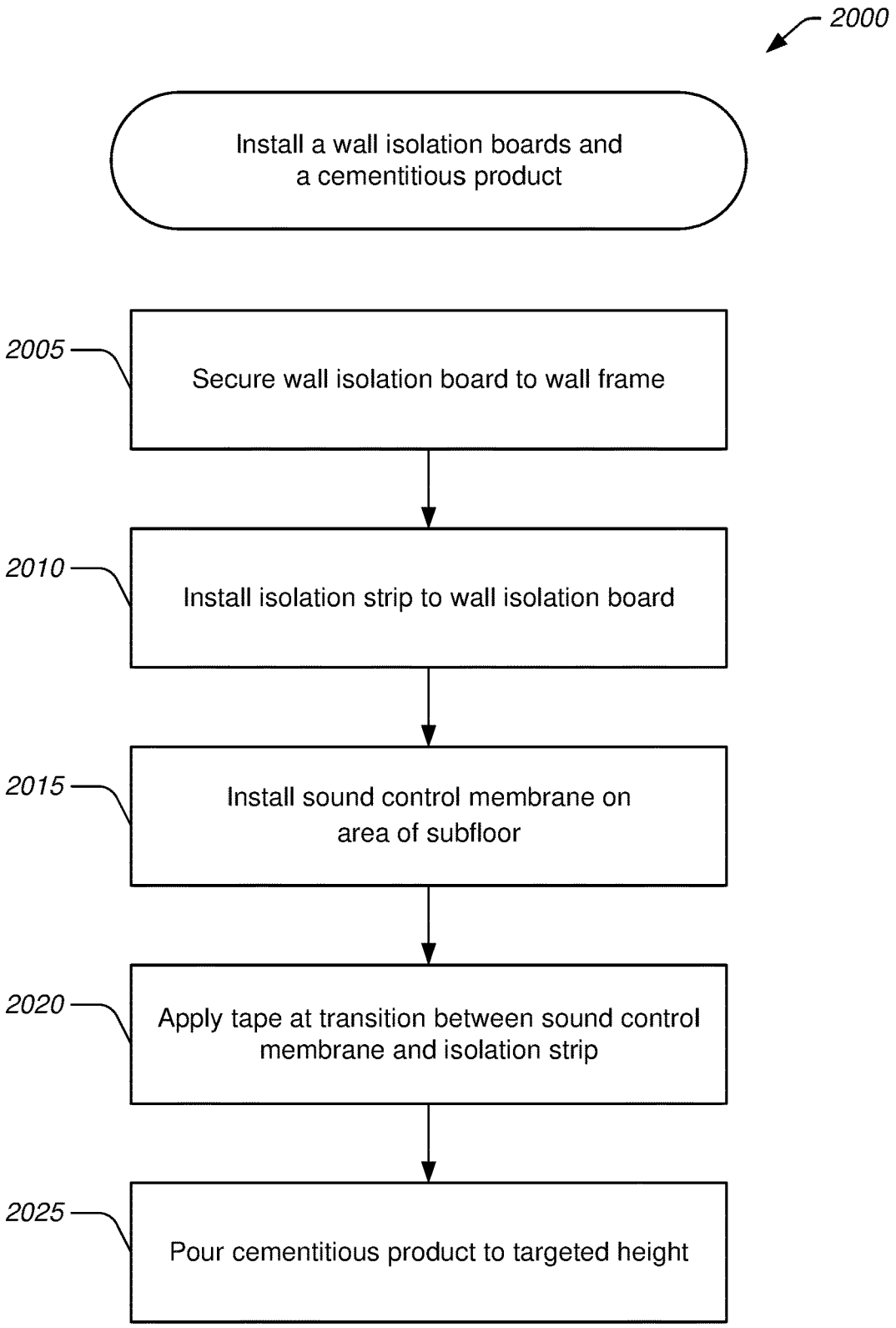
FIG. 20 illustrates a flow chart of an example method for installing wall isolation boards and a cementitious product.

FIG. 20 illustrates a flow chart of an example method 2000 for installing wall isolation boards and a cementitious product. The method 2000 can be used to install the flooring 1700 described herein with reference to FIG. 17, for example. For steps that are similar to the method 1800, description will refer to that corresponding step rather than repeating the description. For example, prior to installing the underlayment layer and the isolation boards, a worker can prepare the area as described herein with reference to the method 1400 and the method 1800.

At block 2005, the worker secures the wall isolation boards to the wall frame using mechanical fasteners. The wall isolation boards can be installed in a manner similar to the floor isolation boards, but against the wall frame rather than on the subfloor.

In some embodiments, the worker lays out the wall isolation boards running parallel to the walls of the room with the length side up and pushed tight against the base plate of the wall. The worker then fastens the wall isolation boards to the studs of the wall frame and sill plate along the base of the wall, for example, using 1.25 in. drywall screws and 2 screws to each stud.

At block 2010, the worker installs an isolation strip to a portion of the wall isolation boards. The isolation strip can be installed so that a bottom portion is in contact with or near the subfloor. The isolation strip can be tacked to the wall isolation board. In some embodiments, adhesives may be used in addition to or in place of mechanical fasteners such as tacks. The isolation strip can extend partially up the wall isolation board. For example, the isolation strip can extend about 4 in. up the wall isolation board. Other heights may be used as well. In some embodiments, the tacks can be placed in the top 2 in. of the isolation strip.

At block 2015, the worker installs a sound control membrane on an area of the subfloor. Installation of the sound control membrane is similar to the step 1810 of the method 1800.

At block 2020, the worker applies a tape material at a transition between the sound control membrane and the isolation strip. Installation of the tape material is similar to the step 1815 of the method 1800, replacing the floor isolation board with the isolation strip.

At block 2025, the worker pours a cementitious product over the subfloor and the sound control membrane to a targeted height. Pouring the cementitious product is similar to the step 1820 of the method 1800. In some embodiments, the height of the cementitious product is lower than the height of the isolation strip. The height of the cementitious product can be controlled so that it reaches the targeted height by using a height-specific screed darby, for example.

Example Performance Metrics

The following includes tables summarizing testing results of various underlayment configurations. The tables indicate hybrid underlayment systems, as disclosed herein, enhance sound control over cementitious product or fiberboards alone.

The tests include (2) Normalized Noise Isolation Class (NNIC) and ten (10) Normalized Impact Sound Rating (NISR) tests to evaluate the airborne and impact sound isolation of the floor ceiling assembly between units. The tests were performed in strict accordance with ASTM standard E336, "Standard Test Method for Measurement of Airborne Sound Attenuation between Rooms in Buildings" and ASTM standard E1007, "Standard Test Method for Field Measurement of Tapping Machine Impact Sound Transmission Through Floor-Ceiling Assemblies and Associated Support Structures". The tests also included the impact isolation class rating (IIC) based on ASTM testing protocol E492.90 and E989.89. Impact Insulation Class rating or IIC rating can be used by architects, builders and code authorities for acoustical design purposes in building construction. The greater the IIC rating, the lower the impact sound transmission through the floor-ceiling assembly. The sound transmission classification (STC) value was obtained using ASTM testing protocol E90-97 and E413-87. Low Frequency Impact Rating (LIR), which defines the thudding on a floor. High Frequency Impact Rating (NHIR), which defined the high frequency impact isolation (like high heels, animal nails, etc. on the floor). Both of these are important in defining acoustical performance.

Results based on floor-ceiling testing are shown in Table 1.

TABLE 1

| Test Specimen | NNIC | NISR | LIR | NHIR |
|---|---|---|---|---|
| Living Room to Garage (hybrid system, 6" perimeter) | — | 40 | 51 | 39 |
| Kitchen to Garage (hybrid system, fiberboards under cabinet areas) | — | 45 | 42 | 45 |
| Bedroom 3 to Garage (gypsum concrete) | — | 42 | 53 | 41 |
| Bedroom 3 closet to garage (fiberboard) | — | 43 | 52 | 54 |
| Bedroom 1 to Garage (gypsum concrete) | — | 40 | 60 | 39 |
| Bedroom 1 closet to garage (fiberboard) | — | 46 | 59 | 60 |
| Master Bedroom to Garage (gypsum concrete) | — | 39 | 47 | 38 |
| Master Bedroom to Garage (fiberboard) | — | 42 | 55 | 53 |
| Bedroom 3 to Garage (gypsum concrete area only) | — | 44 | 49 | 43 |
| Bedroom 3 to Garage (fiberboard area only) | — | 42 | 59 | 51 |

TABLE 1-continued

| Test Specimen | NNIC | NISR | LIR | NHIR |
|---|---|---|---|---|
| Living room and kitchen to garage (gypsum concrete) | 39 | — | — | — |
| Bedrooms Area (hybrid system) | 42 | — | — | — |

Three subfloor systems were tested over a wood structure with a direct attached ceiling and batt insulation in the stud cavities. The systems were: 1" thick gypsum concrete throughout, 1" thick gypsum concrete with a border of fiberboards (i.e., the hybrid underlayment described herein), and fiberboards alone. Floor finishes were not installed at the time of the test. The average impact ratings for each subfloor system are summarized in Table 2.

TABLE 2

| System | Average NISR | Average LIR | Average NHIR |
|---|---|---|---|
| Gypsum concrete | 41 | 51 | 41 |
| Gypsum concrete with fiberboard | 43 | 47 | 42 |
| Fiberboard | 43 | 56 | 54 |

The testing revealed similar performance between the gypsum concrete system and the hybrid system. The hybrid system (primarily in closets and under tubs) was found be significantly better at reducing high frequency impact sounds. The NHIR rating of the fiberboards alone was 13 points better than the gypsum concrete system, which is related to the material properties associated with the fiberboards that damp the high frequency sounds, which is not accomplished by gypsum concrete; which is expected. The fiberboards show an increase (amplification) in sound levels between 100 and 400 Hz, but this did not affect the ratings and is also expected from these systems.

Terminology and Additional Embodiments

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional subcomponents to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list. The word "exemplary" is used exclusively herein to mean "serving as an example, instance, or illustration." Any implementation described herein as "exemplary" is not necessarily to be construed as preferred or advantageous over other implementations.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various embodiments described above can be combined to provide further embodiments. Accordingly, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A method for installing a flooring system, the method comprising:

securing a back face of wall isolation boards to studs of a wall frame so that a bottom edge of the wall isolation board is adjacent to a subfloor and a top edge of the wall isolation board is less than or equal to about 12 inches above the subfloor, the wall isolation boards being installed adjacent to one another to cover a portion of the wall frame, the wall isolation boards comprising cellulose fiberboards;

installing a sound control membrane over a portion of the subfloor;

installing an isolation strip to a front face of the wall isolation boards with a bottom edge of the isolation strip adjacent to the sound control membrane; and pouring cementitious product over the sound control membrane so that the poured cementitious product reaches a targeted height that does not exceed a top edge of the isolation strip.

2. The method of claim 1 wherein securing the wall isolation boards to the wall frame includes using at least two dry wall screws for each wall isolation board.

3. The method of claim 1 further comprising applying a tape material at a transition between the sound control membrane and the isolation strip.

4. The method of claim 1 wherein the sound control membrane extends over the entire subfloor between wall frames of a building.

5. The method of claim 1 wherein the wall isolation boards comprise fire-rated cellulose fiberboard.

6. The method of claim 1 wherein a thickness of the wall isolation boards is greater than or equal to about 0.5 inches and less than or equal to about 1 inch.

7. The method of claim 1 wherein the cementitious product comprises gypsum concrete.

8. The method of claim 1 wherein the targeted height is less than or equal to about 1.5 inches.

9. The method of claim 1 wherein an edge of the sound control membrane is adjacent to the wall isolation boards.

10. A method for installing a flooring system, the method comprising:

securing a back face of wall isolation boards to studs of a wall frame so that a bottom edge of the wall isolation board is adjacent to a subfloor and a top edge of the wall isolation board is less than or equal to about 12 inches above the subfloor, the wall isolation boards being installed adjacent to one another to cover a portion of the wall frame, the wall isolation boards comprising cellulose fiberboards;

securing floor isolation boards to a first area of the subfloor, wherein the floor isolation boards are adjacent to a front face of the wall isolation boards, the floor isolation boards comprising cellulose fiberboards;

installing a sound control membrane over a portion of a second area of the subfloor; and pouring cementitious product over the second area of the subfloor so that the poured cementitious product reaches a targeted height that does not exceed a top edge of the floor isolation boards.

11. The method of claim 10 wherein securing the wall isolation boards to the wall frame includes using at least two dry wall screws for each wall isolation board.

12. The method of claim 10 wherein securing the floor isolation boards to the subfloor includes using a combination of adhesives and mechanical fasteners.

13. The method of claim 10 further comprising applying a tape material at a transition between the sound control membrane and the floor isolation boards.

14. The method of claim 10 wherein the sound control membrane extends over the entire second area of the subfloor.

15. The method of claim 10 wherein the wall isolation boards comprise fire-rated cellulose fiberboard.

16. The method of claim 10 wherein the floor isolation boards comprise fire-rated cellulose fiberboard.

17. The method of claim 10 wherein a thickness of the wall isolation boards is greater than or equal to about 0.5 inches and less than or equal to about 1 inch.

18. The method of claim 10 wherein a thickness of the floor isolation boards is greater than or equal to about 1 inch and less than or equal to about 2 inches.

19. The method of claim 10 wherein the cementitious product comprises gypsum concrete.

20. The method of claim 10 further comprising installing drywall above the wall isolation boards.

* * * * *